US005865189A

United States Patent [19]

Andrews

[11] Patent Number: 5,865,189

[45] Date of Patent: Feb. 2, 1999

[54] BI-DIRECTIONAL SHAVING METHOD

[76] Inventor: Edward A. Andrews, 6835 Beach Rd., Troy, Mich. 48098

[21] Appl. No.: 653,515

[22] Filed: May 24, 1996

Related U.S. Application Data

[60] Division of Ser. No. 301,255, Sep. 6, 1994, Pat. No. 5,522,137, which is a continuation-in-part of Ser. No. 20,594, Feb. 22, 1993, Pat. No. 5,343,622.

[51] Int. Cl.[6] ..... A45D 27/00

[52] U.S. Cl. ..... 132/200

[58] Field of Search ..... 132/200, 289, 132/292; 30/50, 34.1

[56] References Cited

U.S. PATENT DOCUMENTS

| | | | |
|---|---|---|---|
| D. 253,375 | 11/1979 | Chen . | |
| D. 255,161 | 5/1980 | Chen . | |
| D. 255,163 | 5/1980 | Chen . | |
| D. 260,191 | 8/1981 | Chase et al. . | |
| D. 266,960 | 11/1982 | Gray et al. . | |
| D. 270,383 | 8/1983 | Gray . | |
| D. 271,531 | 11/1983 | Byrne . | |
| D. 271,625 | 11/1983 | Gray . | |
| D. 290,050 | 5/1987 | Jacobson . | |
| D. 294,528 | 3/1988 | Gray . | |
| D. 296,247 | 6/1988 | Gray . | |
| D. 298,068 | 10/1988 | Gilder . | |
| D. 306,216 | 2/1990 | Gray . | |
| 827,718 | 8/1906 | Vom Eigen . | |
| 875,008 | 12/1907 | Steinharter | 30/50 |
| 993,132 | 5/1911 | Warner . | |
| 998,528 | 7/1911 | Kendig . | |
| 1,171,290 | 2/1916 | Wild . | |
| 1,359,666 | 11/1920 | Brandt . | |
| 1,382,301 | 6/1921 | McCaffrey . | |
| 1,589,826 | 6/1926 | Strand . | |
| 1,598,189 | 8/1926 | Addison . | |
| 1,618,895 | 2/1927 | Taplinger . | |
| 1,633,139 | 6/1927 | Staats-oels . | |
| 1,726,570 | 9/1929 | Keene . | |
| 1,890,334 | 12/1932 | Muros . | |
| 2,517,028 | 8/1950 | Ridner, Sr. . | |
| 2,587,964 | 3/1952 | Burns . | |
| 2,789,346 | 4/1957 | Algier et al. . | |
| 2,952,910 | 9/1960 | Meohas . | |
| 2,983,045 | 5/1961 | Diatikar, Jr. . | |
| 3,109,237 | 11/1963 | Girouard . | |
| 3,263,330 | 8/1966 | Ferrara . | |
| 3,488,764 | 1/1970 | Welsh . | |
| 3,605,265 | 9/1971 | Iten . | |
| 3,675,322 | 7/1972 | Perry . | |
| 3,675,323 | 7/1972 | Braginetz . | |
| 3,702,026 | 11/1972 | Scholin . | |
| 3,724,070 | 4/1973 | Dorion, Jr. . | |
| 3,748,734 | 7/1973 | Holohan . | |
| 3,777,396 | 12/1973 | Simonetti . | |
| 3,786,563 | 1/1974 | Dorion, Jr. et al. . | |
| 3,842,499 | 10/1974 | Dorion, Jr. et al. . | |
| 3,935,639 | 2/1976 | Terry et al. . | |
| 3,938,247 | 2/1976 | Carbonell et al. . | |
| 3,950,849 | 4/1976 | Perry . | |
| 4,026,016 | 5/1977 | Nissen . | |
| 4,047,296 | 9/1977 | Ishida et al. . | |
| 4,083,104 | 4/1978 | Nissen et al. . | |
| 4,094,063 | 6/1978 | Trotta . | |
| 4,170,821 | 10/1979 | Booth . | |
| 4,205,437 | 6/1980 | Chen et al. . | |
| 4,270,268 | 6/1981 | Jacobson . | |
| 4,275,498 | 6/1981 | Ciaffone | 30/47 |
| 4,283,850 | 8/1981 | Douglass et al. | 30/47 |
| 4,285,124 | 8/1981 | Diakonov . | |
| 4,302,876 | 12/1981 | Emmett | 30/47 |
| 4,344,227 | 8/1982 | Chen et al. . | |
| 4,354,312 | 10/1982 | Trotta . | |
| 4,403,413 | 9/1983 | Trotta . | |
| 4,407,067 | 10/1983 | Trotta . | |
| 4,409,735 | 10/1983 | Carwright et al. . | |
| 4,411,065 | 10/1983 | Trotta . | |
| 4,422,237 | 12/1983 | Trotta . | |
| 4,430,794 | 2/1984 | Miller . | |
| 4,443,939 | 4/1984 | Motta et al. . | |
| 4,461,078 | 7/1984 | Carreker . | |
| 4,464,835 | 8/1984 | Bowman et al. . | |
| 4,488,357 | 12/1984 | Jacobson . | |
| 4,492,024 | 1/1985 | Jacobson . | |
| 4,492,025 | 1/1985 | Jacobson . | |
| 4,498,235 | 2/1985 | Jacobson . | |
| 4,501,066 | 2/1985 | Sceberras . | |
| 4,502,217 | 3/1985 | Schachter . | |
| 4,573,266 | 3/1986 | Jacobson . | |
| 4,586,255 | 5/1986 | Jacobson . | |
| 4,603,477 | 8/1986 | Francis . | |
| 4,621,424 | 11/1986 | Jacobson . | |

(List continued on next page.)

FOREIGN PATENT DOCUMENTS

| | | |
|---|---|---|
| 206980 | 2/1909 | Germany . |
| 52-15761 | 2/1977 | Japan . |
| 365149 | 2/1932 | United Kingdom . |

*Primary Examiner*—Todd E. Manahan
*Attorney, Agent, or Firm*—Harness, Dickey & Pierce, P.L.C.

[57] ABSTRACT

Several single-head bi-directional razor devices and systems are disclosed. Each has a narrow, elongated bi-directional razor head attached or attachable to a transversely extending hand grip. The razor head may be constructed as a disposable cartridge if desired. Two pairs of narrow, razor blade strips are positioned within the head, with one pair of blades extending in one direction and the other pair generally extending in an opposite direction. Both sets of blades extend along the length of the head. The user may move the razor head in one direction for contacting one pair of blades against the user's skin for cutting hair and then, without lifting or tilting or repositioning the hand grip, move the handle in the opposite direction so that the other pair of blades cuts hair during reverse movement of the razor. In other words, the head remains engaged upon the skin for cutting hair in both directions. In some embodiments, the razor head is rigidly attached to the handle. In other embodiments, the head may move relative to the handle upon pivots or shell bearings. Several different constructions and classes of assembled bi-directional razor head structures are disclosed. They differ from one another in terms of shape or size of the head, and in the way the blade strips are captured, held and oriented within the head. The heads may be molded or assembled structures.

11 Claims, 18 Drawing Sheets

U.S. PATENT DOCUMENTS

| | | | |
|---|---|---|---|
| 4,756,082 | 7/1988 | Apprille, Jr. . | |
| 4,774,765 | 10/1988 | Ferraro . | |
| 4,807,401 | 2/1989 | Atwater . | |
| 4,875,288 | 10/1989 | Trotta et al. . | |
| 4,916,817 | 4/1990 | Atwater . | |
| 4,944,090 | 7/1990 | Sumnall | 30/41 |
| 4,980,974 | 1/1991 | Radcliffe . | |
| 5,003,694 | 4/1991 | Chen | 30/49 |
| 5,056,221 | 10/1991 | Thoene . | |
| 5,060,377 | 10/1991 | Althaus et al. . | |
| 5,084,968 | 2/1992 | Trotta . | |
| 5,090,124 | 2/1992 | Althaus . | |
| 5,113,585 | 5/1992 | Rogers et al. . | |
| 5,133,131 | 7/1992 | Hoffman . | |
| 5,153,992 | 10/1992 | Brown et al. . | |
| 5,161,307 | 11/1992 | Althaus . | |
| 5,287,624 | 2/1994 | Mondo et al. . | |
| 5,307,564 | 5/1994 | Schoenberg . | |
| 5,343,622 | 9/1994 | Andrews | 30/50 |

FIG-9
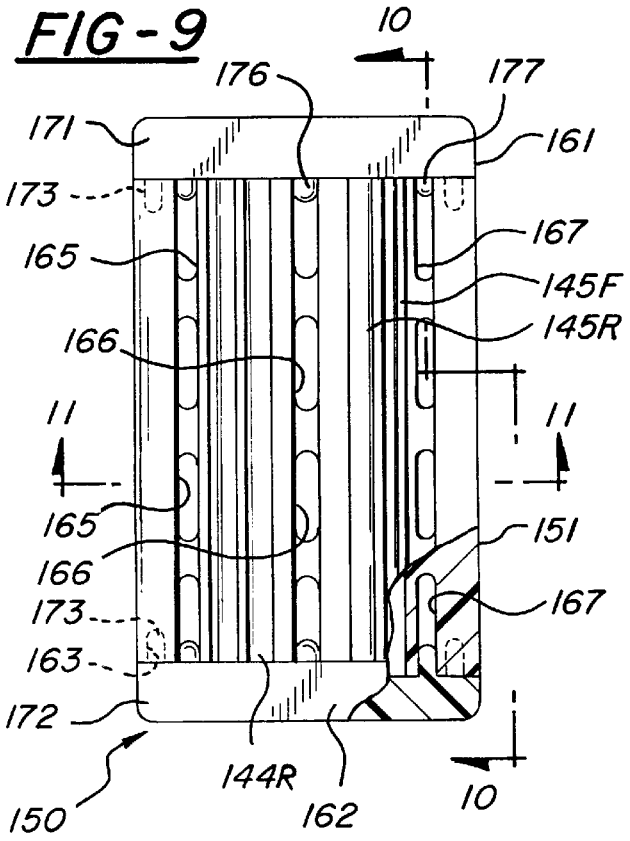
FIG-10
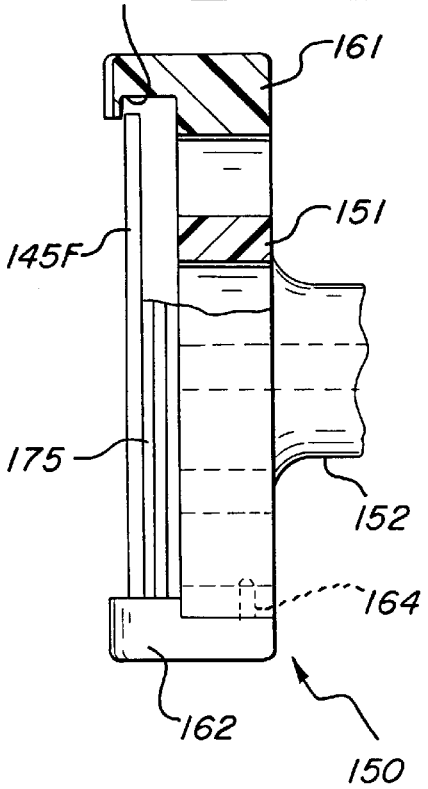
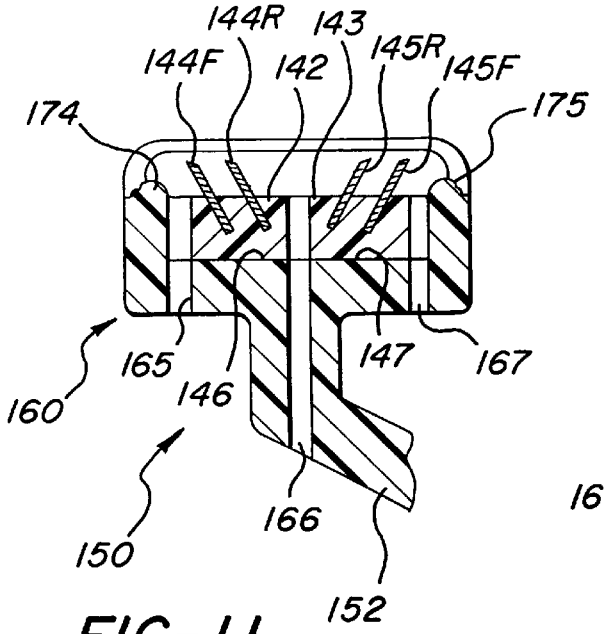
FIG-11
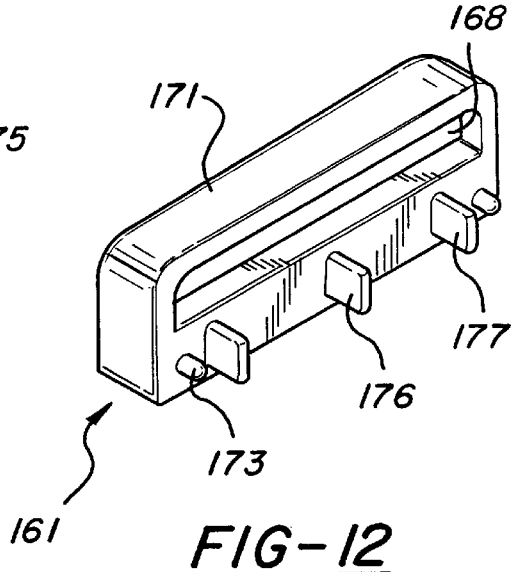
FIG-12

FIG-13
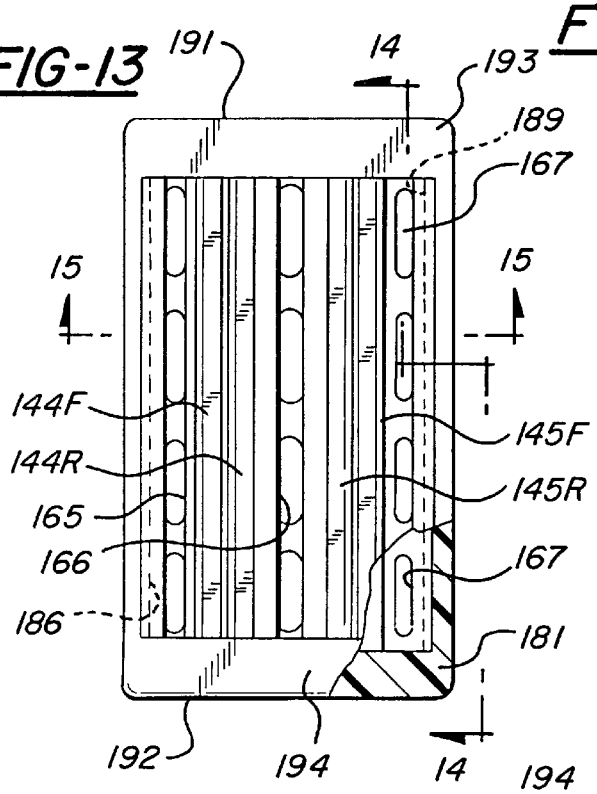
FIG-14
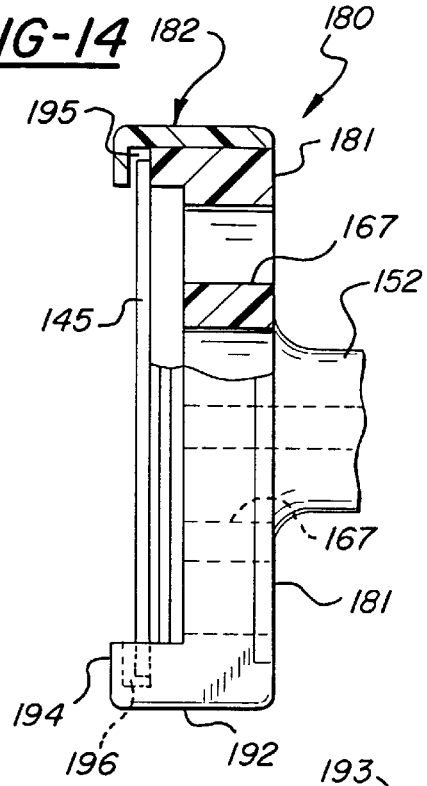
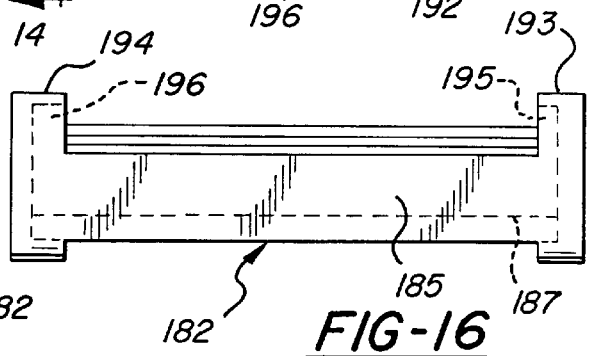
FIG-16
FIG-15
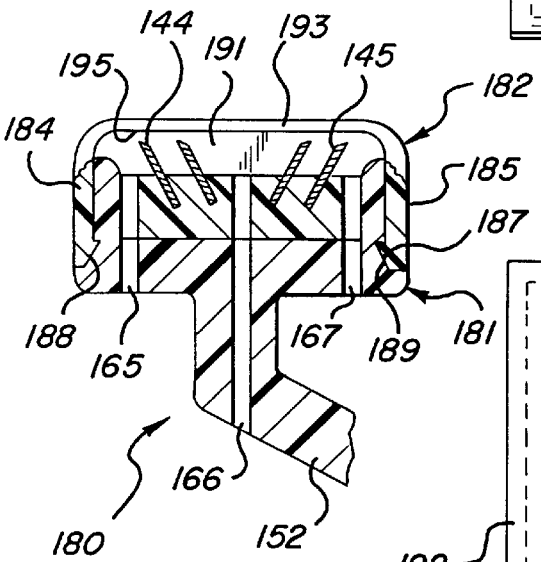
FIG-17
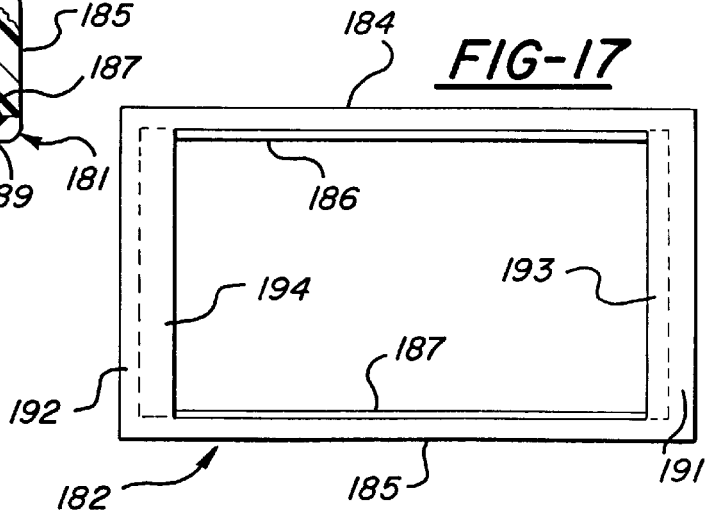

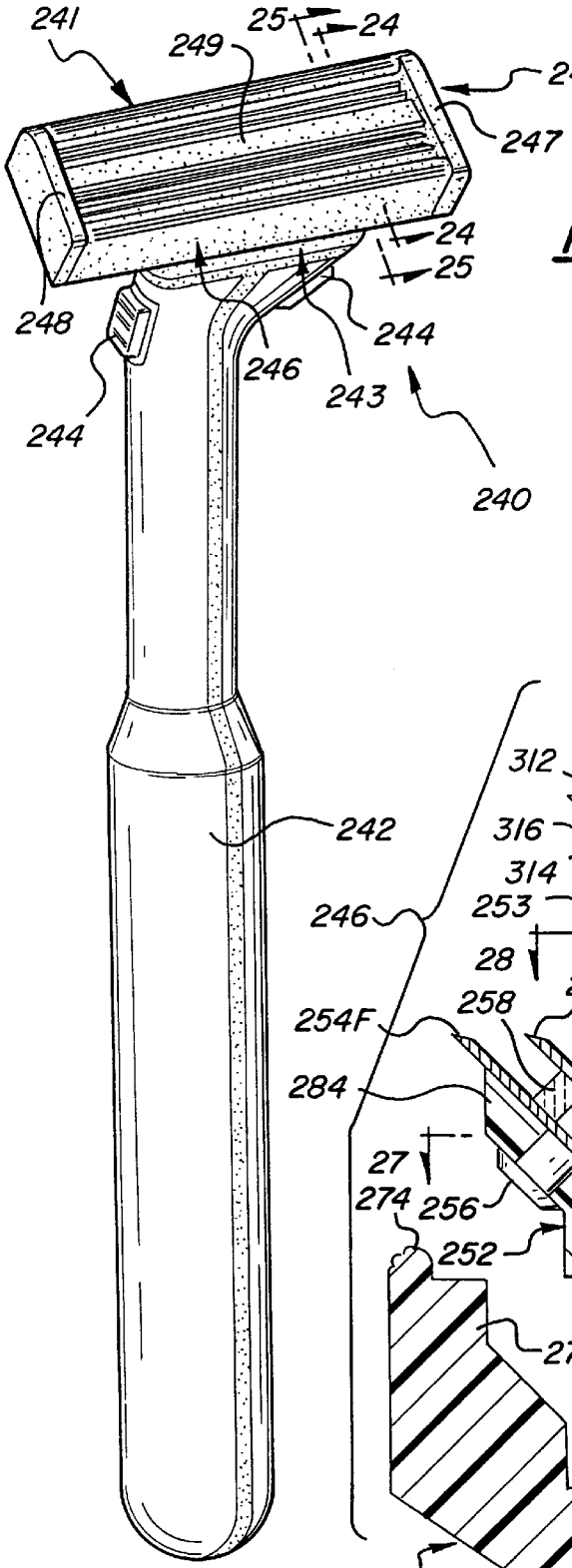
FIG-23
FIG-24
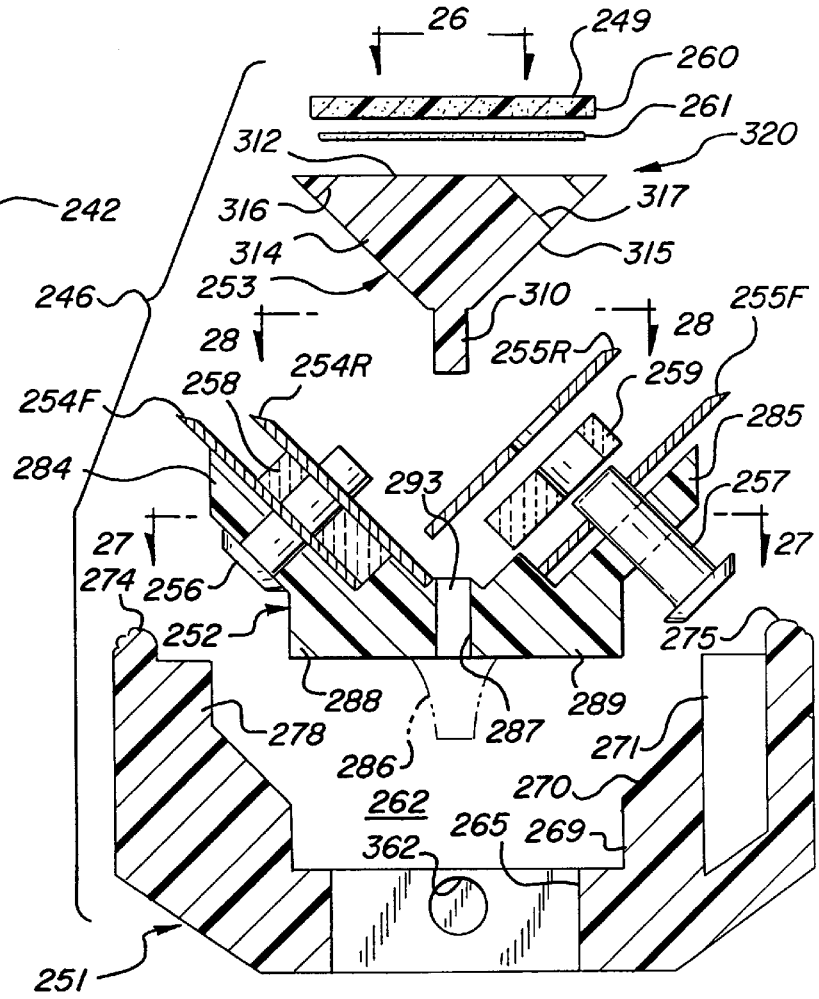

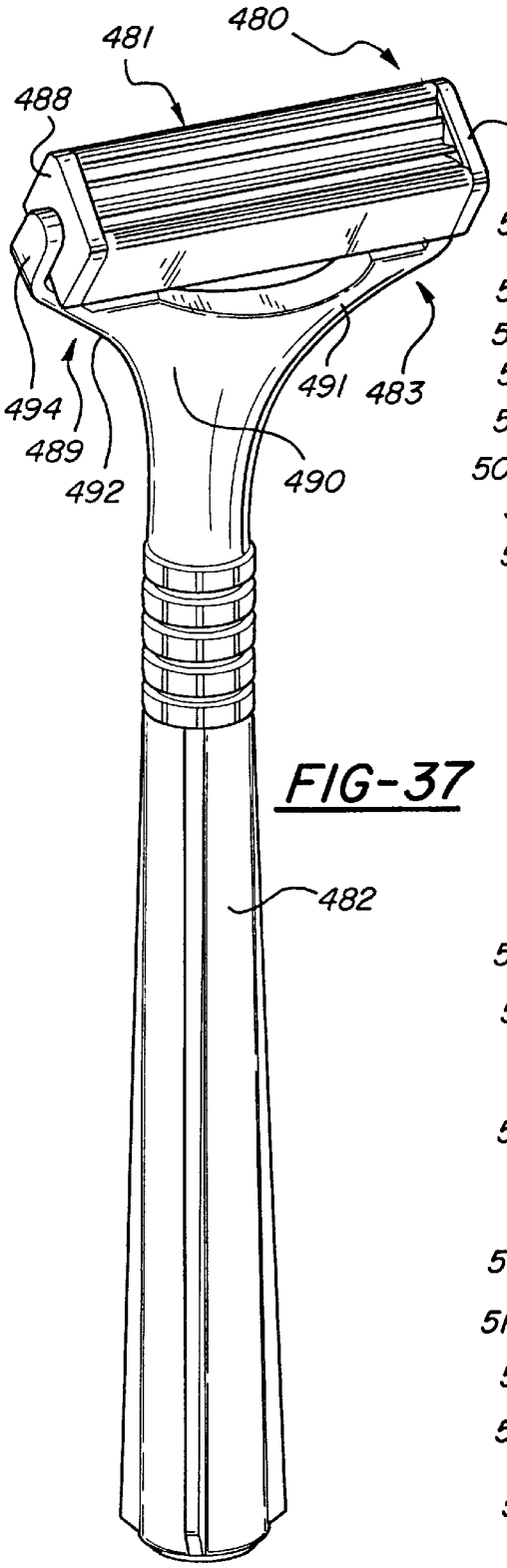
FIG-37
FIG-39
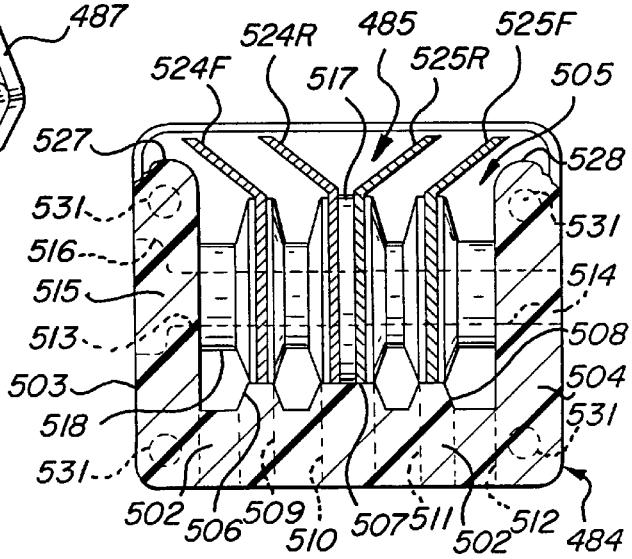
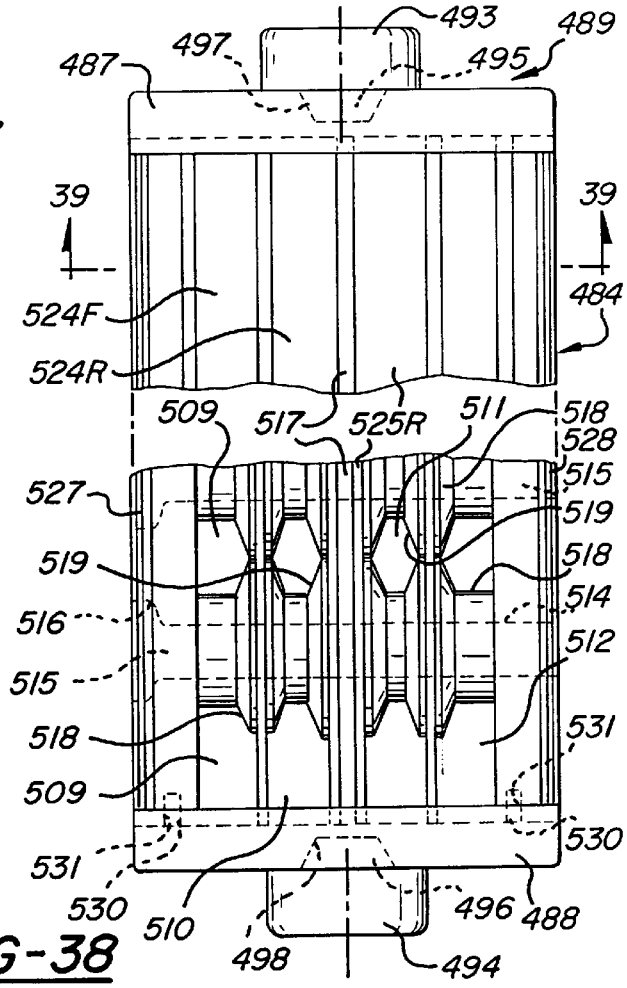
FIG-38

FIG-43
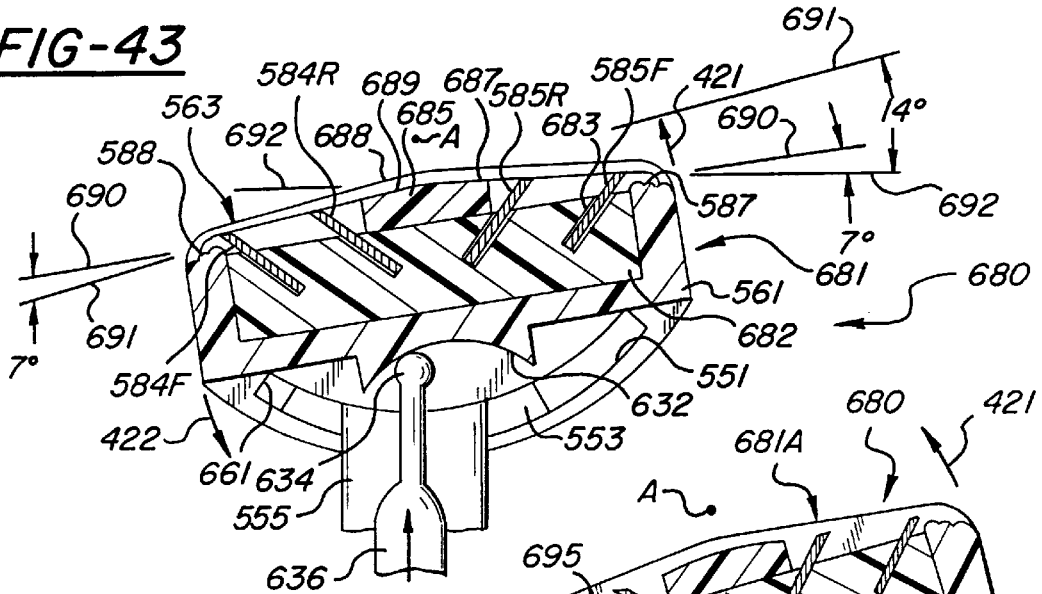
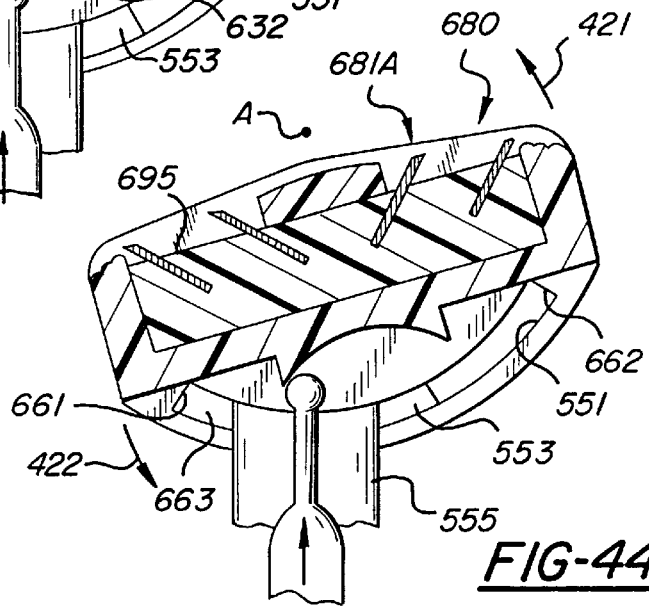
FIG-44
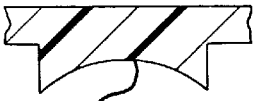
FIG-45A
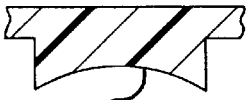
FIG-45B
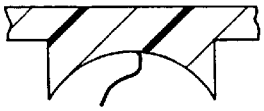
FIG-45C
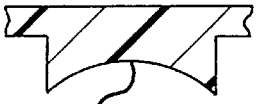
FIG-45D
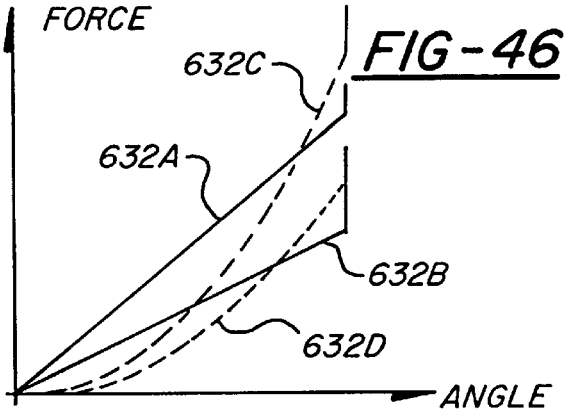
FIG-46
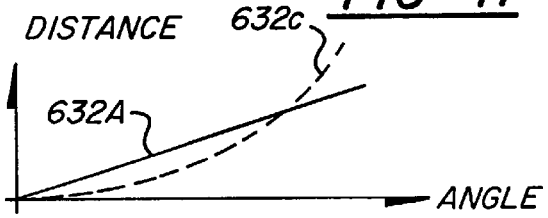
FIG-47

FIG-52
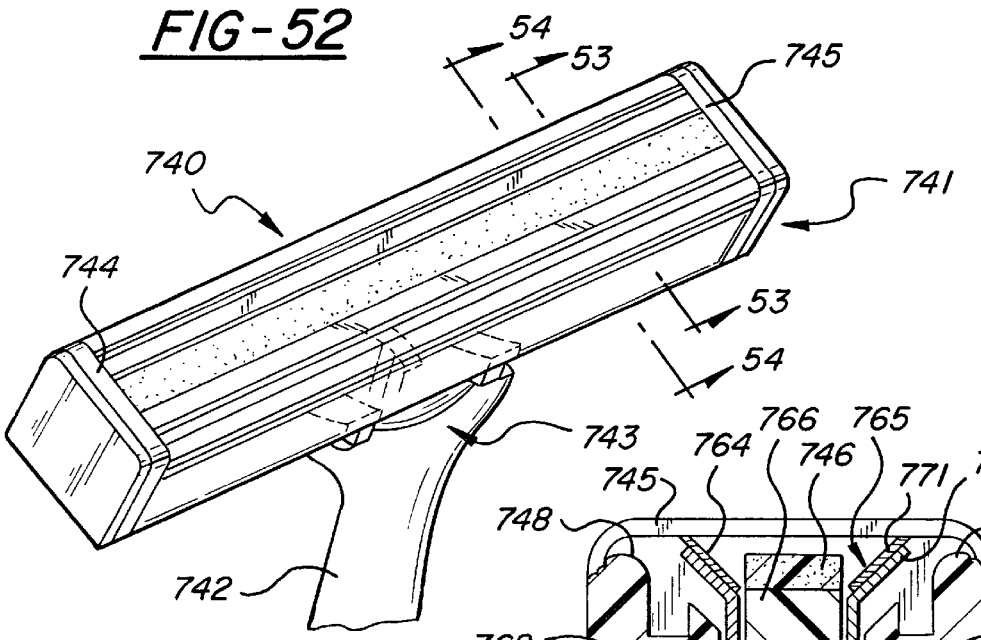
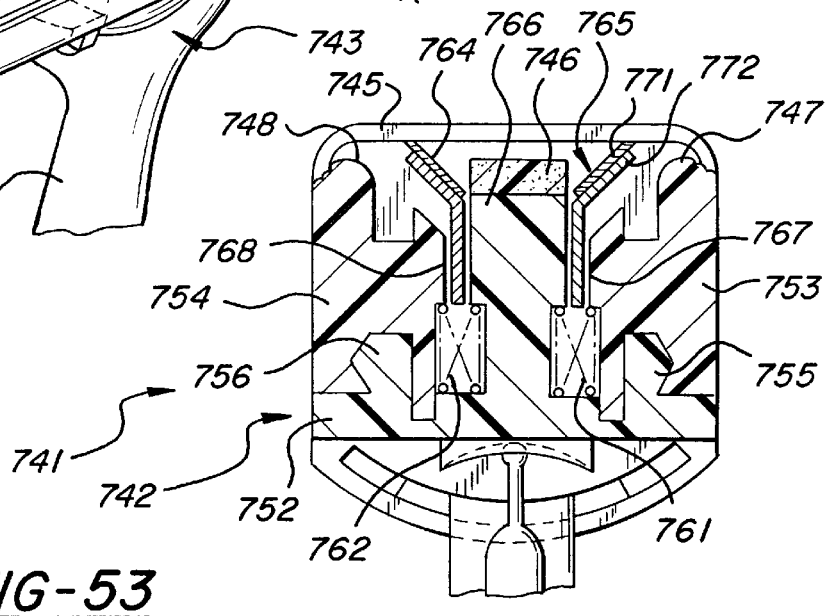
FIG-53
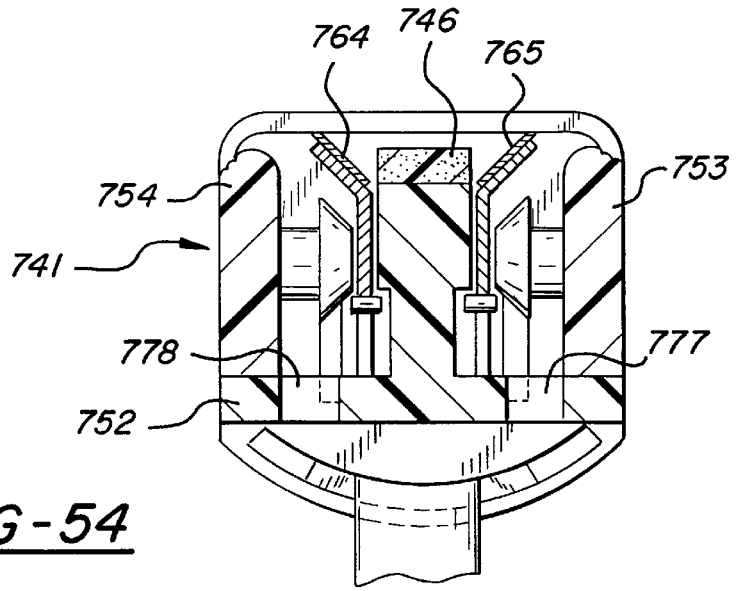
FIG-54

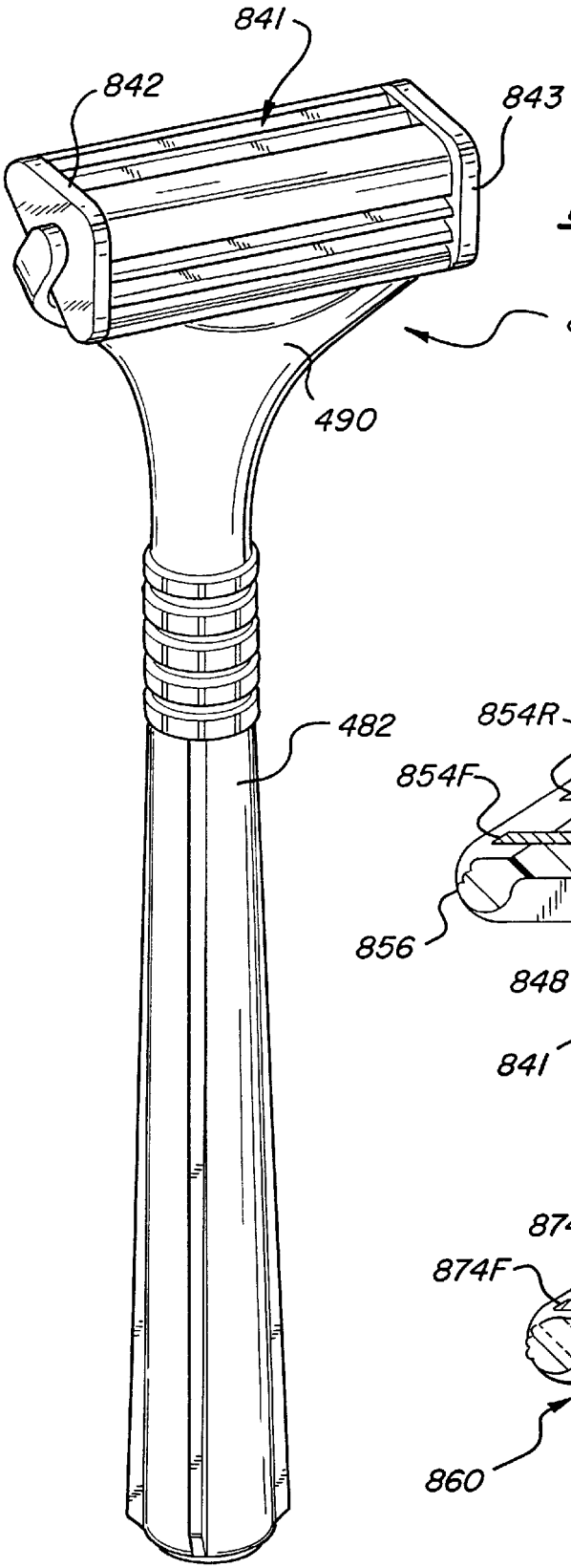
FIG-57
FIG-58
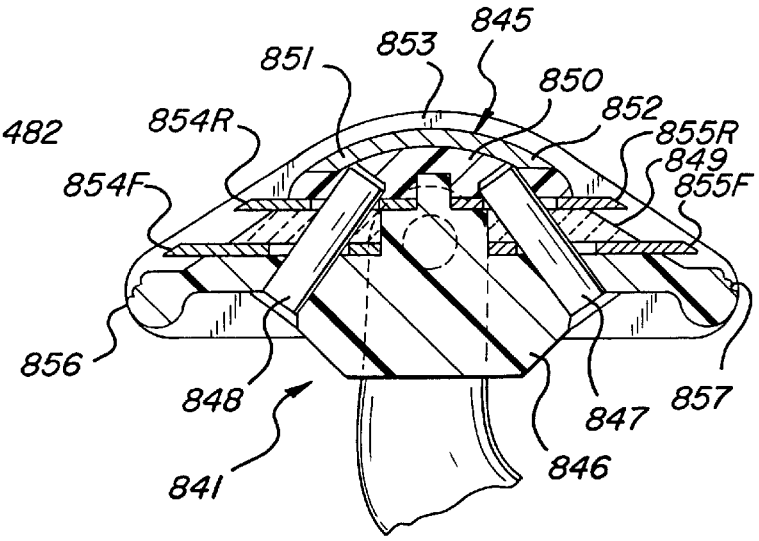
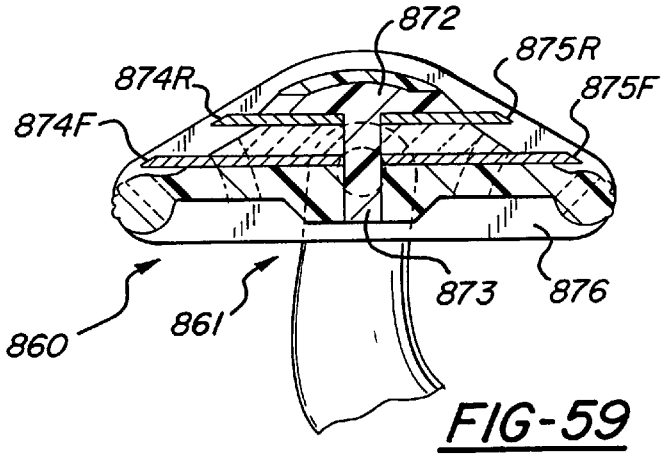
FIG-59

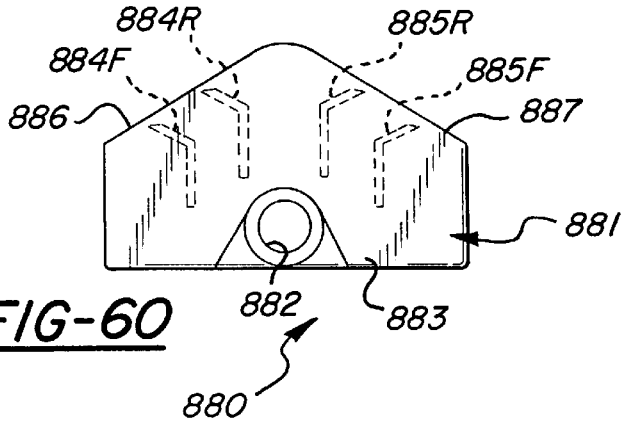
FIG-60
FIG-64
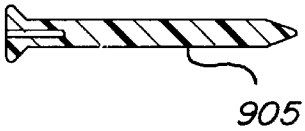
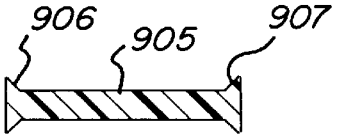
FIG-65
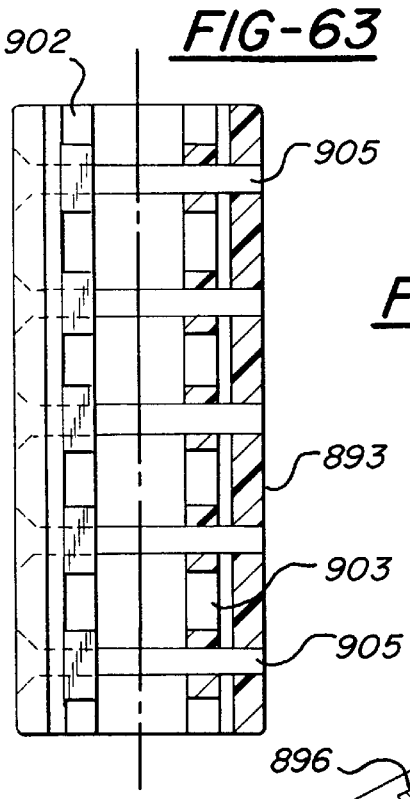
FIG-63
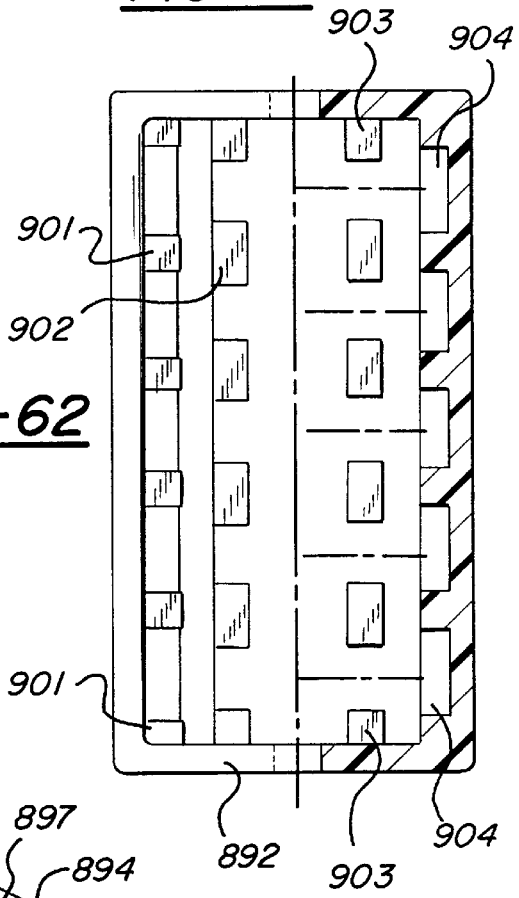
FIG-62
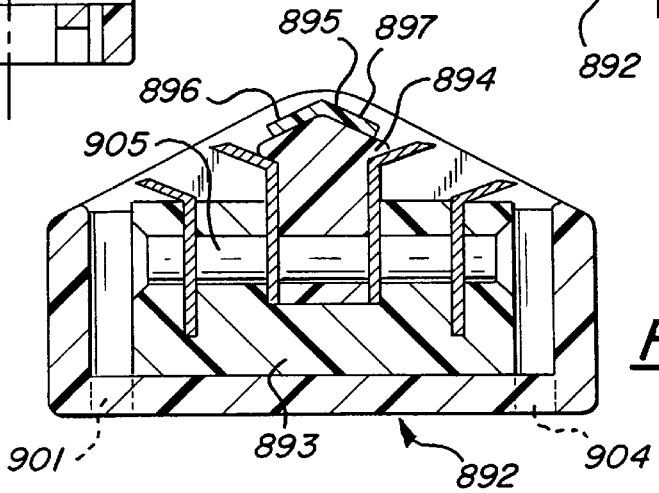
FIG-61

FIG-66
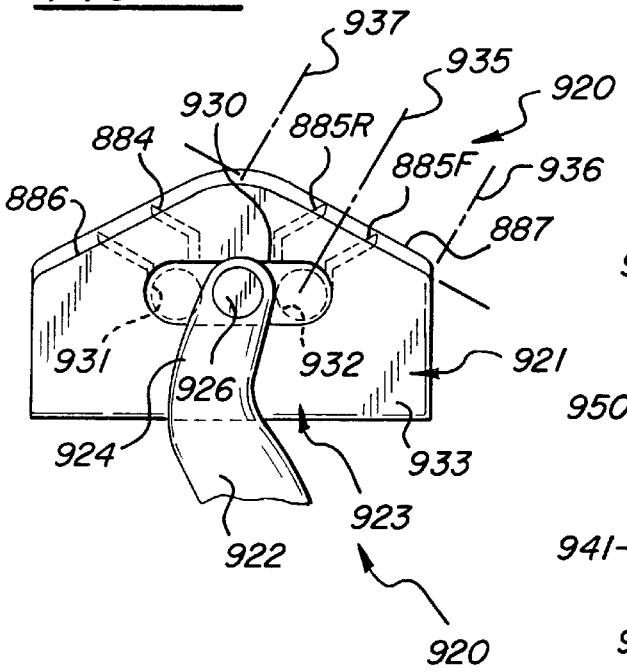
FIG-68
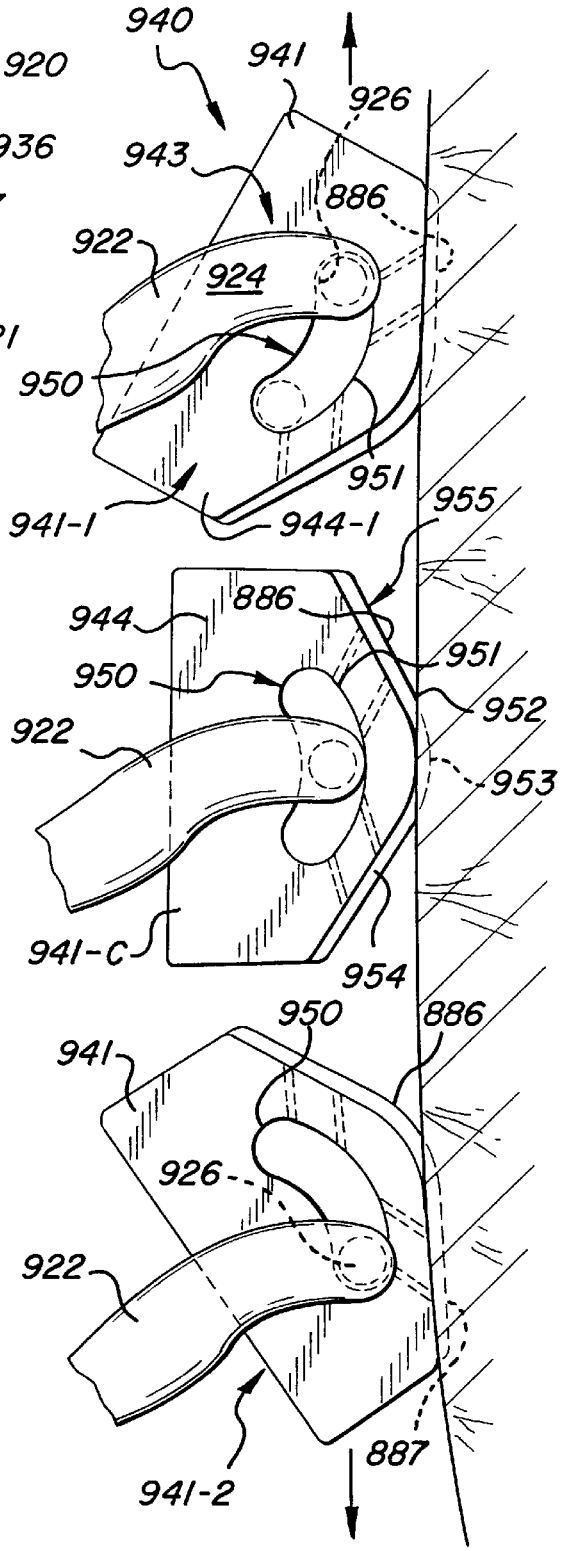
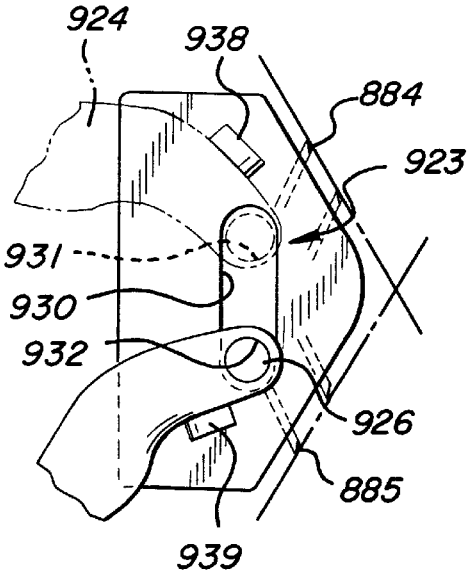
FIG-67

BI-DIRECTIONAL SHAVING METHOD

CROSS-REFERENCE TO RELATED APPLICATION

This is a division of U.S. patent application Ser. No. 08/301,255 filed Sep. 6, 1994, now U.S. Pat. No. 5,522,137, which is a continuation-in-part of U.S. patent application Ser. No. 08/020,594 filed Feb. 22, 1993, now U.S. Pat. No. 5,343,622 issued Sep. 6, 1994.

FIELD OF THE INVENTION

The present invention relates in general to hand-held razor structures, cartridges and systems for wet shaving, and in particular, to hand-held highly maneuverable razor structures, cartridges and systems for wet shaving, which all feature a plurality of razor blades and the ability to operate bi-directionally.

BACKGROUND OF THE INVENTION

Uni-directional Razors. Modern conventional razors are typically made with either one or a pair of parallel strip-like razor blades secured upon the head of the razor. A handle extends from the head. The user holds the handle and ordinarily scrapes or moves the head in one direction along the skin so the blade or blades will cut the hair. After each movement in one direction, when the stroke is completed, the user lifts the razor and brings it back to a point near the original starting position for a second stroke in the same direction. Thus, conventional razors are uni-directional in operation.

Razors have also been made in which the head holds a single flat safety razor blade with two sharpened blade edges extending in opposite directions. These older style of razors have their blade edges spaced apart on opposite sides of the head, and angled so that they are and operate so as uni-directional devices. That is, the first blade edge is used until dull or filled with lather or cut hairs. Then the user manually turns the razor 180 degrees to present the opposite blade edge toward the skin. Such a single replaceable razor blade having two sharpened edges and mounted within a head of a razor that can be opened and closed was at one time very common, and it provided the user with twice the blade life, i.e., once for each sharp edge in uni-directional shaving.

Replaceable Cartridge Razors. Many conventional razors used for shaving have a handle or hand grip structure with means for securing a replaceable razor blade cartridge to it. These cartridge razor systems are desirable, in that a more expensive, ergonomic permanent handle, which can be reused thousands of times, can be provided and used in conjunction with a much less expensive replaceable cartridge containing the razor blades. The blades in such cartridges dull fairly rapidly with use. Thus they are frequently replaced, typically after just a dozen or less shaves. A variety of techniques and cartridge structures have been developed to allow the entire razor head to be readily replaced by the user of the razor.

Conventional Razor Head Constructions. Conventional safety razors typically comprise a guard or deck member and a cap member between which the razor blade or blades are sandwiched when the razor is ready for use. The handle, the guard member and cap member traditionally are all fixed relative to one another. The razors may be provided with a single or double-edged blades. In recent decades, the entire shaving unit or head has been made to be disposable.

A conventional modern razor cartridge typically has a blade seat having formed thereon a guard bar for smoothing the skin adjacent to the cutting edge or edges of the razor blade during shaving. The blade seat may include a channel which can be used to re-load the cartridge if the cartridge is reusable. A cap is provided to complete the main supporting structure of the razor cartridge. The blades are often retained by the passing of plastic pins through holes in the blades and then passing the pins into a heading which forms part of the cap. In this manner, the cap holds the blade or blades in place. The cap typically is pinned, fused, cemented or otherwise bonded together with the blade seat structure and captivates the blade or blades, and any spacers between them.

Wet Razors With Pairs of Blades. In recent years, almost every new wet razor blade system has a pair of parallel strip-like razor blades positioned closely to one another.

These parallel-blade constructions are typically used in razor cartridges that are disposable. The handle may also be disposable or it may be essentially permanent and meant to be re-used with many cartridges. In many of these systems, the pair of blades is encased in a razor head or cartridge which provides a fixed orientation of the blades to the skin through the use of leading, trailing and glide surfaces which define a working plane of the razor head. These various surfaces of the head all bear against the skin being shaved, and thus ensure the sharpened edges of the blade strips are presented at the proper angle to skin being shaved.

Guards For Blade Corners. The sharpened corners of the razor blade strips are guarded by the configuration of the head or cartridge structure for the safety of the user, so the corners do not cut the skin. The head often has an elongated narrow configuration to provide the user with the ability to shave the skin under the chin and nose and wherever the contours of the face are changing rapidly.

Staggered Double-Edged Blade Sets. U.S. Pat. No. 4,470,067 to Trotta discloses a double-edged blade configuration in a razor head. It is said to achieve a desired geometrical relationship between the leading and following cutting edges of the blades so that both are successively active with respect to hair elements being cut during a single shaving stroke. The razor's guard structure is disposed in fixed relation to the cutting edges to define desired relationships including a desired "blade tangent angle", and a preferred "exposure" and "span" and provides definitions for these terms. The platform member includes a back portion upstanding from the blade support portion. The guard and back portions define parallel opposite lengthwise edges of the platform member. As such, they define a single "working plane" which bears against the skin and controls the angle at which the sharpened edges of the blades are allowed to bear against a section of the skin to be shaved as the blade is moved in a single direction.

Pivotal Head Razors. Razors which have a fixed relationship between the head and the handle require considerable maneuvering in order to maintain the shaving unit at its optimum attitude on the shaver's face, particularly when negotiating areas such as the jaw line, where there are rapid changes in facial contour. To provide improved shaving characteristics, many razors have been provided with a pivotable head or cartridge, which is preferred by some users of manual safety razors.

In such a pivoting head or cartridge structure, the portion of the handle nearest the cartridge typically includes one or two spring-loaded mechanisms. The first is used to return the pivoting head to its center or at-rest position. The second is provided if the razor has a removable cartridge. In such case, the cartridge is typically held onto the handle by two pivot pins or bearing surfaces which engage in an interlocking manner with complementary sockets or arcuate slot structures located on the bottom of the cartridge. Since the handle can be re-used over and over, it is more economical to equip the essentially permanent handle with a more expensive mechanism for providing this spring-loaded pivoting, attachment structure than could be economically built into the disposable cartridge which is frequently replaced. This approach results in a cartridge having fewer spring-loaded components resident on it, thus reducing its cost.

Pivots Using Pins. To avoid lengthening the razor's head, pivoting arrangements located on the underside of the shaving unit or head away from the blades have been devised. An example is found in U.S. Pat. No. 4,094,063 to Trotta, which discloses a razor including a handle and shaving unit or head with the upper end of the handle including means for pivotally mounting the shaving unit so that the unit is free to pivot upon the handle during a shaving operation. The handle is a one-piece plastic molding and has means for biasing the pivotally movable shaving unit towards a central position. The connection between the upper end of the handle and the head is made through pivot pins directed axially inwardly. A leaf spring and stop blocks are provided for returning the head to an at-rest center position.

Pivots Using Shell Bearings. Another advance has been the use of juxtaposed, spaced, inner and outer, arcuate bearing segments and cooperating hollow shaft segments (also called guide rails) which are received into bearing engagement with the inner and outer bearing segments. The interengaged bearing segments and shaft segment define an axis of rotation for the shaving head that is located immediately adjacent the active elements or blades of the shaving system. This axis extends parallel to the cutting edges of the blades. In other words, each set forms an interengaged flange and groove elements with the end of the flange elements cooperating with the base of the groove elements in a thrust bearing relation. In use, the shaving unit is thus pivotally positioned along the skin so its cutting edges are parallel to the pivotal axis formed by the shell bearing members. An example of this approach is found in U.S. Pat. No. 3,935,639 to Terry et al. The Terry razor also includes a spring that acts between the handle and support member to bias the support member towards a middle position of pivotable adjustment relative to the handle.

Self-Lubricating Glide or Shaving Assist Strips. Modern razors often have a solid water-soluble shaving assistance or glide strip to provide a lubricant, whisker softener, razor cleaner, medicinal agent, cosmetic agent or a combination of the above as part of the disposable cartridge or razor itself. Such shaving aids are thus embedded in or formed as part of the glide strip which typically is affixed in the vicinity of the working plane of the razor, often in close proximity to the working edges of the blades. The shaving aid strip may be a shave-aiding agent combined with a solid, water-soluble micro-encapsulating or micro-porous structure which retains the agent. The strip can be the agent itself when it is a water-soluble solid. Exemplary materials constituting shaving aid strips are described in U.S. Pat. No. 4,170,821 to Booth, which is hereby incorporated by reference.

Flexible Razors. Flexible razor blade cartridges have also recently become popular.

These may include a pair of flat blades which can flex while remaining captivated alongside or within an integral segmented flexible blade support structure and guard bar. Two examples are shown in U.S. Pat. No. 4,409,735 to Cartwright et al. and U.S. Pat. No. 4,443,939 to Motta et al., the disclosures of which are hereby incorporated by reference.

The Uni-directional Razor Approach. In all of these conventional razors, the razor head is used for shaving in one direction only. For example, in shaving the user's face or legs, the user holds the handle of a conventional razor and moves the razor, with the blades contacting the skin, in one direction for cutting the hair extending from the skin. Normally, when the movement in one direction is completed, the user lifts the razor from the skin and brings it back to a point near the original starting position for moving the razor again in the same direction. These razors, whether of the fixed head-and-handle type, or of the fixed or pivoting cartridge-type, are uni-directional in operation, since the user strokes the razor in a single direction for cutting the hair.

Early Attempts At Bi-Directional Razors. I recognized that, in many instances, it would be desirable to have a bi-directional razor for more rapidly and efficiently shaving the user's face or arms or legs. That is, it would be convenient to provide a single-head razor construction which is usable for stroking first in one direction and then stroking backwards in the reverse direction without the necessity of the user rotating the entire razor by the handle 180° degrees, so as to reduce the time and effort required in shaving. It is a primary object of this invention to provide several such bi-directional razors.

Limited efforts have been made to provide bi-directional razors, but with little success. U.S. Pat. No. 3,488,764 to Welsh discloses two razor blades mounted on a split head with a gap in between. Each blade strip is in effect mounted on its own head, and sharpened edges of two opposed blades face each other.

U.S. Pat. No. 4,501,066 to Sceberras discloses a dual-headed razor system having a single handle, with a pair of separately detachable razor heads separately connected to the handle. Each head has a pair of blades mounted on it. The razor system is said to be useful in shaving forwardly and rearwardly in to and fro strokes. So, like in the Welsh design, there are two heads, which means the Sceberras structure is wide and has limited maneuverability.

Further, using two heads adds significantly to the cost of the bi-directional razor approach by requiring two cartridge support structures and two cartridges. In addition, the working planes of the blades face one another. Thus, it appears that the Sceberras design on a relatively flat area of skin requires an unusual four-step shaving technique, namely: (a) tilt handle rearward to put the blades of forward head into optimum cutting position, (b) stroke the heads forward, (c) tilt handle forward to put blades of rearward head into optimum cutting position, and (d) stroke backwards.

Improvements In Bi-Directional Razors Are Still Needed. From my perspective, it would be desirable to provide improved bi-directional razor systems, structures and cartridges which allow the user to shave rapidly, effectively and efficiently. That can be accomplished, in accordance with my invention disclosed herein, by providing, on a single razor head, a plurality of blades facing away from one another. Such a razor head construction is usable in a bi-directional mode: that is, the razor head can be stroked in one direction and then reversed and stroked back in the opposite direction, without lifting or turning or repositioning the razor relative to the user's skin. The present invention is concerned with providing such bi-directional razor systems, heads and cartridges.

A first principal object of this invention is to provide several different single-head razor blade constructions, each of which can be used bi-directionally. Each razor construction features a single head which can be moved back-and-forth to shave in two opposite directions by the user who holds and uses the handle in his or her normal manner of holding and using a typical, conventional razor when shaving in one direction. Thus, the user is not required to hold or tilt the razors of my invention any differently than when holding and using a conventional razor. Further, it is a related object to provide such a bi-directional razor which may be used in two opposite directions without lifting or turning or tilting or repositioning the razor relative to the skin. Consequently, this object of the present invention is to provide a razor device which enables the user to simply move the razor back-and-forth, cutting hair in both directions, so as to substantially reduce the time and effort spent shaving.

A second principal object of the present invention is to provide for several different constructions of a economically made, bi-directional cartridge for a razor. In each construction, the object is to provide for either double pairs or two single blades mounted so that the cartridge can be manually removed from the razor and replaced with a fresh cartridge whenever the blades become sufficiently dull or the user otherwise wishes to change blades. Thus, the user may continually use the same razor handle by changing cartridges as desired.

A third principal object of the present invention is to provide a replaceable bi-directional cartridge structure which can be used on a conventional razor blade handle directly in place of a conventional uni-directional razor cartridge.

A related fourth principal object of the present invention is to provide compact bi-directional razor structures which can be used as effectively as present-day uni-directional razor heads to shave in tight locations such as on the face, near the nose and under the chin.

A fifth principal object of the present invention is to provide an improved manual shaving method, namely bi-directional shaving using a razor system having a single razor head supporting first and second pairs of blade strips arranged so that the sharpened blade edges of each set face away from the sharpened blade edges of the other set, whereby the handle of the razor need not be lifted, tilted or twisted as the shaving head or unit is moved back and forth in opposite directions to shave an area of the skin.

A sixth object of the present invention is provide a wet razor system that will more readily deliver a closer shave than conventional uni-directional dual-blade wet razor systems, by virtue of facilitating shaving the skin in two different directions, and by scraping and conditioning the skin to be shaved with one or two razor blade edges moving in a non-cutting direction.

A seventh object is to provide a wet shave razor blade system that stays sharper longer than a conventional uni-directional razor blade system by virtue of having twice as many shaving edges.

An eighth object is to provide several different constructions of bi-directional razor heads which are particularly economical to manufacture at a cost essentially equal to or slightly more than the cost of conventional uni-directional razor blade heads.

A ninth object is to provide a few different bi-directional razor blade constructions which are able to pivot or swivel while being used, in order to more readily follow the contour of the skin to be shaved.

A tenth object of the present invention is to provide a very stable shell-bearing razor head structure having improved skin-tracking action by virtue of an axis of head rotation being located above the working plane of the blades, that is beneath the skin to be shaved.

An eleventh object is to provide a few different bi-directional razor head structures especially designed to each have a very thin profile to facilitate shaving in tight locations, where the surface topography of the skin is concave and rapidly changing, and awkward to reach, like the inward curvature under the chin.

A twelfth object is to provide several different bi-directional razor blade structures wherein two pairs of blade strips both make effective use of a single glide or lubricant strip located between them.

A thirteenth object of the present invention is to provide bi-directional razor head constructions which feature all of the blade strips in substantially the same working plane.

A fourteenth object is to provide bi-directional razor structures each having two pairs of blade strips, with each pair being located in its own working plane facing away from and intersecting the other pair's working plane at an angle in the range of about five degrees up to about fifteen or more degrees.

A fifteenth object of the present invention is to provide a few different pivoting bi-directional razor structures wherein the two pairs of blade strips are each located in their own working plane facing away from the other working plane, with the two working planes intersecting one another at an angle of about twenty degrees or more, but with the pivot mechanism of razor so arranged that the two sets of blade strips during shaving operate in the same effective plane adjacent the user's skin.

A sixteenth object is to provide pivoting bi-directional razors having two working planes, in accordance with the fifteenth object, that are compactly and simply constructed, and have a thin profile.

A seventeenth object is to provide a few different bi-directional razor heads with either a pivot mechanism or a pivot-and-slide mechanism which facilitates changes in the orientation of the bi-directional head relative to the user's skin without the need for the user to lift, tilt or twist the handle of the razor as the shaving head is moved back and forth in opposite directions to shave an area of the skin.

An eighteenth object of the present invention is to provide a pivoting or swiveling razor head having an adjustment mechanism which allows the user to adjust the return-to-center force associated with the pivoting or swiveling action.

A nineteenth object is to provide a bi-directional razor head which is flexible and permits the two sets of blade strips to bend while being used so that the working pair of blade strips may more closely track the contours of the user's skin being shaved.

A twentieth object of the present invention is to provide a bi-directional razor construction where the razor blades are individually spring-loaded and may move independently in response to skin forces substantially perpendicular to the direction in which the razor head is being moved along the skin, so as to permit the individual blade strips to more closely conform to changing contours of a user's skin during shaving.

Still other objects of the present invention will become apparent from the descriptions of the preferred embodiments of the present invention which follow.

SUMMARY OF THE INVENTION

Eighteen different embodiments of the bi-directional razors of the present invention are disclosed below, and all can be characterized as follows. In accordance with one aspect of the invention, there is provided a single-head bi-directional razor with at least two blade strips, whose sharpened edges extend in opposite directions. The bi-directional razor comprises: a single elongated razor head; a hand grip or handle supporting the head for manual movement by a user of the razor; a first razor blade strip supported by the head and having a sharpened blade edge portion; and a second razor blade strip supported by the head and having a sharpened blade edge portion which extends in a direction away from the edge of the first razor blade strip.

The elongated razor head preferably has first and second longitudinal edges, and a face and a longitudinal axis. The face and axis are generally located between the longitudinal edges. The face may be generally flat, or it may be curved. The sharpened blade edge portion of the first razor blade strip extends outwardly at an acute angle relative to the face of the razor head. It projects generally toward the first longitudinal edge of the head and away from the longitudinal axis of the head. Similarly, the second razor blade strip has its sharpened blade edge portion extending outwardly at an acute angle relative to the face. This second sharpened blade edge portion projects generally toward the second longitudinal edge of the razor head and away from the longitudinal axis. Thus, the sharpened edges of the first and second blades point generally away from one another.

In preferred embodiments of the single-head bi-directional razor of the present invention, two pairs of razor blade strips are provided, and all strips are preferably of the same length. The third razor blade strip is supported by the head and has a sharpened edge portion that is arranged closely adjacent to and spaced a short distance from the sharpened edge portion of the first blade strip. In this manner, the first and third blade strips form a first pair of blades, and cut hair substantially simultaneously as the razor is moved in a first direction along the user's skin. Similarly, the fourth razor blade strip is arranged closely adjacent to and spaced a short distance from the second blade strip, and form a second pair of blades. The sharpened blade edge portions of this second pair of blade strips cut hair substantially simultaneously as the razor is moved in a second direction opposite from the first direction along the user's skin.

Several distinctly different embodiments of my single-head bi-directional razor with two sets of blade strips as generally described above are disclosed. The razor blade strips may be molded into the razor head, or may be part of an assembled head structure that is designed for holding the blade strips fixedly in place, or movably in place. Examples of the molded style of construction and of the assembled style of construction are provided in the different embodiments of the present invention presented herein.

As is well known, modern conventional uni-directional safety razors often have a pair of adjacent razor blade strips mounted parallel to one another between a forward guard bar, a rear glide strip or surface, and blade-end caps or shields. This modern style of safety razor construction reduces the chance that the razor blade edges will accidently nick or cut the skin during shaving. As is well known, the two parallel blade strips have their edges projecting into a working plane of the razor that is also in part defined by the surfaces of the guard bar, glide strip or surface and end caps which contact the user's skin. These non-cutting surfaces of the safety razor, which are in or very near to the working plane of the razor, help ensure that the blade edges are presented to and engage the skin of the user to be shaved at a proper angle so as to minimize the chance of nicks or cuts to the skin.

The bi-directional razors of the present invention are preferably constructed in a manner which incorporates those advantages found in the modem uni-directional safety razors. However, the bi-directional razors of the present invention preferably utilize two front guard bars, one for each of two opposite directions of transverse movement of the razor head across the skin, and a single glide strip or surface centrally located between the two sets of blades. The blade-end shields, which may take the form of a pair of end caps or raised end portions on the razor head, are configured to shield the end corners of both sets of blade strips. Further, the bi-directional razor heads of the present invention are preferably constructed to have a symmetrical appearance or face.

According to a second aspect of the invention, the bi-directional razor heads of the present invention may be constructed as disposable cartridges, designed to be used with reusable handles. In one embodiment according to this aspect of the invention, the bi-directional cartridge may be formed of molded plastic material. It is preferably shaped as an elongated, narrow member which can be mounted upon a razor having a handle. The cartridge can thus be removed and replaced with a new cartridge when desired.

In another embodiment of the bi-directional cartridge, a molded construction is utilized. Pairs of parallel, closely spaced, single edge, strip-type razor blades are embedded in plastic material. The plastic is molded directly around the lower portion of the blade strips, thus anchoring the blades in place.

In yet other embodiments, the main razor blade support structure of the cartridge is pre-molded of plastic or other suitable material. It can be made of either flexible material or substantially rigid material. In either case, the blade strips are inserted afterwards into the pre-molded structure. End caps or blade-retaining bands are then attached to keep the blades in position. In the rigid pre-molded head structure, the blades may be rigidly fixed in position, or they may be individually spring-loaded, and confined to move up and down generally perpendicularly to the working plane. In the flexible molded head structures, the blades are allowed to move with the head in a direction that is substantially perpendicular to the direction of head travel during use and to the longitudinal axis of the cartridge.

In some embodiments of my bi-directional cartridges, the razor head of the cartridge is rigidly fixed relative to the handle. In others, the cartridge head pivots or swivels relative to the handle, typically on pivot pins or shell bearings found on the bottom side of the razor.

In all styles of construction of my bi-directional razors, I prefer to have one pair of blades with their sharpened edges extending in one direction, and a second pair of blades with their sharpened edges extending in a generally opposite direction, relative to the head. Thus, the sharpened edges in the two pairs of blades extend in opposite directions at an obtuse angle relative to each other, while being disposed at an acute angle relative to their own respective working plane within the razor head. The razor head, as noted above, may take the form of a disposable cartridge, if desired.

The razor head, whether constructed as a disposable cartridge or as a permanent extension of the handle, can be made in many different sizes and shapes, as illustrated by the eighteen embodiments. The embodiments are preferably made to be a size and shape that will fit upon almost any given conventional commercially available handle. Thus, my bi-directional razors may be used by those who shave in lieu of their uni-directional razors. Further, when constructed as a disposable cartridge, my bi-directional razor heads may be used as a replacement for uni-directional cartridges on the conventional handles. All that is required is that my bi-directional razor head be outfitted with an appropriate handle-to-head coupling mechanism, including any return-to-center mechanism which may be required, so that it is compatible with the portion of the coupling mechanism found on the conventional handle.

Although most of the razor heads of my invention are shown with and contemplate the use of a double pair of blades, the bi-directional razors of the present invention need not be so complicated. Two single blades that extend in opposite directions, rather than twin-blade pairs, can be used. This style of construction is exemplified by the twelfth embodiment, which I specifically designed to have a very thin profile, so that it could be very easily used in the tightest of places to be shaved. This two single-blade design approach may be extended to almost all of the other embodiments, by simply removing the third and fourth razor blade strips and eliminating the corresponding portion of the support structure associated with the removed blade strips. In every instance, this would reduce the width of the razor head.

The bi-directional razors of the present invention fall into three general classes. In the first class of the bi-directional razors, which is exemplified by the first through ninth embodiments and the eleventh embodiment of the present invention, the sharpened edge portions of the first and second sets of blades (which point to generally opposite directions) are all arranged in a single common working plane. The twelfth embodiment, which has only two blade strips, is also in this class since the sharpened blade edges point away from one another and are in a common plane.

In the second class of bi-directional razor blades according to the present invention, each pair of blade edges is in its own separate working plane. These two working planes intersect one another at an angle of only a few degrees, such as from about five degrees to less than about 20 degrees, and preferably in the range of about eight to about fifteen degrees. Since skin is generally somewhat compliant, this slight difference in angle between the first and second working planes of the razor blade still enables the bi-directional razor to be used without lifting or turning or tilting the handle of the razor while moving back and forth in opposite directions. This category of bi-directional razor is exemplified by the tenth embodiment shown in the Figures.

This second class of bi-directional razor head constructions constitutes a yet another aspect of the present invention. According to this aspect, there is provided a bi-directional razor head which comprises: a single elongated razor head having a face; a first razor blade strip supported by the head and having a sharpened blade edge portion located in a first working plane and extending in a first direction; and a second razor blade strip supported by the head and having a sharpened blade edge portion that is located in a second working plane distinct from and angled relative to the first working plane and that extends in a second direction that is generally opposite of the first direction. The first and second working planes are located adjacent the face of the elongated razor head, and intersect one another at an angle between about four degrees and about 20 degrees, with an angle in the range of about six to about 15 degrees being presently preferred. The line of intersection of the planes is preferably above the longitudinal axis of the razor head, and even slightly above the face of the razor head, so the planes face away from rather than toward each other.

Third and fourth blade strips are preferably provided and are respectively located adjacent and parallel to the first and second blade strips, so that the sharpened edge portions of the third and fourth strips are respectively located in the first and second working planes. Thus, the first and third blade strips form a first pair of blades and cut hair together as the razor head is moved in a first direction. The second and fourth blade strips form a second pair of blades which cut hair together as the razor is moved in a second direction opposite from the first direction along the user's skin.

The third class of single-head bi-directional razor blades of the present invention feature two sets of blades, each in their own working plane, with the two working planes being angled considerably more than fifteen degrees from one another, such as about 25 degrees apart up to about 100 degrees (or more) apart, and arranged to face away from one another. Preferably the angle between the two planes is in the range of about 30 degrees to about 80 degrees, with a narrower range of about 35 degrees to about 70 degrees being presently preferred. This class of bi-directional razors is exemplified by the thirteenth through eighteenth embodiments of the present invention, and constitutes still other aspects of the present invention. Since the working planes for the two sets of blades are angled so far apart, it is not possible for both sets of blades to cut hair, each in its own direction, while the head and handle both remain in the same relative position to the skin being shaved. Accordingly, the razor head itself and the coupling between the head and handle is deliberately made to pivot in these embodiments.

In the seventeenth and eighteenth embodiments, a sliding motion is combined with this pivoting action for improved user control of the shaving action. This style of head and pivot coupling arrangement thus permits each set of blades, in its own working plane, to be brought successively into shaving engagement with the skin as the razor head is moved back and forth along the skin, without the razor head being lifted from the skin, and without the need of the user to change the orientation of the handle.

In this third class of embodiments, then, the razor head pivots (or slides and pivots) into two different cutting positions, while the handle of the razor being held by the user remains oriented in the same direction, as it is moved back and forth by the user. This class of my bi-directional razors thus enables the two sets of blades, each in its own distinct working plane angled far apart from the other working plane, to be presented to the skin in the same effective working plane, in a successive fashion, each different time, which depends upon when the user changes the direction in which he is moving the razor head. Thus, this third class of bi-directional razor head structures implements a concept of mine that is common to the thirteenth through eighteenth embodiments that I have named the "single effective plane". I coined this term to describe the bi-directional razor blade structures, which, although not having all of the sharpened edges of the razor blade strips generally found with a common plane of the razor head or cartridge, can nevertheless be used to shave bi-directionally without lifting the razor head from the skin or tilting the handle as the direction of shaving is changed.

The term "single effective plane" as used herein, including in the claims, is deemed to cover any arrangement of a single razor head (or cartridge) which has two working planes that are angled significantly apart from one another so that when the cutting or active blade or pair of blades is in shaving contact with the skin, the non-cutting blade or pair of blades are not in contact with the skin, but nevertheless, due to the movable coupling structure between the razor head and the handle or hand grip, can be still used to perform shaving of an area of skin in two opposite directions without lifting the razor head or cartridge from the skin.

Thus, in accordance with this aspect of my invention, there is provided a bi-directional razor head with blades in distinctly different working planes but capable of operating in a single effective plane. This razor head minimally comprises: a single elongated razor head; a first razor blade strip supported by the head and having a sharpened blade edge portion located in a first working plane and extending in a first direction; a second razor blade strip supported by the head and having a sharpened blade edge portion that is located in a second working plane distinct from, facing away from, and angled relative to the first working plane so that the working planes intersect one another at an angle between about 20 degrees and about 100 degrees; and coupling means supported by the head for enabling the head to be pivotally engaged by a handle for movement through a range of angles substantially matching the angle between the planes. With this structure, when the razor head is moved back and forth across and in continuous contact with the a user's skin, the first blade edge portion and the second blade edge portion are successively presented in shaving relation to the user's skin, thus accomplishing bi-directional shaving in a single effective working plane. As in the other aspects of the present invention, third and fourth blade strips are preferably provided and are respectively located adjacent and parallel to the first and second blade strips, so as to provide a pair of razor blades in the first and second working planes.

Advantages of the Razors of the Present Invention. The bi-directional razors of the present invention are believed to more readily deliver a closer shave than conventional uni-directional dual-blade wet razor systems for a few reasons. First, the bi-directional razor of the present invention is easier to use than a uni-directional razor, since the handle of the razor need not be lifted, twisted or tilted in order to repeatedly pass the razor across an area of skin to be shaved. Second, the bi-directional razor easily cuts hair in two different directions. As is well-known, an area of skin is shaved closer when a razor is passed across the skin in two opposite directions. Third, in those embodiments of the present invention where the razor blades in opposed directions both bear upon the skin simultaneously, the non-cutting blades scrape against the skin, which assists in providing a closer shave.

In the "one working plane" embodiments of my bi-directional razors, as the forward-moving set of blades cuts hair, the trailing set of blades typically is dragged across the skin. This dragging action may help stretch the skin and thereby facilitate a closer shave by the active blades. Further, the scraping of the skin by the hard sharp edges of the non-cutting blades should loosen dry skin, debris and may also help individual strands or stubbles of hair to stand up further, so they can be cut more closely on the return stroke by those same blades. This scraping action should also have the beneficial effect of helping to spread out more uniformly whatever thin layer of lubricating material remains on or is deposited upon the skin being shaved after the active blades pass over it. The lubricant may be shaving soap lather, shaving cream, or the lubricant from a slowly-dissolving conventional lubricant strip also provided on the razor that is left on the skin.

The bi-directional razor systems and structures of the present invention contain twice as many blade edges as does a conventional uni-directional razor. With advances in razor blade metallurgy, manufacture and/or surface protection, blade edges in most present day dual-blade razors corrode more slowly than blades of yesteryear. So, razor blades in daily use tend to dull from use rather than corrosion. By providing twice as many blade edges as are found in a conventional razor head, my bi-directional razor heads may well last almost twice as long, since each blade is essentially doing one-half the cutting of the blades in a uni-directional razor.

Another advantage of my bi-directional razors is that they can each be held and used in the exact same manner as a uni-directional razor if desired. For example, this is simply accomplished by lifting the engaged razor blades off of the skin on the return stroke if and when it is desired to do this for any reason. Thus, the new user of my bi-directional razor is not forced to immediately use a back-and-forth motion where the razor head is kept on the skin when shaving in order to begin to make use of my razor devices. Instead, the user can proceed to do so as he or she begins to feel comfortable with the bi-directional shaving technique.

The various constructions of my bi-directional razor blade heads described below are believed to be particularly economical to manufacture. In developing my designs, I considered it important to have all of the blades for the razor mounted in a single head. This reduces the overall size of the bi-directional razor, thus making it easier to handle and less expensive to manufacture and assemble. Further, in my designs, I attempted to reduce the number of overall components required, especially the number of pieces that would need to be separately made and/or separately handled during assembly. Also, I wanted to create structures and components which are easy to make and assemble using automatic equipment in order to achieve very low unit costs per razor. As a result, the individual components can be made using conventional materials and machinery, and the razor heads can be assembled using well-known techniques, such as by stamping plastic parts together so that they interlock by virtue of using cold-headed plastic pins.

Another advantage present in my designs is that, in many of the embodiments of the bi-directional razor of the present invention, the centrally located glide or lubricant strip located between the two pairs of blade strips does double duty. The glide area or strip is in use no matter which pair of blades is doing the cutting of hair. Further, the top surface of this common strip (even when curved such as in my later embodiments) is substantially within and forms part of the structure that defines the working plane (or planes) for the first and second set of blade edges.

For purposes of illustrating the features and advantages of the present invention, the accompanying figures, in the interest of clarity, at times exaggerate the size, spacing, clearances and/or relative sizes of or between certain parts of the razor head structures and/or their associated handles. But as noted above, my bi-directional razor heads can readily be used in place of commercially available, uni-directional razor heads. A preferred range of sizes and a typical size for each of the various embodiments of my bi-directional razor heads are given in the table near the end of this specification. This table shows that the various embodiments of my invention can be easily constructed in sizes that are quite acceptable to razor users for the shaving of the face and legs. Further, I have designed a number of my embodiments, especially the ninth, tenth and fourteenth embodiments, so that overall profile of the razor head is quite narrow. I did this so that, even in the tight quarters of a person's face where the contours are rapidly changing, bi-directional shaving can still be readily accomplished.

Other objects, features, operating principles, and advantages of the bi-directional razors and methods of the present invention will become apparent upon studying the various Figures in the drawings and reading the following detailed description and subjoined claims.

BRIEF DESCRIPTION OF DRAWINGS

FIG. 1 is a perspective view of the disposable razor;

FIG. 2 is a side elevational view of the FIG. 1 razor with a cover arranged next to the head of the razor;

FIG. 3 is a side elevational view, schematically showing the FIG. 1 razor engaging the user's skin and ready to move either upwardly or downwardly for shaving;

FIG. 4 is an enlarged, cross-sectional view, showing the FIG. 1 razor head and blades in cross-section;

FIG. 5 is a plan view of the face of the razor head shown in FIG. 4;

FIG. 6 is an elevational view of the razor illustrated in FIG. 2, with its cover, shown in cross-section, frictionally attached over the head; and FIG. 7 is a perspective view of the removable cover shown in FIG. 2.

FIGS. 8 through 12 illustrate a second embodiment of the bi-directional razor head of the present invention, which may be used with the handle of the first embodiment, and which has blade blocks assembled into a blade deck structure where:

FIG. 8 is a perspective view in transverse cross-section to illustrate the general shape and relationship of the deck structure or blade blocks;

FIG. 9 is a plan view of the top of the assembled razor head showing two opposed sets of parallel blade strips whose end portions are covered with end caps placed on opposite ends of the razor head;

FIG. 10 is a side view of the FIG. 9 head in partial cross-section taken along line 10—10 in FIG. 9, which shows the skin-smoothing leading edge or guard portion of the razor's deck;

FIG. 11 is a partial cross-section view of the FIG. 9 razor showing the part of the handle and the guard portions located on each side of the razor deck; and FIG. 12 is a perspective view of one of the snap-on end caps shown in FIG. 9.

FIGS. 13 through 17 illustrate a third embodiment of the bi-directional razor head of the present invention having a perforated deck and snap-on cover, where:

FIG. 13 is a plan view of the top of the razor head, which has a snap-on top structure with integral end caps that fit over the razor blade deck structure holding two opposed sets of razor blade strips;

FIG. 14 is a side view of the FIG. 13 head shown in partial cross-section taken along line 14—14 in FIG. 13, which illustrates passages through the head;

FIG. 15 is a partial cross-section view of the FIG. 13 razor taken along line 15—15 showing the part of the handle and some of the passages through the head and handle; and FIGS. 16 and 17 are side and top views respectively of the snap-on cap shown in FIGS. 13 and 14.

FIG. 18 is a side, elevational view of the bi-directional cartridge secured upon a razor handle using a sliding track arrangement; and FIG. 19 is a perspective view of a bi-directional cartridge razor of FIG. 18.

FIG. 20 is a front, elevational view of a razor of the type shown in FIGS. 18 and 19, but showing the modified end portions of the head raised to provide at each end a skin-deflecting ridge which keeps the skin away from the sharpened corners of the blade strips;

FIG. 21 is a perspective view of the FIG. 20 razor with the cartridge disassembled from the handle, and showing the cartridge in partial cross-section taken along line 21—21 of FIG. 20 with the razor strips embedded within the head, and terminating at one of the raised ridges; and FIG. 22 is an enlarged end cross-sectional view clearly illustrating the working plane formed by the four blade strips and showing the relationships between the blade strips and leading edge guards.

FIGS. 23 through 34 illustrate a sixth embodiment of the bi-directional razor of the present invention, which has a removable cartridge head structure with an assembled blade strip structure, the head structure being pivotally mounted upon the upper end portion of the handle, and where:

FIG. 23 is a perspective view of the sixth embodiment, showing the two manually operated buttons on the handle which are pressed inwardly to release the cartridge head from the handle of the razor;

FIG. 24 is a partially exploded enlarged cross-sectional end view of the cartridge razor structure taken along line 24—24 of FIG. 23, which shows the box-like deck, the W-shaped blade seat, the two sets of blades, and the Y-shaped cover interlock block;

FIG. 25 is a cross-sectional view of the FIG. 24 cartridge fully assembled;

FIG. 26 is an enlarged plan view of the top of the FIG. 23 cartridge head with the two end caps assembled thereon, and with the head partially broken away in the center in layers to show selected details of the internal structure;

FIG. 27 is a view of the top of the cartridge deck as viewed from line 27—27 of FIG. 24 showing its construction, and also showing on the right-hand side thereof an end cap ready to be inserted thereon;

FIG. 28 is a view of the blade seat structure as viewed from the direction of line 28—28 in FIG. 24;

FIG. 29 is a side-elevational view, mostly in cross-section, depicting the internal spring-loaded mechanism within the upper end of the handle shown in FIG. 23; and FIG. 30 is a cross-sectional view taken along line 30—30 of FIG. 29, showing the return-to-center plastic leaf springs of the handle and central prong and cam surfaces located in the center of the razor cartridge;

FIG. 31 is a view like FIG. 30, but with the cartridge structure pivoted about 15 degrees counter-clockwise from its center position;

FIG. 32 is a view like FIG. 30, but with the cartridge structure pivoted fully counter-clockwise (about 35 degrees) and engaging a mechanical stop;

FIG. 33 is a partial cross-sectional view of a pivot pin structure for use in the FIG. 29 cartridge-handle connection arrangement; and FIG. 34 is a view like FIG. 33, but with the cartridge rotated fully counter-clockwise relative to the handle, as in FIG. 32.

FIG. 35 is a cross-sectional end view of the head of the razor of the seventh embodiment showing the horizontal assembly pins locking the upper and lower head pieces together, and the slidable clip for handle whose upper end is in the form of a yoke for engaging the ends of the head for a pivoting connection between handle and head;

FIG. 36 is a fragmentary plan view of the top of the razor head, showing the open passages through the head and showing the location of the assembly pins which lock the blades in position.

FIGS. 37 through 39 illustrate an eighth embodiment of the bi-directional razor of the present invention, similar to the seventh in head construction in its use of angled razor blade strips, but whose head has a smaller width-to-length ratio than the seventh embodiment, due to a more compact head construction, where:

FIG. 37 is a perspective view of the razor showing the head connected to a long handle whose upper end is in the form of a yoke for engaging the ends of the head for a pivoting connection between handle and head;

FIG. 38 is a plan view of the top of the razor head, showing the passages through the head and the location of assembly pins which lock the blades in position; and FIG. 39 is a transverse cross-sectional view, taken along line 39—39 of FIG. 38, showing the internal construction of the head, including the generally hollow cartridge base with its integral pedestals for supporting the blade strips and spacers, which are secured by transverse pins.

FIG. 40 shows a side-elevational view in partial cross-section of the razor head and upper portion of the razor handle of the ninth embodiment;

FIG. 41 is a simplified end cross-sectional view taken along line 41—41 of FIG. 40, showing the shell bearing tab and complementary track in which it is engaged; and FIG. 42 is a fragmentary side elevational view in partial cross-section of the shell bearing member and the complementary journal which receives same extending downwardly from the main portion of the razor head;

FIGS. 43 through 44 illustrate a tenth embodiment of the bi-directional razor of the present invention, which is a modification of the ninth embodiment in that its head has two working planes, each plane being defined by its leading guard bar and a back glide surface, with the two planes being on a slight angle with respect to one another, so that they face slightly away from one another:

FIG. 42 is a view of the tenth embodiment, like the FIG. 41 view, but with the razor head rotated about 15 degrees in a counter-clockwise direction about center line A; and FIG. 43 is a side cross-sectional view as in FIG. 41, but with the razor head rotated counter-clockwise further than in FIG. 42 and reaching a positive stop.

FIGS. 45 through 47 illustrate the principles of operation of permanent and temporary adjustments to the return-to-center bias spring force applicable to the ninth, tenth and other embodiments, where:

FIG. 45A, 45B, 45C and 45D illustrate in cross-section four possible slopes for the return-to-center cam surface of the ninth and tenth embodiments;

FIG. 46 is a graph of the return-to-center bias spring force as a function of angle of rotation of the head relative to the handle in one direction from the center position; and FIG. 47 is a graph showing the distance of downward travel of the cam member (displacement distance) as a function of angle of head rotation relative to the at-rest center position for the cam surfaces of FIGS. 45B and 45D.

FIG. 48 shows an end cross-sectional view taken across the width of the bi-directional head, showing its internal construction and the upper end of the attached handle;

FIG. 49 is a cross-sectional view as in FIG. 48, but with three of the four razor strips being pushed downwardly within the head by the user's skin;

FIG. 50 is a simplified cross-sectional view taken along the length of the head of the eleventh embodiment, showing one angled razor blade strip biased to its full up position by four plastic springs integrally formed in the blade deck; and FIG. 51 is a cross-sectional view as in FIG. 50, but showing the razor blade strip pushed downwardly against the four springs by passing skin (not shown).

FIGS. 52 through 54 illustrate a twelfth embodiment of the bi-directional razor of the present invention, which utilizes only two opposed angled razor blade strips in a head having a very thin width, and a shell bearing arrangement to provide for pivoting action of the head, where:

FIG. 52 is a perspective view of the twelfth embodiment;

FIG. 53 is an end cross-sectional view taken along line 53—53 of FIG. 52 and showing the simple internal construction of the blade deck and snap-on cover, with individually sprung blade strips; and FIG. 54 is an end cross-sectional view taken along line 54—54 of FIG. 52 showing a typical area of the interior of the twelfth embodiment which is largely open.

FIG. 55 is a side cross-sectional view of the thirteenth embodiment showing a horizontal blade deck with vertical assembly pins formed into the cap; and FIG. 56 shows two bi-directional razors of the thirteenth embodiment, respectively being moved generally upwardly to the upper left and generally downwardly to the lower right direction along the skin during shaving.

FIGS. 57 and 58 illustrate a fourteenth embodiment of the bi-directional razor of the present invention, which is a modification of the thirteenth embodiment but featuring a smaller length-to-width ratio for the head structure, and diagonally-oriented assembly pins, and an outboard pivot pin arrangement, and where:

FIG. 57 is a perspective view of the bi-directional razor with its curved head structure supported by the upper portion of the handle using an outside pivot mount; and FIG. 58 is an end elevational view in cross-section showing the internal construction of the FIG. 57 bi-directional razor head.

FIG. 59 illustrates a fifteenth embodiment of the bi-directional razor of the present invention, which operates like the two previous embodiments, and features a simplified internal construction utilizing a single set of vertical assembly pins located along the longitudinal axis of the razor head, and two different sizes of flat double-edged razor blades.

FIGS. 60 through 65 illustrate a sixteenth embodiment of my bi-directional razor featuring a pivot connection between the handle and head and featuring two sets of angled blade strips arranged for bi-directional operation in a single-effective working plane, where:

FIG. 60 is a simplified end view of the bi-directional head showing the location of the two sets of blade strips;

FIG. 61 is a slightly enlarged cross-sectional view showing the box-like deck structure of the head, and blade seat structure captive within the deck;

FIG. 62 is a plan view in partial cross-section of the deck structure;

FIG. 63 is a plan view, in partial cross-section, of the blade seat structure; and FIGS. 64 and 65 are cross-sectional views of two meltable assembly pins used to lock the bi-directional blade assembly together in the fifteenth embodiment, with the pin in FIG. 64 being before melt and the pin in FIG. 65 being after melt.

FIGS. 66 and 67 illustrate a seventeenth embodiment of a bi-directional razor system of the present invention, which is like the sixteenth embodiment, but has a sliding channel arrangement for the pivot pin coupling the upper portion of the handle to the head, and where:

FIG. 66 shows the pivot pin in the center of the sliding channel; and

FIG. 67 illustrates the pivot pin at one end of the sliding channel with the handle rotated to a clockwise mechanical stop, and in phantom illustrates the pivot pin at the other end of the sliding channel with the handle rotated to a counter-clockwise stop.

FIG. 68 illustrates an eighteenth embodiment of the bi-directional razor of the present invention, which is a modification of the seventeenth embodiment that has a curved sliding channel for receiving a pivot pin from the handle, where the razor is shown three times to respectively illustrate the razor along a stretch of skin shaving upwardly, in transition between shaving positions, and shaving downwardly.

DETAILED DESCRIPTION OF THE PREFERRED EMBODIMENTS

Numerous bi-directional razors and razor head structures are shown in the Figures and discussed herein. While these embodiments are presently preferred, they are still only exemplary of the various possible bi-directional razors and razor heads of the present invention. As explained further below, I contemplate that, within the scope of the present invention, variants of the bi-directional razors of my invention may readily be constructed based upon my teachings here.

Note that all of my bi-directional razor head structures are symmetrical about their longitudinal axes. Unless otherwise indicated, they are also symmetrical about their central transverse axes. Thus, those in the art should appreciate that the descriptions herein of one side, end, or section of any given razor head will also serve to describe the other half of said symmetrical structure on the opposite side of the longitudinal axis or central transverse axis.

Figure 1:
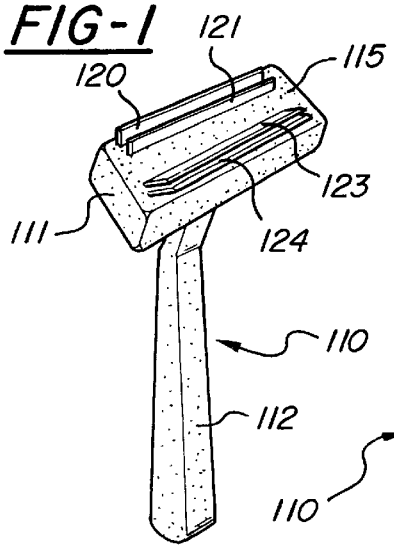
FIGS. 1 through 7 illustrate a first embodiment of a disposable bi-directional razor of the present invention, and show a preferred geometry for the two pairs of blade strips arranged in generally opposite directions.
Figure 6:
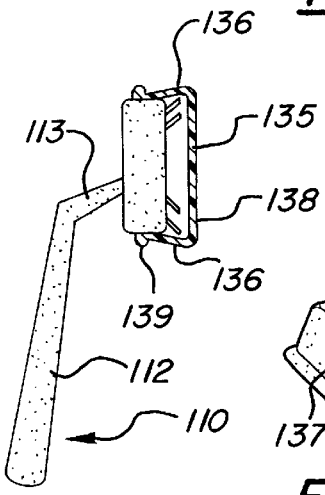
Figure 7:
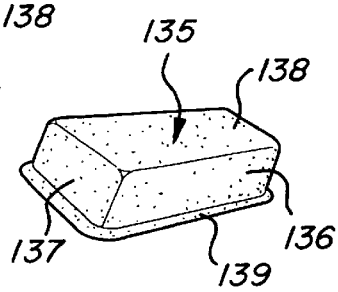
Figure 8:
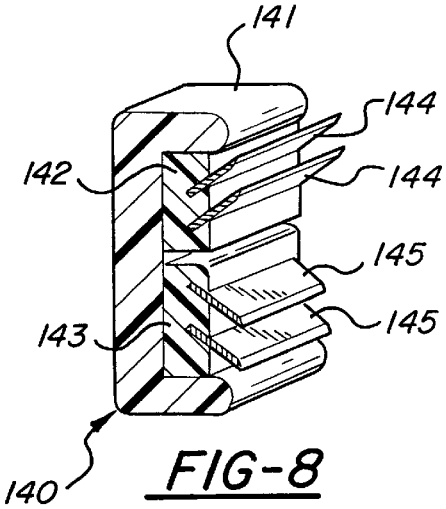

FIGS. 1 through 7 illustrate a first embodiment of the present invention, and FIG. 8 illustrates a modification of it. This first embodiment shows my bi-directional razor in its most elementary form, with all of the sharpened edges of the blades found in a common plane. FIG. 1 illustrates, in perspective, the bi-directional razor 110, while the remaining FIGS. 2 through 7 show various aspects of the FIG. 1 device and its safety cap. The razor 110 is preferably formed of any suitable molded plastic material to provide a head 111 and an integral hand grip or handle 112. The hand grip may have an upper end portion 113 which is molded integrally with the head and a lower, angled hand-holding portion 114. Alternatively, the handle may be shaped in a more curved or in a more straight configuration.

The head 111 is in the shape of an elongated, narrow strip or bar. It has a substantially flat, exposed shaving face 115. By way of example, the face may be about ⅜ inch (9.5 mm) to about ½ inch (12.7 mm) in width and about 1½ inch (38 mm) in length and about 3/16 inch (4.8 mm) in thickness. These dimensions may vary considerably, but in general it can be seen that the head has a narrow, generally rectangular shape.

Figure 4:
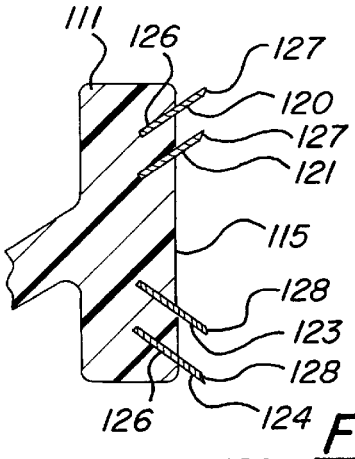
Figure 5:
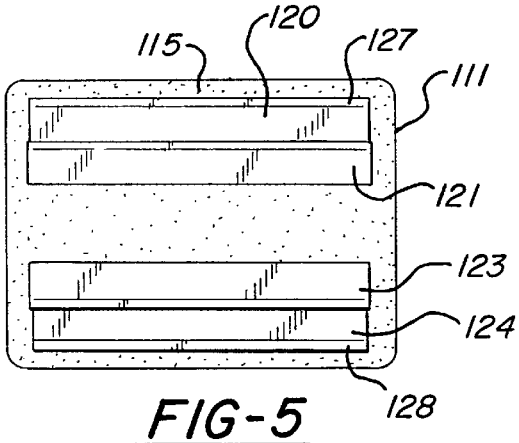

The head is provided with a first pair of razor blades 120 and 121 and an oppositely, angularly extending, second pair of razor blades 123 and 124. The blades are each formed of a narrow, single sharpened edge razor blade strip. As best shown in FIG. 4, each blade strip has an inner portion 126, which is embedded within the head, and an outer, sharpened edge portion 127 or 128 which extends outwardly from the head for cutting hair. The sharpened edges are arranged so that edges 127 cut in one direction while edges 128 cut in the opposite direction. Thus, when one pair of edges cut, the other pair merely drags or rides upon the skin and guides the edges that cut. As shown schematically in the drawings, the blades of each pair are closely adjacent to each other, such as on the order of 1/32 inch (0.8 mm) to 1/16 inch (1.6 mm). The spacings may be varied as desired, however.

Preferably, each of these blades is formed as a conventional, single edge razor blade which may be made of stainless steel strip or sintered metal, such as a hard carbide, or the like, conventional razor blade alloy material. These blades may be embedded in the head of the razor during the molding of the razor head. Alternatively, they may be separately formed and inserted in slots or sockets provided in a molded head or a head made from assembled pieces for the purpose of receiving the blades. The blades may be fastened in their sockets by the molding of plastic around them, or adhesively, or by some suitable mechanical fastening means such as cold-headed plastic pins. The blades extend along almost the entire length of the head. Significantly, the two opposing pairs of blades are close to each other, and extend outwardly at an acute angle relative to the working plane or face 115 of the head of the razor. This acute angle may be any suitable value, such as in the range of about five degrees to about 40 degrees, with angles in the range of 15 to 35 degrees being presently preferred.

Figure 3:
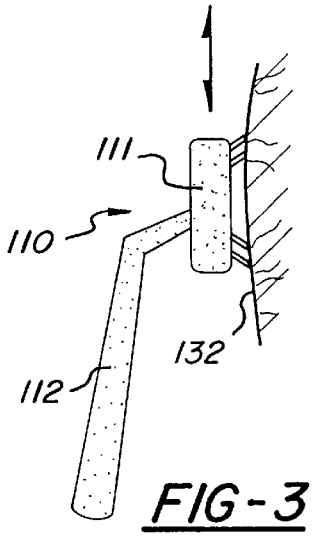

In use, as illustrated in FIG. 3, the razor is applied against the user's skin 132 (shown schematically) and is moved back-and-forth. By way of example, when the razor is moved upwardly, as schematically shown in FIG. 3, the sharp edges 127 of the one pair of blades 120 and 121 engage the skin and cut the hair in the upward direction. Then, the user may move the handle downwardly so that the sharp edges 128 of the second pair of razor blades 123 and 124 cut the hair without lifting the razor head away from the skin.

The razor may be used in almost any direction when shaving legs or the sides of faces, etc. The terms upwardly and downwardly are used here to describe the bi-directional operation wherein the razor may be stroked in one direction and then reversed to stroke in the opposite direction.

Figure 2:
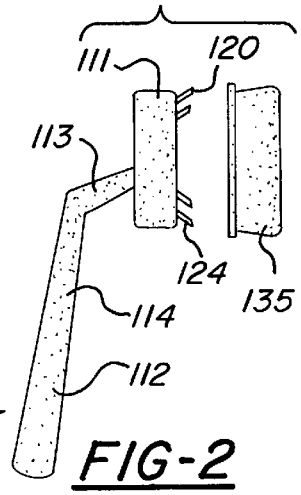

Preferably, the razor 110 is provided with a removable cover or cap 135 as illustrated in FIGS. 2, 6 and 7. This cover is formed of a molded plastic in a trough shape having opposing sidewalls 136, end walls 137 and a base 138. It may also have an edge lip 139 for stiffening it, if desired. The cover 135 snugly fits over the head 111 of the razor and is attached by friction. The cover is dimensioned so that it may be manually pushed over the head and will remain in place due to friction, until manually pulled off of the head.

The precise shape of the cap 135 may vary, depending upon the shape and size of the head. Thus, the cover is schematically illustrated as being shaped to fit over the blades and engage the sides of the head. The cover may be formed of a transparent plastic material. An appropriately shaped cover may be used over the blades and head in the other embodiments which follow as well.

FIG. 8 illustrates a modified razor head 140 which is similar to head 111 shown in FIGS. 1–6. However, the face 141 of the head 140 is provided with a pair of razor blade cartridges 142 and 143 each having a pair of blades 144 and 145. The shapes of the cartridges can be varied as desired. The cartridges may be suitably fastened in any way upon the head. For example, they may be arranged within a depression closely formed in the head and held therein by friction. In all cases their outer surfaces preferably are approximately in the same plane, so that the blade edges will be in the same plane.

Although two pairs of blades are preferred in each of the razors 110 and 140, the razors may be formed with either two single blades or with two triple sets of blades. The construction and operation will otherwise be similar to that described above. Since the bi-directional razors 110 and 140 are quite inexpensive to make, I consider them completely disposable, handle and all.

FIGS. 9 through 12 illustrate a second embodiment of my invention, namely bi-directional razor 150. Razor 150 is an enhanced version of the razor device shown in FIGS. 1 through 8, particularly the FIG. 8 device.

The bi-directional razor 150 includes a razor head 151 and an integral handle 152. The razor head 151 is comprised of: a blade deck structure 160; two end cap members 161 and 162; and razor blade cartridges 142 and 143, which respectively each support a pair of razor blade strips 144 and 145. The two cartridge blocks 142 and 143 are bonded or otherwise secured to internal flat surfaces 146 and 147 of the structure 160. They may be designed to be manually removable by a user, so that new blocks with sharp blades can replace those that have dulled. In the deck structure 160, three rows of passages 165,166 and 167 are provided for liquids and debris to pass through the deck structure 160, as best shown in FIG. 11. The row of holes 165 provide a place for soap or shaving cream lather and cut stubble to exit after being scraped up or cut off the skin's surface by the forwardmost blade strip 144F. Similarly, the row of through holes 167 provide a debris passage for front blade strip 145F. The centrally located holes 166 provide a path for flushing any shaving debris that accumulates in the center of razor head 151.

End caps 161 and 162 are preferably molded plastic parts, and have smooth planar top surfaces 171 and 172. These surfaces slide across the skin and are only slightly higher in elevation than the skin-engaging front guard bar portions 174 and 175. As shown in FIGS. 10 and 12, each end cap has a recess or open chamber 168 and 169 for receiving the ends of the blade strips 144 and 145. The top wall portion above the recess in each end cap acts as a shield to ensure that the user of the razor is not nicked by the end corners of the blade strips.

The end caps, such as cap 161, best shown in FIG. 12, preferably include elongated integrally molded projections, such as studs 173 through 177, which respectively slide into corresponding apertures in the razor deck 160, to interlock the end caps onto the deck. For example, studs 176 and 177 slide into and frictionally engage holes 166 and 167 which are of a complementary width. Similarly, cylindrical projecting studs 173 engage holes 163 in the deck 160, and ensure proper vertical registration of the end cap with the deck.

The front guard bars 174 and 175 preferably have their outwardly facing rounded edges 184 and 185 longitudinally scored or scalloped, as can best be seen in FIG. 11. This forms elongated nibs to better engage and stretch the skin just prior to hair being shaved therefrom by the adjacent razor blades.

In FIGS. 10 and 11, for the sake of clarity, the relative spacing in the horizontal and vertical dimension, especially between the topmost edge of guard bars 174 and 175, the sharpened edges of the razor blades 144 and 145, and the clearance shown between the blade edges and the inner top surface 179 of the top wall section of end cap 171, has been exaggerated. In practice, the vertical distances between these points of reference just mentioned would be in the range of about 0.001 inch (0.025 mm) to about 0.1 inch (0.25 mm). Thus, those skilled in the art will appreciate that the upper surface of guard bars 174 and 175, the sharpened edges of blades 144 and 145 and the top surfaces 171 and 172 of end cap 161 and 162 generally fall within and define a common working plane of the razor 150. The sharpened edges of the blades are all located within this working plane. The guard bars, the top surfaces of the end caps, and the trailing pair of blades all are dragged across and lay in the same plane on the skin, thus helping keep the forward blades at their desired angle relative to the skin. The trailing blades and guard bar also help condition the skin for a return stroke in the opposite direction, in the manner described in the Summary Section above.

FIGS. 13 through 17 illustrate a third embodiment of my invention, namely bi-directional razor 180. Razor 180 is quite similar to razor 150, and includes a deck structure 181 and razor strip carrying blocks 142 and 143. But it is provided with a one-piece snap-on cover structure 182, in place of separate end caps 161 and 162. The deck structure 181 of the razor 180 is modified somewhat, in comparison to deck structure 161, in order to receive and hold the snap-on cover 182. FIGS. 16 and 17 show the cover 182 by itself from a side elevational view and plan top view respectively.

FIGS. 15 through 17 show that the generally-open rectangular cover 182 has two side portions 184 and 185 spaced from one another by two end portions 191 and 192. The side portions 184 and 185 respectively have elongated side walls with tapered bottom portions provided with internal tongue portions 186 and 187 which engage complementary mating grooves 188 and 189 on the side walls of the modified deck 181, as best shown in FIG. 15. The upper wall portions 193 and 194 of end portions 191 and 192 create recessed pockets 195 and 196, that hide and shield the blade ends, so they cannot scratch the user of the razor. Any conventional or suitable plastic materials may be used to injection-mold the deck structure 181 and cover 182.

Figure 18:
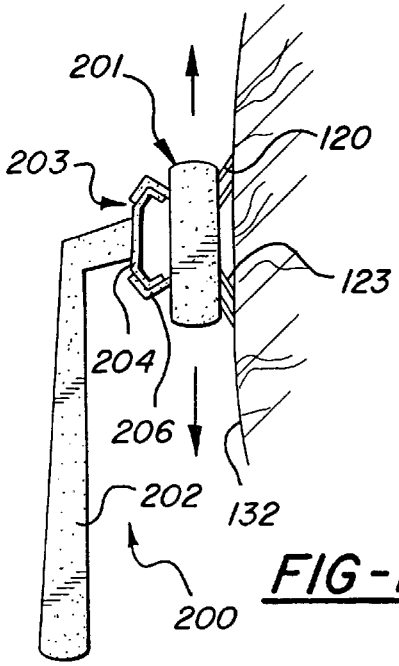
FIGS. 18 and 19 illustrate a fourth embodiment of the bi-directional razor of the present invention which illustrates a preferred geometry for blade strips on a disposable razor blade cartridge that has a sliding track for removably attaching it to the handle where.
Figure 19:
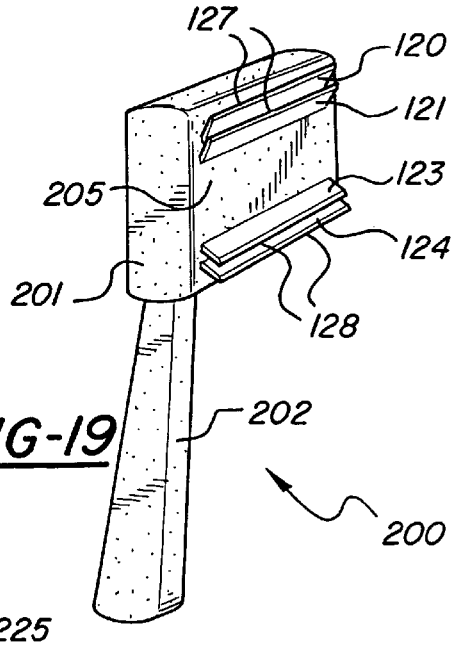

FIGS. 18 and 19 show my fourth embodiment, which is a simple bi-directional cartridge razor 200. Razor 200 includes a replaceable cartridge 201 as its razor head, and a re-usable handle 202, upon which head 201 is mounted through a suitable rigid coupling means or connector arrangement, such as a frictionally-engaged sliding track mechanism 203. Cartridge 201 includes a generally flat face 205 and two pairs of blades 120, 121 and 123,124, with the sharpened edges 127 and 128 of the respective pairs of blades pointing away from each other. All of the sharpened blade edges are arranged in a common working plane, as best shown in FIG. 18. Coupling mechanism 203 includes a C-shaped carriage member 204 supported by the upper end of handle 202, and complementary track members 206, mounted in and extending out from the bottom of head 201. Carriage 204 is slidably engaged on the inner surfaces of track members 206. Frictional forces hold carriage 204 in place on tracks 206. A deliberate sideways force must be applied by the user pushing the handle and head in opposite directions to disengage the carriage from the track, in order to change cartridge 201.

Figure 20:
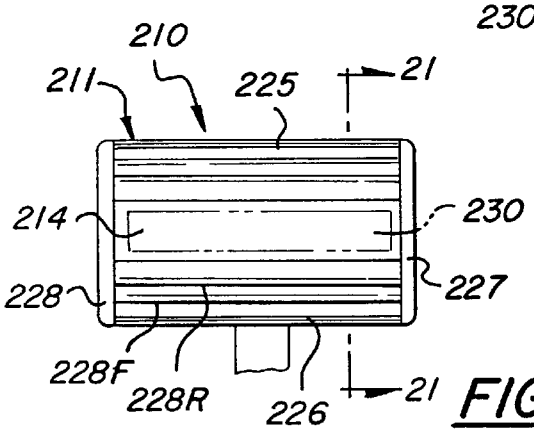
FIGS. 20 through 22 illustrate a fifth embodiment of the bi-directional razor of the present invention, which is a modification of the fourth embodiment that has the same sliding track for removably attaching the disposable razor blade cartridge, but features a modified cartridge head with rippled leading guard bars, end ridges, an optional center lubricant strip, and slightly raised rear razor strips, where.
Figure 21:
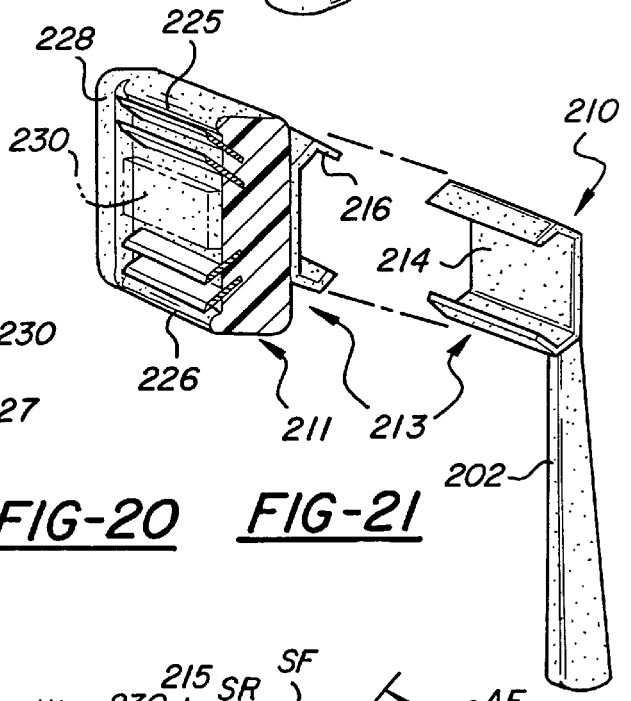
Figure 22:
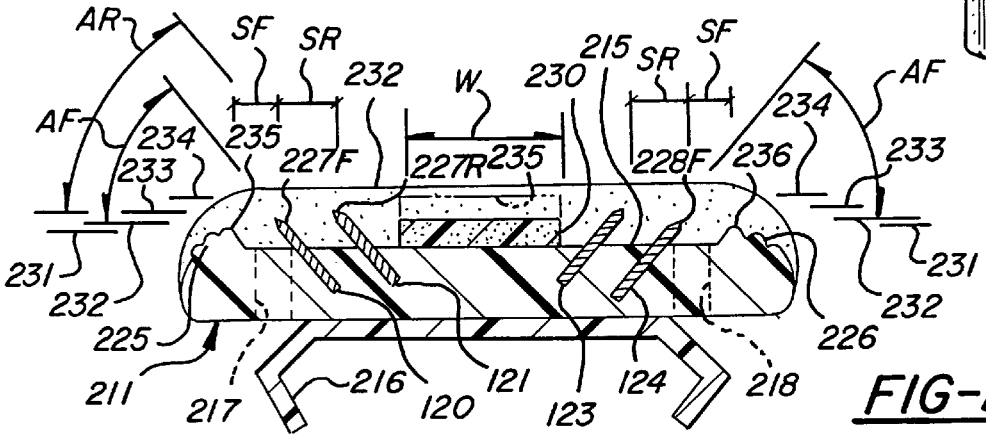

FIGS. 20 through 22 show my fifth embodiment, which is a second bi-directional cartridge razor 210. Razor 210 includes replaceable cartridge 211 and handle 212, and coupling mechanism 213 between the head and handle. Connecting mechanism 213 is very similar in style to mechanism 203, but features a carriage member 214 supported by the upper end of handle 202 that slidably envelops and frictionally engages the outer surfaces of a C-shaped track member 216. As noted by the hatching in FIG. 22, track 216 may be made of plastic material. The carriage 215 may also be made out of plastic material. The track and the carriage, if separately made, may be secured to the bottom of head 211 and the top of handle 212 respectively by any known technique, including mechanical interlocking or fasteners, adhesives, sonic welding, thermal bonding, etc.

Razors 200 and 210, like in previous embodiments, have their blades arranged at an acute angle relative to the face of their cartridge. The blades can be molded within the deck structure, fastened into slots in the deck, or be part of an assembled deck. As indicated by dashed lines in FIG. 22, rows of passages 217 and 218 to allow liquids and shaving debris may be provided through the razor heads 201 and 211 adjacent to the razor blade strips as desired. Each cartridge can be removably connected to the handle by any suitable mechanical connecting means which enables the user to release one cartridge and replace it with another similar cartridge whenever desired. Coupling mechanism 203 for razor 200 can be made of out of any suitable material, such as cadmium or nickel-coated, hot-rolled thin steel sheet stamped or pressed into the desired shape prior to being fastened to the handle and head. The coupling or connector arrangement can take the form a socket and plug that are detachable from one another. Various other types of suitable or conventional mechanical fastening systems or devices can be used to removably connect the cartridge to the handle, in either a stationary or a pivoting relationship. In my embodiments which follow, a number of them are shown and discussed.

In razor 210, the blade edges 127 and 128 of the blade strips 120 through 124 in the cartridge head 211 are guarded so as to reduce the chance of accidentally scratching the user's skin during shaving. This guarding is provided by scalloped front guard bars 225 and 226, which respectively contact the skin just prior to blade edges 127 or 128 passing over the skin when "active", that is, when in their hair-cutting orientation relative to the skin. The guarding also includes skin-engaging raised end portions 227 and 228, which abut the corners of the blades and rise slightly above the blade edges. In a fashion similar to the second and third embodiments, the upper surfaces of the raised end portions and the uppermost parts of the guard bars preferably fall substantially within and help define a common working plane which includes the sharpened blade edges.

In FIGS. 20 and 21, the phantom lines show a preferred central location between the two pairs of adjacent blades 227R and 228R for an optional, generally rectangular, thin, elongated glide strip 230. This strip 230 is shown in solid lines in FIG. 22, and may have a water-soluble lubricant agent or other shaving aid slowly released from its upper surface during shaving. Alternately, strip 230 may be integrally formed out of a plastic material, such as the remainder of the head 222 is, and be provided with a smooth finish on its top surface to enhance skin-gliding action. Width W of the preferably planar surface of glide strip 230 may be adjusted as desired, and need not occupy the entire width between adjacent blades.

FIG. 22 shows an enlarged end view in cross-section of the head 211, which has the sharpened edges of the inner and outer blades substantially in the same common working plane, but not exactly in the same plane, as will now be explained. The blade edges in this fifth embodiment are arranged in a stepped fashion which can produce an enhanced cutting action for each blade, provided proper blade angles, elevations and spacings are used. The pairs of horizontal lines 231 through 234 in FIG. 22 represent planes 231 through 234, which are parallel to one another and to the plane of face 215 and are located at successively higher elevations above face 215. Plane 231 is defined by uppermost surface portions 235 and 236 of guard bars 225 and 226. Sharpened blade edges 227F and 228F define plane 232. Sharpened blade edges 227R and 228F define plane 233. Lastly, plane 234 is defined by the top surface of glide strip 230, as shown by phantom line 235 on FIG. 22. The spacing between adjacent planes 231 through 234 is preferably in the range of 0.0005 inch (0.013 mm) to about 0.002 inch (0.05 mm). As those in the art should appreciate, the farther the sharpened edge of a blade projects above the plane of the skin-engaging surface which precedes it, the more that blade edge will tend to engage the user's skin. The precise amount of skin engagement due to increased elevation (sometimes called the "exposure" of the blade) is a function of, among other things, (1) the angle of the blade relative to the working plane of the razor head for that blade (sometimes called the "blade tangent angle"), and (2) the distance between the cutting edge of the blade and the skin engaging surface forward of that cutting edge (sometimes called the "span").

The optimum angles for the spacing or span of, and the elevation for pairs of, blades relative to a working plane defined by surrounding skin-engaging surfaces on a uni-directional razor head is well known. U.S. Pat. No. 4,407,067 to Trofta, assigned to the Gillette Company, and other patents discuss this subject in detail. Due to the extensive information provided herein about my bi-directional razors, those skilled in the art should be able to readily employ such known information with my bi-directional razors, particularly when armed with the following insights. There are two separate zones where my razor blades are active, one for each direction of shaving. One such zone is found on each side of the longitudinal axis of each of my bi-directional razor heads. The blades (or blade) in each zone can be set up and adjusted as though they were (or it was) on a uni-directional razor head, once the working plane for those active razor blades (or blade) is established by selection of the size and location of the other non-cutting surfaces of the head that are to contact the skin while the blades (or blade) of that zone are active.

As illustrated in the FIG. 22 embodiment, the rear blades in my bi-directional razors can be slightly elevated, if desired, relative to their front blades for enhanced cutting action. In FIG. 22, the sharpened edges 227R and 228R of rear blade strips 121 and 123 are shown slightly elevated relative to sharpened edges 227F and 228F of front blades 120 and 124. Further, the blade tangent angles AF and AR for the front and rear blades respectively may be varied. Further, the span SF, which is the distance between the guard bar and the front blade and the span SR, which is the distance between the front blade and rear blade, all as shown in FIG. 22, may be varied.

A centrally located glide strip or surface can be used with (or omitted from) virtually any of my bi-directional razors, as desired. When used, it constitutes a rear skin-engaging surface that helps define the working plane for the active blades. The simplest way to use a glide strip in my bi-directional razors is to have the top surface 233 of the glide strip 230 in plane 231, that is, at an elevation on the head equal to the elevation of the uppermost surfaces 235 and 236 of the guard bars 225 and 226. If rear razor blades 121 and 123 have too much cutting action with the rear glide surface or strip 230 at such an elevation, then the top surface 235 of glide strip 230 should be raised, to either the level of plane 231 or plane 232 or somewhere in between. This will cause the skin being shaved to bear with less force upon the sharpened edge of the rear blades. If the top surface of glide strip 233 is raised sufficiently, it will introduce a shallow acute angle between the face of the razor head and the working plane of each pair of blades. The "working plane" of a razor blade or pair of blades may be defined as that plane generally formed and defined by all of the surfaces on the razor head which engage the skin when that blade or pair of blades is active, i.e., in a hair-shaving orientation relative to the skin. The working plane determines the angle at which the active blade or blades are presented to a substantially flat area of skin to be shaved. The surfaces or the razor head which substantially define the working plane include the forward guard bar surface in front of the active blade(s) if any, the rear glide surface behind the active blade(s) if any, the trailing blades (if they are in fact in contact with and dragging across the skin), and the raised surfaces at the ends of the blade strips (if any) which shield the user's skin from being nicked by the corners of the blades.

Those in the art should appreciate from the foregoing discussion that bi-directional shaving with the elongated, compact, single-head razors of my invention can be accomplished when the blades are in precisely the same plane as shown in my first four embodiments, or when in substantially the same plane as taught in my fifth embodiment. Further, the precise elevation of the rear glide surface, and the blade tangent angle for each blade, and the elevation, spacing and positioning of the individual blades and of other skin-engaging surfaces of the razor head can all influence the cutting action and performance of the active blade or blades in all of my bi-directional razors. Armed with the foregoing insights into the operation of my bi-directional razors, those skilled in the art will be able to vary these blade-action performance parameters (as just mentioned and as discussed above in connection with this fifth embodiment) in all of my other embodiments as well, to achieve a desired degree of blade engagement with the skin and excellent shaving action in both directions of head travel.

FIGS. 23 through 34 illustrate a sixth embodiment of my invention, namely bi-directional razor 240, which includes a pivoting razor 240 that is a replaceable assembled cartridge structure that uses flat razor blade strips and a pivotal mount. Razor 240 includes a cartridge head 241 which is mounted on handle 242 through a releasable pivoting connector mechanism 243. Finger-operated buttons 244, located at the upper end 246 of handle 242, are squeezed inwardly to release cartridge 241 from its pivot mount. Razor 240 has a generally flat face 245 defined in part by the molded plastic end covers 247 and 248 which shield the blade ends and the central glide surface 249.

Figure 25:
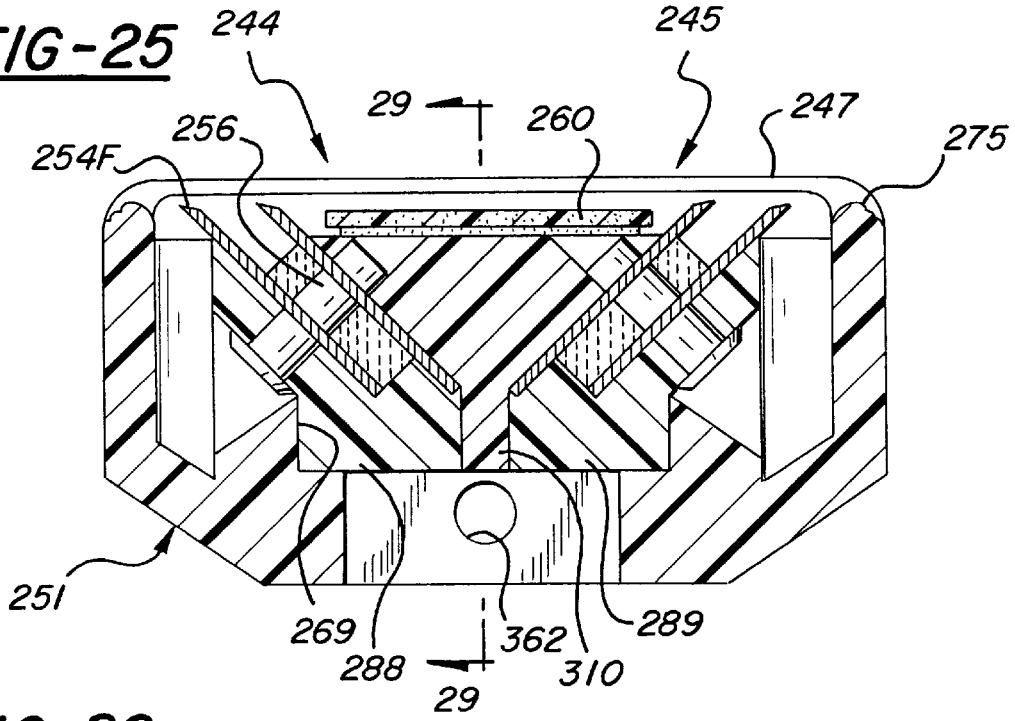

FIG. 24 shows the main cartridge structure 246 in an end cross-sectional view taken along lines 24—24 of FIG. 23. FIG. 25 shows the same structure 246 in an assembled state, with the end cover 247 attached, from an end view taken along lines 25—25. FIG. 25 reveals more about the internal support structure and shaving debris passages. The blade-carrying cartridge structure 246 includes: base structure 251 resembling a ship's hull; a blade-supporting deck structure 252; a blade-retaining Y-shaped cover structure 253; two pairs of diagonally-oriented, elongated flat blade strips 254 and 255; diagonally-oriented blade-interlock pins 256 and 257; elongated blade spacers 258 and 259 made of mica or any other suitable material; and a centrally-located glide strip 260 secured to the top of cover block 253 by adhesive layer 261.

Figure 26:
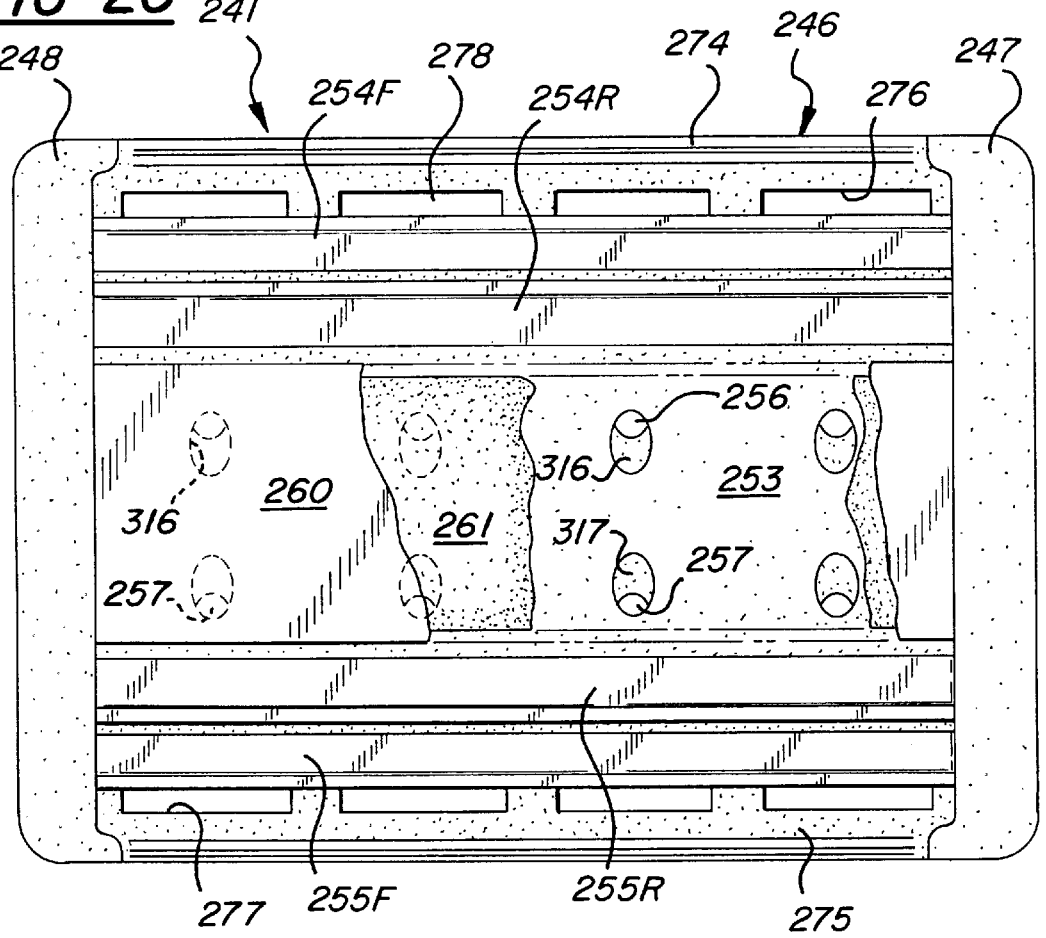
Figure 27:
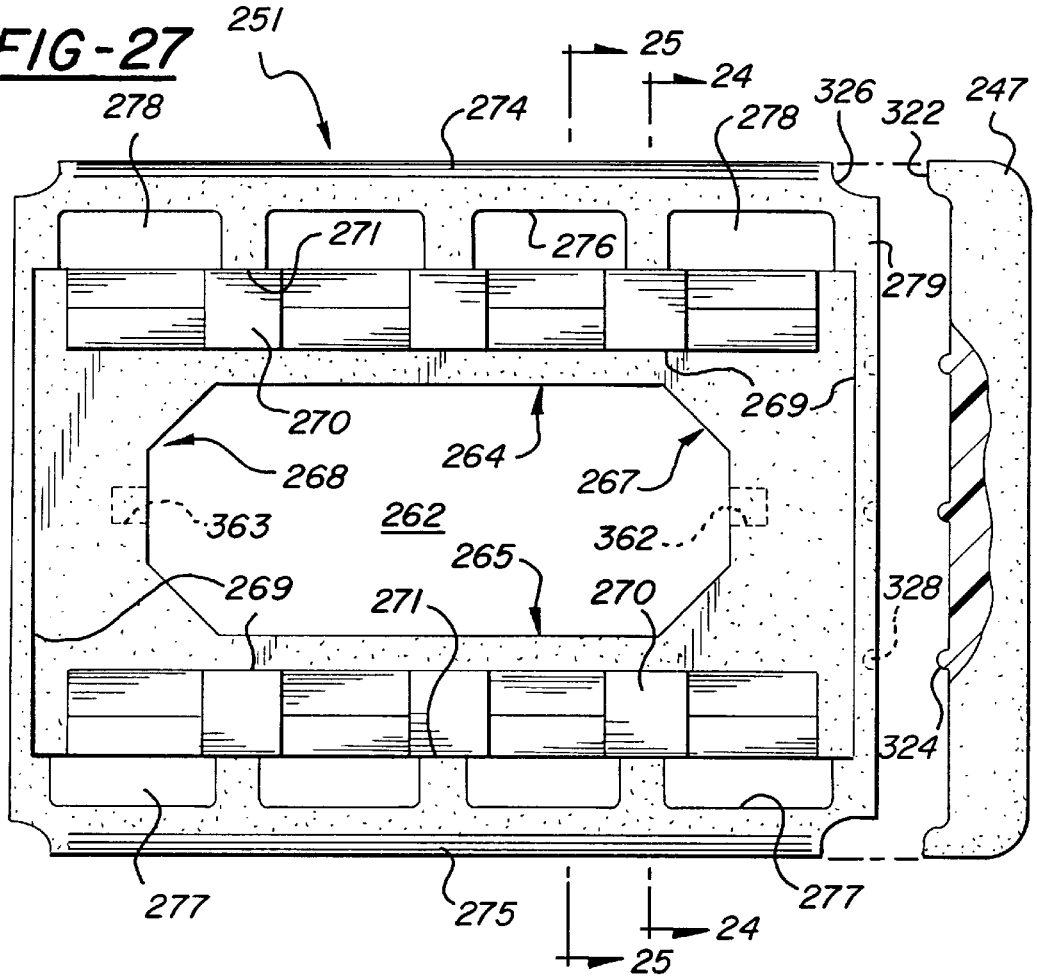

FIGS. 24 through 27 and 29 show base structure 251 in greater detail. FIGS. 24 and 27 reveal that base structure 251 includes elongated side portions 264 and 265 interconnected to end portions 267 and 268. Interior walls of the side and end portions define an interconnected open chamber 262 having an elongated lower opening 265, a middle vertical-wall region 269, a sloping slide wall region 270, and an upper vertical side wall region 271. Further, base structure 251 has elongated scalloped top edge portions 274 and 275 on side wall portions 264 and 265 forming skin-engaging guard bars for razor head 241. Structure 251 also has rows of debris passages 276 and 277 respectively passing through side wall portions 264 and 265, as best shown in FIGS. 26 and 27. Rectangularly-shaped passages 276 are defined in part by interior vertical support column portions 278 and end wall portions 279 and 280. FIGS. 24, 25 and 27 show that base structure 251 fully supports complementary exterior surface portions of deck structure 252 at spaced intervals, when structure 252 is inserted in the generally open trough-shaped chamber 262 defined in part by regions 269, 270 and 271 of base structure 251.

Figure 28:
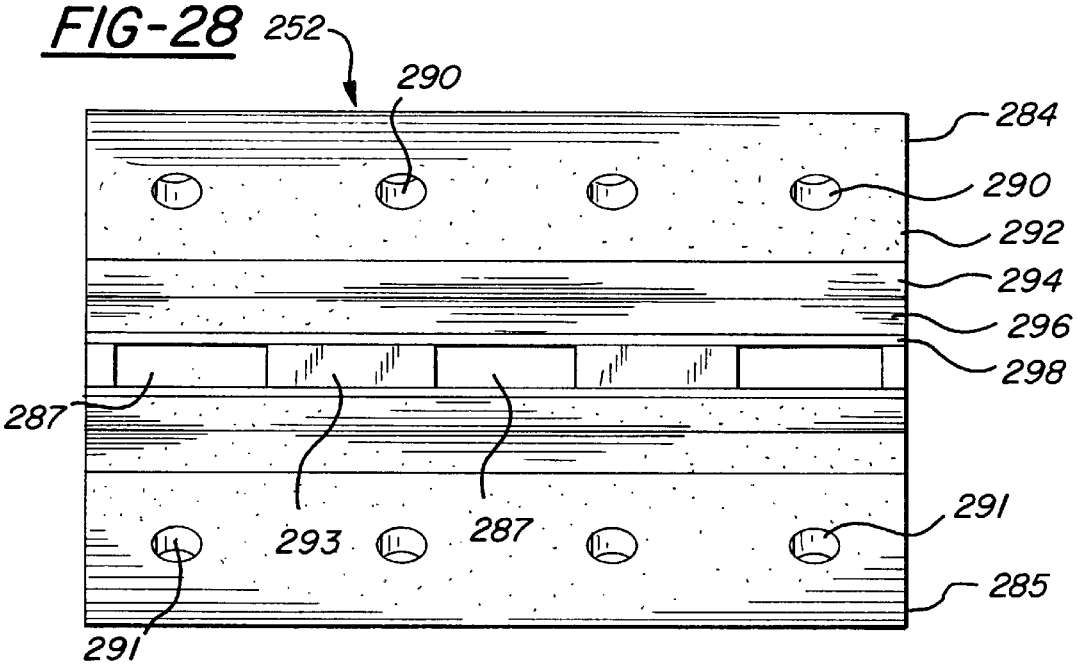

Blade seat structure 252, best shown in FIGS. 24, 25 and 28, has a cross-sectional shape resembling the letter W. Structure 252 is comprised of diagonally-oriented, elongated upper wall sections 284 and 285, connected to lower seat portions 288 and 289. A lower cam section 286 (shown in phantom) is also connected to portions 288 and 289, and spaced apart elongated passages 287 are provided therebetween.

As best shown in FIG. 28, blade seat structure 252 includes two rows of cylindrical holes 290 and 291 passing through upper wall sections 284 and 285. The interior diagonal surfaces 292 and 294 of lower portion 288 of structure 252 are at right angles to one another, and cradle and support blade 254F. Mica blade spacer 258 and interior diagonal surfaces 296 and 298 of portion 288 cradle and support blade 254R, as can be seen in FIGS. 24 and 25. These surfaces 292 and 298, along with spacer block 258, enable the razor blade strips 254F and 254R be moved into position on the blade deck 252, prior to insertion of cold-headed pins 256 through holes 290 and the corresponding registration holes in blades 254 and cover interlock block 253.

As best shown in FIG. 24 and as can be understood from study of FIG. 28, cover interlock block 253 has a Y-shaped cross-section when viewed from the end. Block 253 preferably includes three lower "registration and lock" key portions 310 directly opposite top surface 312, which are frictionally press fit under light pressure into complementary holes 287 in deck structure 252. Diagonally oriented surfaces 314 and 315 of block 253 bear against blades 254R and 255R once the interlock block 253 has been pressed into place over the subassembly consisting of deck 252, blades 254 and 255, and spacers 258 and 259. The top block 253 holds the blades in place prior to two rows of plastic pins 256 and 257 being pushed through the deck, spacers and blades and pressed into corresponding friction-fit holes 316 and 317 in block 253. Thereafter, glide strip 260 is bonded by adhesive layer 261 to surface 312 of the cover block to complete a subassembly 320 consisting of assembled deck, spacers, blades, pins, top interlock block and glide strip 260. Subassembly 320 is then inserted, as shown in FIG. 25, into deck structure 251 to complete cartridge structure 246. Thereafter, end caps 247 and 248 are added to form the completed cartridge 241. FIG. 26 shows how end caps 247 and 248 cover and shield the ends of the blades in cartridge assembly 241, and thus prevent the user from being nicked by blade corners. FIG. 27 illustrates how the end covers, such as cap 247, may be provided with protrusions such as flange 322 and studs 324, that are received by and snugly frictionally engage corresponding complementary surfaces 326 and holes 328 in deck structure 251.

Figure 29:
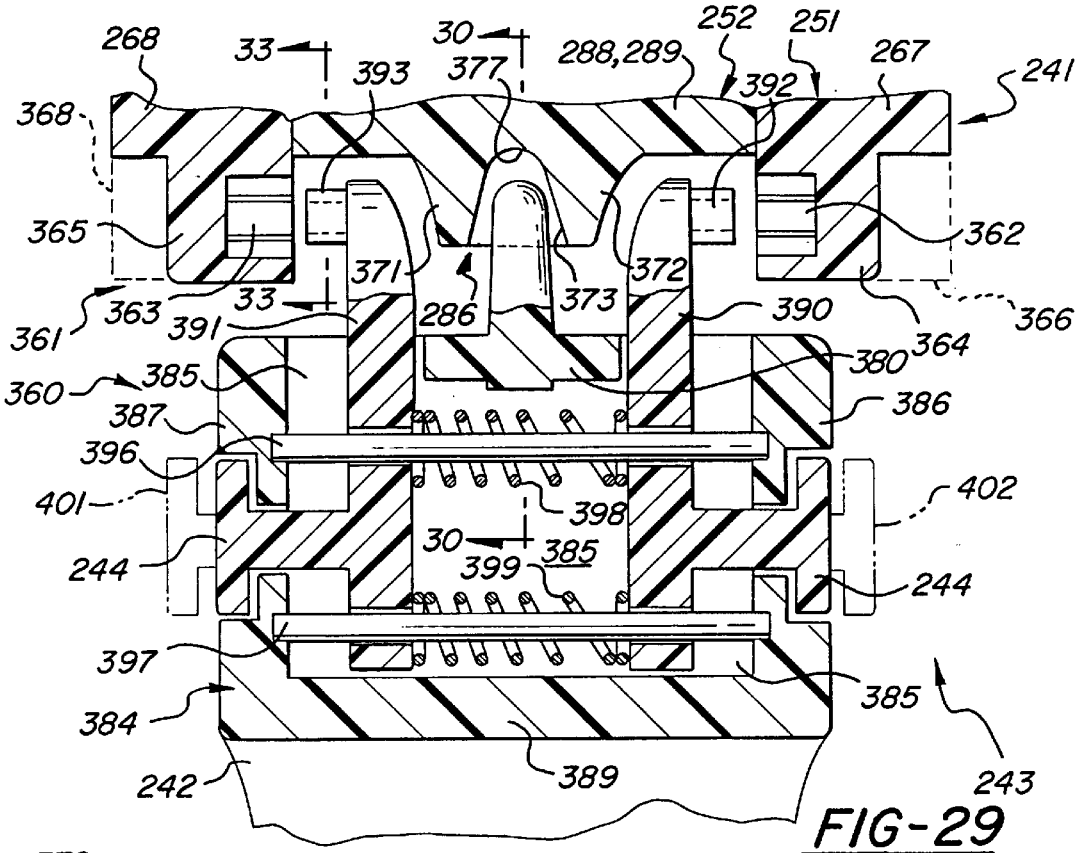

FIGS. 24, 25 and 29 illustrate one preferred form that the pivoting interconnection arrangement 243 between cartridge 241 and handle 242 may take. This pivoting mechanism includes two sets of spring forces operating in orthogonal directions. One set of springs biases the manual release buttons 244 outwardly. The other set of springs provides a return-to-center function for the pivot action. Mechanism 243 also includes dual-positive stops to prevent accidental over-rotation of cartridge 241 relative to handle 242.

Figure 30:
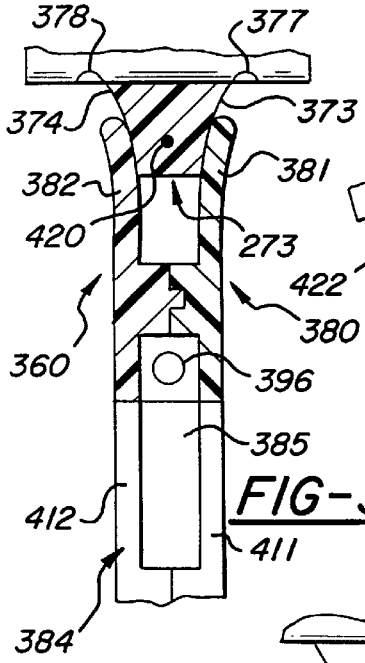
Figure 33:
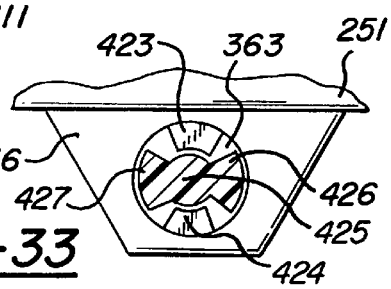

Mechanism 243 has a handle-mounted portion 360 and a cartridge-mounted portion 361. Because handle 202 is intended to be reused thousands of times, while cartridge 241 is to be disposed after about twenty or thirty uses, my pivot mechanism is designed with the more expensive components in handle portion 360. As shown in FIG. 29, portion 361 on razor cartridge 241 includes the lower cam section 286 and lower portions 288, 289 of the blade deck structure 252. Portion 361 also includes sockets 362 and 363 formed in lower blocks 364 and 365 of base structure 251. As shown by dotted lines 366 and 368, these block sections could readily be larger, but I prefer to reduce them in size as shown in FIG. 29 and FIG. 33 to save material. Lower cam section 268 of blade deck structure 252 includes thick wall sections 371 and 372 surrounding the parabolically-shaped shoulder which defines cam surface 373 symmetrically positioned about the main transverse plane of cartridge structure in which line 30—30 is drawn. A similar parabolic cam surface 374 is provided on the opposite side of cam section 268. Cam surfaces 373 and 374 taper downwardly and inwardly from top to bottom, as shown in FIG. 30. The topmost surfaces 377 and 378 of the parabolic shoulders (see FIG. 30) provide positive stops for leaf-spring plastic fingers 381 and 382 of the portion of mechanism 380 on the handle.

Handle-mounted coupling mechanism 362 at the top end of handle 242 includes box-like upper handle support frame 384 having a generally hollow substantially closed chamber 385 formed by side wall sections 386 and 387 and lower wall section 389 and front and rear wall sections 411 and 412. Mechanism 362 also includes movable arms 390 and 391 which support pivot pins 392 and 393 at their free ends. The pivot pins move longitudinally outwardly to engage complementary sockets 362 and 363. Mechanism 360 also includes longitudinally-extending guide rods 396 and 397 mounted to frame 384. The rods pass through and ensure arms 390 and 391 can move only in a longitudinal direction. Helical springs 398 and 399 co-axially mounted about rods 396 and 397, and shown in their compressed state in FIG. 29, provide longitudinal forces that attempt to drive pins 392 and 393 into sockets 362 and 363. FIG. 29 shows the arms 390 and 391 in their actuated state, with springs 398 and 399 compressed, as they would be when pushed inwardly by the user's fingers bearing against buttons 244, in order to remove cartridge 241 from handle 242 by decoupling the pivot pins from the sockets. When arms 390 and 391 are in their normal, released position, the pivot pins will be in their respective sockets, and buttons 244 will be in the positions indicated by dotted lines 401 and 402.

Figure 31:
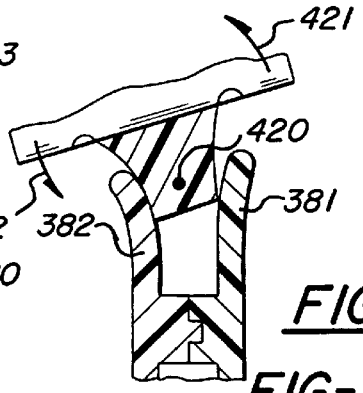
Figure 32:
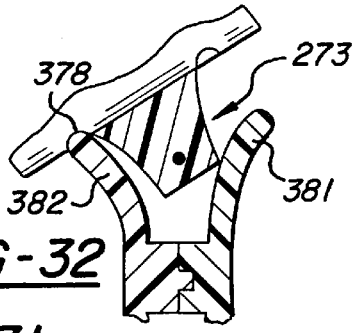

FIG. 30 shows key portions of handle-mounted coupling mechanism 360 from an end cross-sectional view. As shown, return-to-center spring mechanism 380 is comprised of leaf-spring finger portions 381 and 382 made of semi-rigid bendable plastic material, which extend up from front and back wall portions 411 and 412 of housing structure 384. Point 420 shown in FIGS. 31 and 32 represents the axis of rotation of the pivot pins 392, 393 within their sockets 394, 395.

During operation of pivot connection mechanism 243, arms 390 and 391 are extended outwardly by spring force so that pivot pins 392 and 393 engage sockets 362 and 363 of deck structure 251. The leaf-spring fingers 381 and 382 extending from the handle on a coupling structure 360 engage the parabolic side wall cam surfaces 373 and 374 normally as shown in FIG. 30. The razor 240, when in use, is moved by a user along his or her skin. As a counter-clockwise force, represented by arrows 421 and 422 in FIG. 31, is applied to the cartridge 251, it begins to rotate about point 420, as shown. Leaf-spring fingers 381 and 382 are pushed outwardly by surfaces 373 and 374, and thus tend to resist rotation and provide a restoring force proportional to the displacement of the fingers that tries to return the cartridge 251 to its at-rest center position. If rotational forces 421 and 422 continue to build, eventually the coupling mechanism reaches the point shown in FIG. 32. In this position, the top of leaf spring 382 is engaged in the top of arcuate shoulder 378 of cam section 286, thus stopping further rotation.

Figure 34:
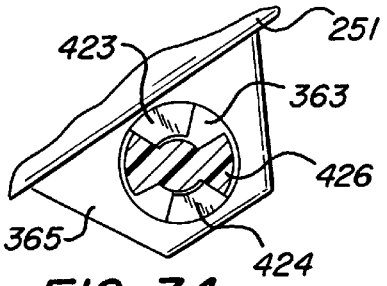

FIG. 33 shows one preferred internal construction for socket 363 and pivot pin 393, with both socket and pin being shown in their at-rest center position. Socket 363 has a pair of inwardly-projecting stops 423 and 424 on opposite sides of the socket. Pivot pin 393 is provided with a central section 425 and two wedge-shaped wing sections 426 and 427. In use, central section 425 of pivot pin 393 rotates on the inner surfaces of stops 423 and 424, which constitute opposed arc segments of an inner cylindrical bearing surface, and on the outer opposed arcuate surfaces of wedge sections 426 and 427 which rest on complementary interior cylindrical surface segments of socket 363. If cartridge 251 rotates sufficiently far, as illustrated in FIG. 34, then radially-aligned surfaces of wedge-shaped sections 426 and 427 engage adjacent radially-aligned surfaces of stop locks 423 and 424. This provides additional balanced positive-stop action which helps to prevent the rotational forces applied to the cartridge 251 by the user of razor 240 from exceeding the yield point of the leaf-spring material or the corresponding positive stops of cartridge-to-handle coupling mechanism 243. The coupling mechanism 243 may be constructed of all plastic materials, although rods 396, 397 and springs 398, 399 are preferably a steel alloy resistant to corrosion from exposure to water and all usual shaving aid products. Those in the art will appreciate however, that the various assembled structures of and major components of razor 240 may be made from any suitable material, and may be fastened together in alternate ways.

Figure 35:
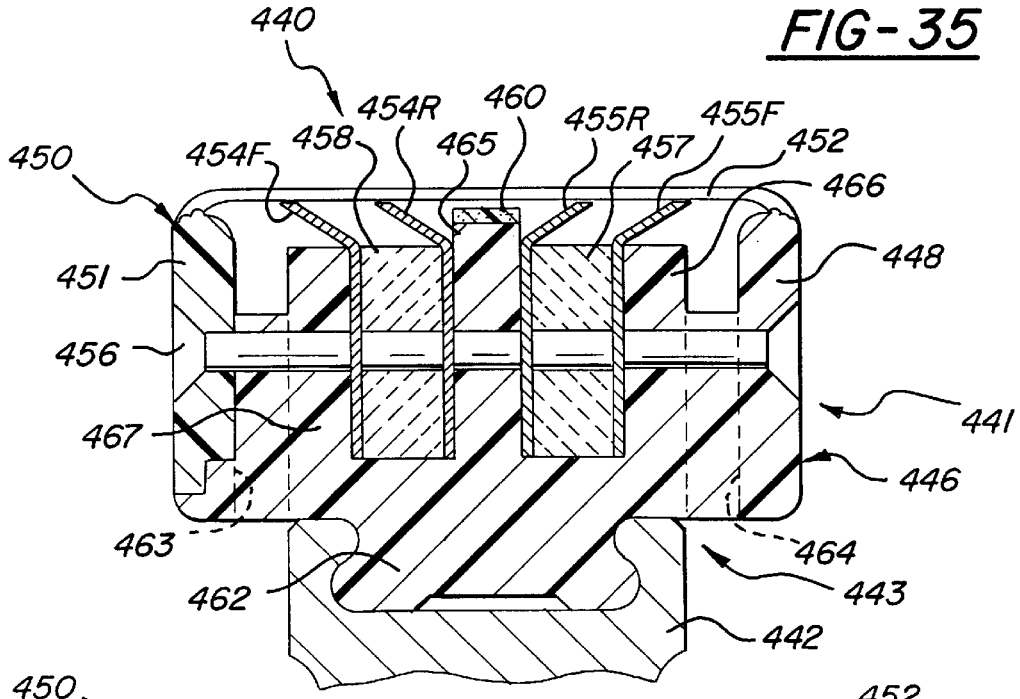
FIGS. 35 and 36 illustrate a seventh embodiment of the disposable bi-directional razor of the present invention, whose head is formed from two main pieces and which uses two sets of angled razor blade strips and horizontal locking assembly pins, where.
Figure 36:
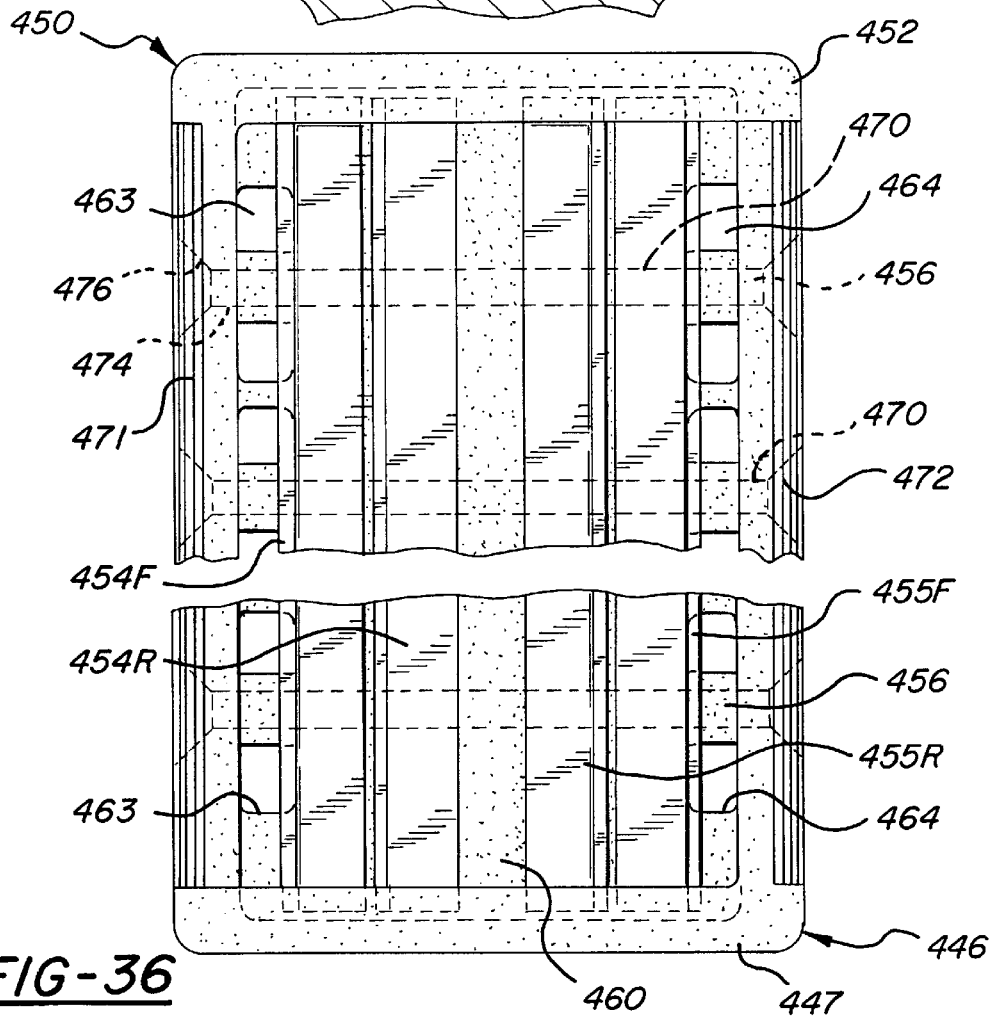

FIGS. 35 and 36 illustrate a seventh embodiment of my invention, namely a disposable bi-directional cartridge razor 440. Razor 440 is comprised of a cartridge head 441, connected to a handle 442 by a simple all-plastic slidable interlock mechanism 443 having an internal carriage molded into head 241 and outer track molded onto the top of handle 442. Head 441 has fewer pieces and is narrower in width than razor 240 of the previous embodiment, and still has an essentially flat face 445. Cartridge structure 441 is formed mainly of two pre-molded pieces: a blade seat structure 446, which includes an integral end cap portion 447 and guard bar portion 448; and a cover structure 450 which includes side portion 451 and end portion 452. Cartridge 441 also has two pairs of angled blade strips 454 and 455, a row of head-locking pins 456, blade spacer strips 457 and 458, and an elongated centrally-located glide strip 460.

Blade seat structure 446 includes base portion 462 through which two rows of passages 263 and 264 extend for flushing out cut hair and spent shaving cream. Structure 446 also includes center wall portion 465 and interior side wall portions 466 and 467 and an exterior side wall portion 468, all integrally formed with base 462. Rows of horizontal holes 470 having counter-sunk ends 472 extend through wall portions 465–467. Wall portion 451 associated with cover structure 450 also includes transverse horizontal hole portions 474 having countersunk ends 476. All of these holes are for receiving horizontally-disposed cartridge-interlock pins 456, which retain the blades firmly in place and provide additional rigidity to the overall cartridge structure.

The construction of the razor cartridge 441 shown in FIGS. 35 and 36 begins with pre-molded base structure 446 and cover structure 450. First, angled razor blades 454 are disposed on both sides of mica spacer block 458 and inserted into the elongated slot between wall portions 465 and 467. Next, blades 455 and spacer block 457 are brought together and inserted into the elongated slot between wall portions 465 and 466. Then, cover member 450 is placed into position, as shown in FIGS. 35 and 36. Dado joints or other mating surfaces may be used as adjacent contacting surfaces of seat and cover structures 446 and 450 to ensure perfect registration in all three orthogonal directions. Next, pins 456 are inserted through holes 470 and 474, and suitably fastened to ensure that the cartridge 441 does not come apart. The pins 456 may be made of metal or plastic or any other suitable material. If plastic, the pins may have one end melted into the countersunk hole portions 472 and/or 476. Obviously, registration holes are provided in the vertical wall portions of razor blades 454 and 455 and in spacers 457, 458 to receive the pins. This completes the cartridge structure except for the placement of optional lubricant strip 460 and connecting the handle to the cartridge using coupling mechanism 443. Note while pins 456 are shown being used to hold the completed head structure 441 together, any other suitable permanent fastening technique may be used instead.

Blades 454 and 455 may be made out of any conventional steel or other alloy material, either as an integral one-piece member as shown, or from two steel strips, namely a very thin flat blade strip with a sharpened edge laser spot welded to the diagonal portion of an angled thicker blade support member. Such two-piece angled blade constructions are well-known and in common use in some commercially available razors, but without pin registration holes.

FIGS. 37 through 39 illustrate an eighth embodiment of my invention, namely bi-directional razor 480, which includes disposable bi-directional cartridge 481 mounted on a permanent handle 482 through a semi-flexible, pivot connecting mechanism 483. Razor head cartridge 481 includes as its main molded components a base structure 484, a blade support structure 485, and end covers 487 and 488.

Pivot mounting structure 483 includes a handle-mounted section 489 on upper end 490 of handle 482. This section 489 includes elongated upper arm members 491 and 492 having upper end portions 493 and 494 from which pivot pins 495 and 496 extend inwardly facing one another. Pivot pins 495 and 496 resemble thick shaft ends and may have a frusto-conical shape and are engaged in corresponding bowl-shaped apertures 497 and 498 formed in end cover structures 487 and 488. Although not shown, within the upper end members 493, 494 and corresponding surfaces of cover structures 487 and 488, there may be provided spring return-to-center mechanisms and positive stops to control the pivoting action of the head 481 upon the handle 482 and to prevent over-rotation of the razor head on handle 482. Upper arms 491 and 492 and their end portions 493 and 494 are preferably made of semi-flexible plastic material, so that a user, upon squeezing the cartridge 481 by its side wall surfaces 503 and 504 and pushing it along in a longitudinal direction, may elastically deform the arm members sufficiently to uncouple one of the pivot pins 495 and 496 from its corresponding socket, and then angle the uncoupled end of the head upwardly so as to remove the cartridge from the handle. Installation of a new cartridge 481 simply requires reversing this procedure. Thus, a new cartridge may be easily installed whenever desired.

As shown in FIGS. 38 and 39, base structure 484 includes bottom portion 502 and side wall portions 503 and 504, which together form a U-shaped channel when viewed in cross-section as best shown in FIG. 39, with a large chamber 505 which opens upwardly. A blade subassembly 485 is installed in chamber 505, as shown in FIG. 39. Lower portion 502 of base structure 484 preferably includes three rows of internal support pedestals 506, 507 and 508, each formed like a mesa, for precisely locating blade subassembly 485 during installation, and for preventing the blades from moving downwardly during use of razor 480. Bottom portion 502 also includes a plurality of through passages 509 through 512 for allowing water and shaving debris to flow through the largely open razor blade subassembly 485 and out of the bottom 502 of the razor cartridge. A row of horizontally aligned holes 513 and 514 are provided in side walls 503 and 504 of base structure 484 for receiving blade-retaining interlock pins 515. Hole 513 may be enlarged as shown in area 516 for receiving the head of a cold-headed plastic pin 515.

The blade subassembly 485 includes four identical spool-like spacers having axially-aligned cylindrical holes therethrough for receiving the blade-retaining pins. An elongated rectangular slab-like spacer 517 is also provided between the two adjacent rear blades 524R and 525R. The distance between blades 524F and 525F from guard bars 527 and 528 at the top of side wall portions 503 and 504 is determined by the thickness of spacers 518. The clearance between the front and rear blades is determined by the thickness of spacers 519. If desired, the spacers 518 and 519 may be made identical in configuration and/or size to reduce manufacturing costs.

End covers 486 and 487 are registered with and secured to base structure 484 by a plurality of projecting studs 530 which are press-fit into corresponding apertures 531 in the end walls of base structure 484 shown in FIG. 39. The bottom of FIG. 38 shows two studs 530 projecting into two such apertures 531 in the base structure.

Razor cartridge 481 can be assembled manually or automatically. Assembly begins with preparing razor blade subassembly 485, with blades 424 and 425 sandwiched into position as shown in FIG. 39 between spacers 515 and 517. Subassembly 485 can be temporarily held together by two (or more) temporary interlock pins resembling pointed headless nails having an overall length no wider than the subassembly, which are inserted into the through-holes in the set of spacers and blades making up the subassembly. Once prepared, subassembly 485 is then inserted into its proper position within chamber 505 of base structure 484. At this point, the permanent interlock pins 515 may be cold-headed into place through the horizontal holes, including holes 513 in side wall 503, through the subassembly 485, and into press-fit engagement with holes 514 in side wall 504. The act of inserting permanent interlock pins 515 will drive the temporary interlock pins out of the cartridge entirely. Then, end caps 486 and 487 are installed to complete cartridge 481.

Those in the art should appreciate that razor cartridge 481 has very narrow width, and that all blades are shown arranged in a single, common working plane. In this embodiment, the trailing pair of blades act as rear glide strips for the active blades of the other pair. Dimensions, spacing and elevations of guard bars and blades and blade tangent angles may be changed as desired to produce an effective bi-directional razor device using the structure disclosed in FIGS. 37–39.

Figure 42:
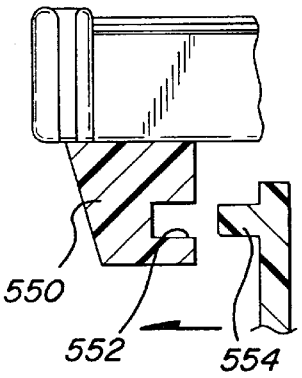
FIGS. 40 through 42 illustrate a ninth embodiment of the bi-directional razor of the present invention, which has a molded flexible razor head, a user-operable return-to-center bias force adjustment mechanism, and a detachable handle coupling mechanism which permits head swivels about a center line A outside and above the head through the use of large-radius, shell bearing members, where.
Figure 41:
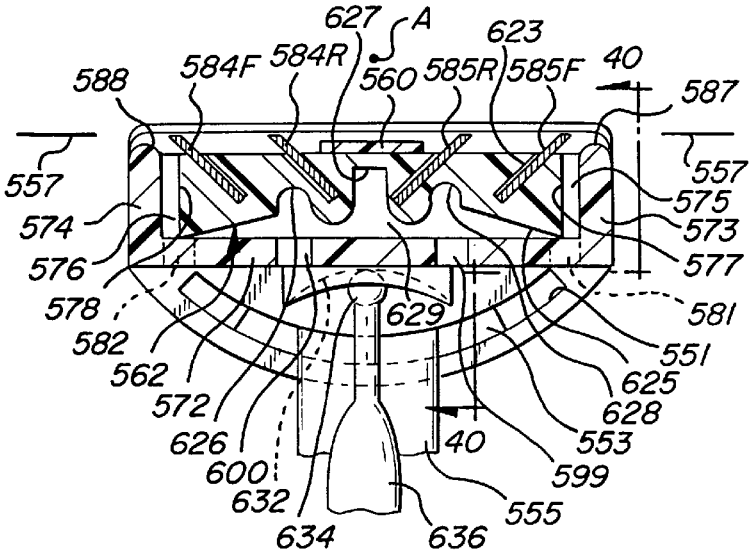
Figure 40:
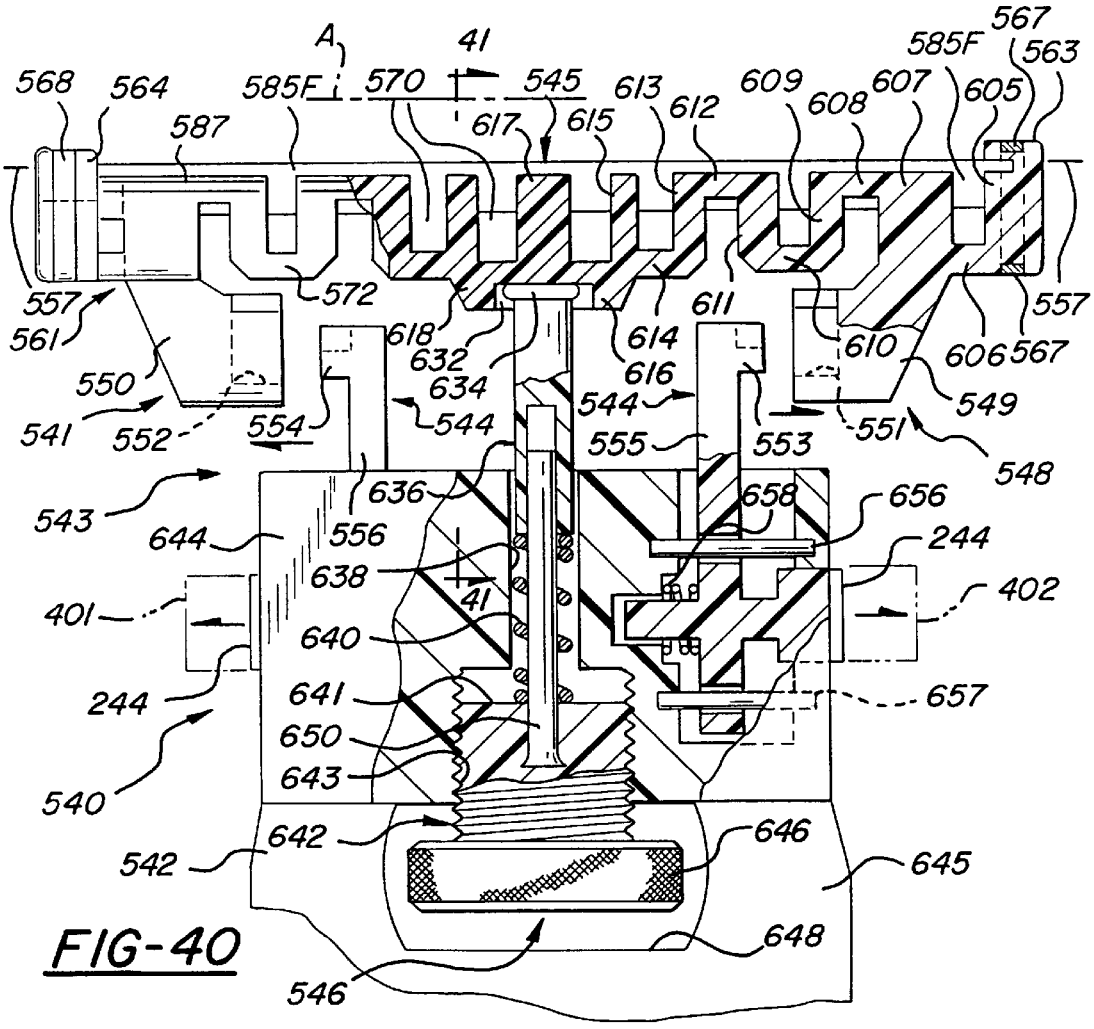
Figure 48:
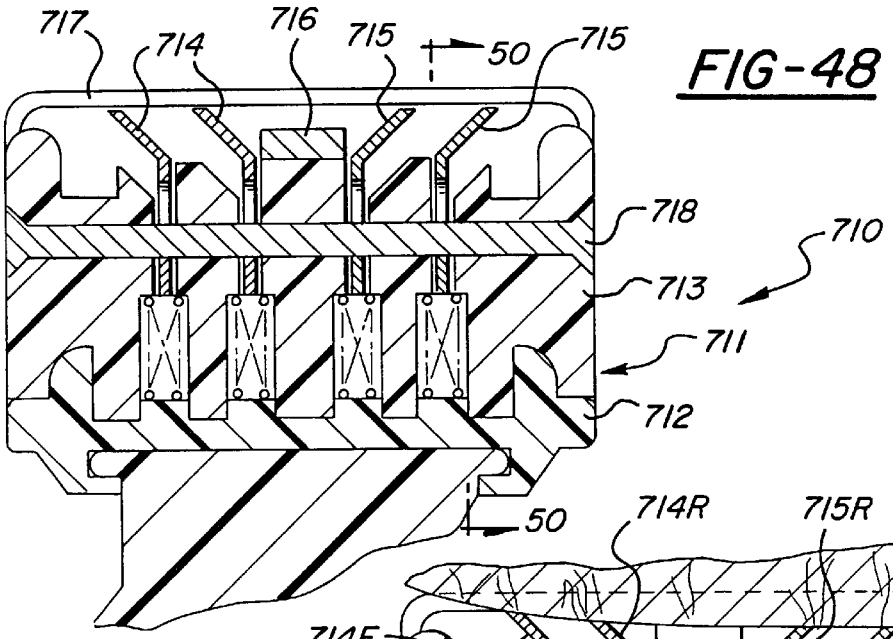
FIGS. 48 through 51 illustrate an eleventh embodiment of the bi-directional razor head of the present invention, which features razor strips which are individually movable and spring-loaded within the head, where.

FIGS. 40 through 42 illustrate a ninth embodiment of my invention, namely bi-directional razor 540. It includes a replaceable cartridge 541 mounted to handle 542 through a movable coupling mechanism 543 featuring a shell bearing pivot arrangement 544 and a field-adjustable return-to-center spring force adjustment mechanism 546. The cartridge 541 has a generally flat face 545. FIG. 40 is a side elevational view taken in partial cross-section showing the internal construction of flexible cartridge 541 and the field adjustable spring force mechanism 546. Cartridge 541 includes, as its part of movable coupling means 543, matched spaced opposing shell bearing support structures 549 and 550, in which are formed female shell bearing cylindrical arcuate surfaces 551 and 552 which resemble curved grooves. Handle 542 includes as part of its portion of coupling means 543, male shell bearing members 553 and 554 which are curved flanges that have the same basic radius as grooves 551 and 552. The grooves face longitudinally inwardly toward the central transverse axis of cartridge 541. Shell bearings 553 and 554 extend from arms 555 and 556 longitudinally outwardly away from the central transverse action axis of the cartridge.

Dashed line A in FIG. 40 represents the axis of rotation of cylindrical arcuate shell bearings 553 and 554. Point A in FIG. 41 represents this same axis. The radius of shell bearing segments 551 through 554 was deliberately selected to be large enough so that this axis of rotation A would be substantially above the working plane of the razor, which is represented by horizontal lines 557 in FIGS. 40 and 41. The axis of rotation A is preferably about 0.1 inch (2.5 mm) to about ⅜ inch (9.5 mm) above plane 557. As noted in the Summary of the Invention above, placing this axis of shell bearing rotation above the working plane of the blade edges is believed to improve the degree of control over bi-directional cartridge 541 experienced by the user, particularly as the contour of the skin changes rapidly. It causes improved tracking over the skin by bi-directional cartridge 541 particularly along rapidly changing skin contours. The cartridge tends to more quickly rotate or pivot the active blades away from contact with the skin, than it otherwise would if the axis of rotation were placed precisely in the working plane 557, as it is in prior art uni-directional razors.

Cartridge 541 may if desired be made of substantially rigid plastic material. Preferably, it is made of fairly flexible plastic or synthetic rubber material. In either case, shell bearing coupling mechanism 543 and return-to-center mechanism 546 will work well. The use of serpentine flexible cartridges in uni-directional razors is known, as is taught in aforementioned U.S. Pat. Nos. 4,409,735 and 4,443,939, and as found in the widely available Schick Tracer razor. However, to my knowledge, no one has ever applied flexible razor constructions to cartridges having four razor blades, or to razor heads having razor blades whose sharpened edges pointed in opposite directions. The flexible embodiment of cartridge 541 shown in FIGS. 40 through 42 will now be described.

Cartridge 541 includes central elongated lubricant glide strip 560, a flexible deck structure 561, a flexible blade seat structure 562, and two molded end cover plates 563 and 564. The end cover plates are installed on the cartridge after the razor blade strips and seat structure 562 are placed in deck structure 561, as shown in FIG. 41. The cover plates shield the user from the blade ends to prevent nicks, and help hold the razor blade strips and seat structure 562 in place within deck structure 561. Cover plates 562 and 564 are retained on the deck structure 561 by spring clip or band members 567 and 568, which may be made of spring steel (or any other suitable material) in a conventional manner like on the Gillette Sensor razor cartridge. Such clip or band members rest in a transverse track in the middle of the top surface of their respective cover plates, and completely or partially encircle the sides and bottom of ends of adjacent deck structure to which the cover is attached.

Deck structure 561 has, as shown in FIG. 41, a bottom or floor portion 572 and side wall portions 573 and 574, thus forming a channel having U-shaped cross-section when viewed in end cross-section, as shown in FIG. 41. This leaves an open chamber 570 in the deck structure 561, into which seat structure 562 is placed. Side wall portions 573 and 574 each include a row of spaced interior vertical column portions 575 and 576 (similar to vertical interior column portions 271 in FIG. 27) which at spaced intervals abut side wall portions 577 and 578 of seat structure 562. Between these two rows of spaced vertical columns 575 and 576 are debris passages 581 and 582 which pass through cartridge floor 572 to allow the open areas in front of blades 584F and 585F and behind guard bars 587 and 588 to be flushed. Interior passages 599 and 600 are more flush holes through floor 572.

Deck and seat structures 561 and 562 each are preferably made of an elongated serpentine-like interconnection structure of planar vertical and horizontal segment portions, such as segment portions 605 through 618 shown generally in the right half of FIG. 40. (Since the razor head structure 541 is symmetrical about its longitudinal and central transverse axis, it is sufficient to describe one-half of structures 561 and 562.) Odd-numbered planar segment portions represent generally vertical portions while even-numbered segment portions represent generally horizontal portions. The planes of these vertical segments are perpendicular to axis A, and the planes of the horizontal segments are parallel to face 545. This serpentine pattern of interconnected segment portions allows the blade deck and support structures 561 and 562 to flex in a direction perpendicular to both the longitudinal axis and central transverse axis of the razor head 541. In other words, cartridge 541 is able to flex when in use in a direction generally perpendicular to face 545 and working plane 557.

As seen in FIG. 40, adjacent overlapping sets of three segments have upright and inverted U-shaped cross-sections, which enables flexing to occur at both the top and bottom portions of deck and blade structures 561 and 562.

FIG. 41 shows that blade seat structure 562 supports flat blade strips 584 and 585 in a diagonal orientation with the two sets of sharpened edges pointing away from one another. Individual strips are inserted into slots pre-formed into structure 562, such as slot 623 in which blade 585F is located. The blades preferably do not fit snugly into the elongated slots. Instead each blade slot is made slightly wider than the width of the blade strip so that the blade will be free to bend in a direction transverse to the plane of the blade and slot, and can freely move longitudinally relative to individual transverse planar segments of structure 562. This manner of mounting blades 584 and 585 promotes the flexibility of cartridge 541, as will be further explained.

FIG. 41 further shows that blade seat structure 562 has been molded to have further flexibility that is independent of the flexing of deck structure 561. The lower interior surface 625 of structure 562 is sculpted to produce four thick regions separated by three thinner regions 626, 627 and 628. Central thin region 627, coupled with the nominal clearance space 629 between surface 625 and the adjacent interior surface of floor portion 572 of deck structure 561, allows seat structure 562 to bend downwardly in the center along its longitudinal axis, which tends to bend or bow the two sets of blade strips 584 and 585 in opposite directions generally perpendicular to their respective blade strip planes. Thin side regions 526 and 528 of the seat structure 562 provide further flexibility and independent bending of the seat structure 562 and the two sets of blade strips. This ability to bend the sets of blade strips in opposite directions due to clearances provided between the blade strips and their respective slots, and the flexibility within seat structure 562 itself due to the thin regions 526–528 helps ensure that one set of blades does not act as a stiffener within seat structure 562 to oppose the bending of the other set of blades. Because of the multiple degrees of freedom for bending of the blade strips 584 and 585 and deck and seat structures 561 and 562, cartridge 561 has an excellent ability to flex so as to conform the sharpened edges of the blades more closely to the contours of the skin to be shaved with razor 240.

The return-to-center spring force adjustment mechanism 546 includes a cam surface 632 between horizontal segments 616 and 618 extending from the floor section 552 of deck structure 561, and a cam operator 634 at the end of cam lever 636 extending upwardly from the upper end of handle 542. The cam lever is located in bore 638 and urged upwardly by helical spring 640 resting upon surface 641 of adjustment screw screwed into complementary threaded socket 643 in the upper end 644 of handle 542. Screw 642 has a knurled finger-actuated knob 646 accessible through clearance hole 648 in intermediate section 645 of handle 542. Guide rod 650 extends between a bore in screw 642 and a bore within cam lever 636 to maintain spring 640 in proper position, as it biases the cam lever into cam surface 632. The knob 646 may be adjusted by the user. Alternately, knob 646 may be replaced with a tool-actuated end, such as a hex nut end that requires a small wrench to operate. Further, the screw 642 may be hidden if desired, to allow only knowledgeable service personnel to adjust same. While the knob 646 is user-adjustable, hiding the screw behind a cover plate would make the mechanism adjustable only by qualified personnel in the field. The operation of mechanism 546 will be explained shortly in connection with FIGS. 43 and 44.

FIG. 40 shows in the lower right-hand portion thereof the internal mechanism which carries movable arm 555. Like the arrangement shown in FIG. 29 concerning the sixth embodiment, arm 555 is operated through user-actuated buttons 244 which, when pushed inwardly as shown, decouple the shell bearings 553 and 554 from corresponding bearing surfaces 551 and 552, thus allowing cartridge 561 to be changed. Arm 555 rides on rods 656 and 657, and is returned to its normal position, indicated by dotted lines 402 in FIG. 40, by bias spring 658 on the part of arm structure 555 opposite button 244.

FIGS. 43 and 44 illustrate the tenth embodiment of the present invention, namely pivotable razor head 680, which is similar in a number of respects to razor 540 shown in FIGS. 40 and 42. In particular, the spring-return spring force mechanism is identical, and therefore will be used now to further explain now the pivot operation of razor 540. FIG. 41 shows the cartridge 561 in its center position, at rest on handle 542. When a rotation-inducing force is applied to the cartridge 561, such as counter-clockwise ("CCW") force represented by arrows 421 and 422 in FIG. 43, the shell bearing 553 slides in its arcuate groove 551, thus causing the cartridge to rotate about center point A, as shown in FIG. 43. If the CCW rotational forces 421, 422 continue to build, then, as shown in FIG. 44, end portion 663 of shell bearing 553 contacts end wall 661 of bearing surface groove 551, thus preventing further rotation. Those in the art will appreciate that opposite end 662 of groove 551 also is a positive stop to prevent rotation in the opposite direction in response to clockwise pivot forces.

The cam lever 636 is continuously biased upwardly against cam surface 632 by compression spring 640. A comparison of FIGS. 41, 43 and 44 reveals that as the angle of rotation of the cartridge increases, change in the thickness of cam surface 632 causes cam lever 636 to be pressed downwardly against the force of spring 640 in proportion to the amount of rotation. In this manner, the return-to-center spring force mechanism 546 exerts a continuous restoring force that is substantially linear with the angle of rotation, assuming the curvature of cam surface 632 has been properly selected.

Adjustment knob 646 can be used to adjust the force exerted by spring 640. When knob 646 is used to turn screw 642 clockwise, the spring 640 is compressed, thus increasing the pressure cam 634 exerts through lever 636 on the cam surface 632, and thus more strongly tending to urge the cartridge from a pivoted position to its at-rest position. Conversely, rotating knob 646 in screw 642 counter-clockwise reduces the force on spring 640, and thus reduces the spring return-to-center restoring force exerted through cam lever 636 and cam surface 632. Hence, the user (or service person having access to screw 642) is able to adjust the bias force operating on the shell bearing pivot mechanism of razor 540 and razor 680. Those in the art will appreciate that this user-adjustable variable return-to-center biasing force allows the user to customize, to some extent, the pivoting action of razors 540 and 682 to his or her liking. The spring restoring force can be made whether heavy or light, as preferred by the user.

FIGS. 45 through 47 illustrate that the cam surface 632 may be varied, with different results, in terms of altering the return-to-center force in relation to the angle of rotation (i.e., pivoting) of the cartridge to the handle, and these results are graphed in FIG. 46. FIG. 47 is a graph of distance traveled by cam lever 636 as a function of angle of rotation.

FIG. 45A shows my first cam 632A (which is identical to cam surface 632 shown in FIGS. 41 and 43). Cam surface 632B shown in FIG. 45B has a shallower rise, and thus produces less force per unit of angle rotation, as shown in line 632B in FIG. 46, but still produces a linear restoring force as a function of angle of rotation.

FIG. 45C and 45D show cam surfaces 632C and 632D which produce variable rate (nonlinear) restoring forces. Their restoring forces start slowly and then increase rapidly as a function of angle of rotation, in almost exponential form. Since the rate of rise of cam surface 632C is greater than cam surface 632D, the graphs of force versus angle of rotation in FIG. 646 show greater force being produced by cam surface 632C than by cam surface 632D. Armed with the foregoing information, those skilled in the art should be able to design any given spring-to-return force versus angle characteristics they may desire in conjunction with razor heads or cartridges which pivot upon their handles.

FIGS. 43 and 44 illustrate the tenth embodiment, namely bi-directional razor 680 which has two distinct working planes which are less than 15 degrees away from being co-planar. Because skin to be shaving is normally soft and pliant, razor 680 is still able to operate in a manner substantially identical, from the user's point of view, to my bi-directional razors which have all their blades in substantially the same working plane.

Bi-directional razor 680 shown in FIGS. 43 and 44 includes a pivoting cartridge 681 of substantially the same in construction as cartridge 561 in the previous embodiment, except that the blade seat structure 682 has substantially solid planar vertical and horizontal segments, (e.g., those segments corresponding to segments 605 through 616 shown in FIG. 40). In other words, the sculpted bottom surface 628 found on blade seat structure 562 (see FIG. 41) has been replaced in blade seat structure 682 by solid material as shown in FIG. 43. Blade strips 584 and 585 are still loosely mounted in diagonally-oriented slots, such as slot 683, so that they can move relative to seat 562 when cartridge 681 is flexed. Cartridge 681 also includes a modified glide strip 685 which is slightly rounded between top surfaces 687 and 689. Cartridge 681 also includes a modified profile for top surface 688 of end cover plate 563 to accommodate the two working planes which will be discussed next.

Three planes may be identified relative to cartridge 681, namely guard (or front blade) edge plane 690, first working plane 691, and second working plane 692. Plane 690 extends parallel to the face 695 of blade seat structure 682, and is defined by the topmost surfaces of guard bars 587 and 588 of cartridge 681. It is parallel to the front blade edge plane, defined by the sharpened edges of blades 584F and 585F. The first set of blades 584 are found in the first working plane 691, which extends between guard bar 588 and rear guard surface 689 of glide strip 685. The sharpened edges of blade strips 585 are found in the second working plane 692, which extends between front guard bar surface 587 and rear glide strip surface 687. The first and second working planes are both at equal and opposite angles (in the range of about 2.5 degrees to 7.5 degrees) to the guard bar plane 690. In order for the bi-directional razor 680 to be usable in essentially the same manner as the previous embodiments, it is necessary for this acute angle to be about 8 degrees or less. Thus, the combined angle between working planes 691 and 692 is shown in FIG. 43 to be 14 degrees, but may be anywhere in the range of about 5 to about 15 degrees for example. As long as this combined angle is anything less than about 15 degrees, this dual plane will still permit both sets of blades to engage the skin to be shaved as the cartridge 681 is moved back and forth by a user without the need to lift, turn or tilt the handle for shaving bi-directionally, i.e., (in opposite directions of movement) with cartridge 681 along the skin.

While razor cartridges 651 (in FIG. 41) and 681 (in FIG. 43) have been shown to have loose-fitting diagonally-oriented slots in which flat blades 584 and 585 are placed, such loose-fitting slots are not necessary if the razor cartridge is not flexible. In other words, when the seat structures 562 and 682 are to be made out of substantially rigid material, the loose slots may be replaced with snug-fit or very-light-press-fit diagonal slots for the blade strips. The resulting structure for razor 680 may take the appearance of cartridge 681A in FIG. 44. Thus, those in the art should appreciate that the basic design for dual-plane razor head 681 may be used with rigid as well as flexible cartridges, and with fixed as well as pivoting razor head and handle combinations.

Figure 49:
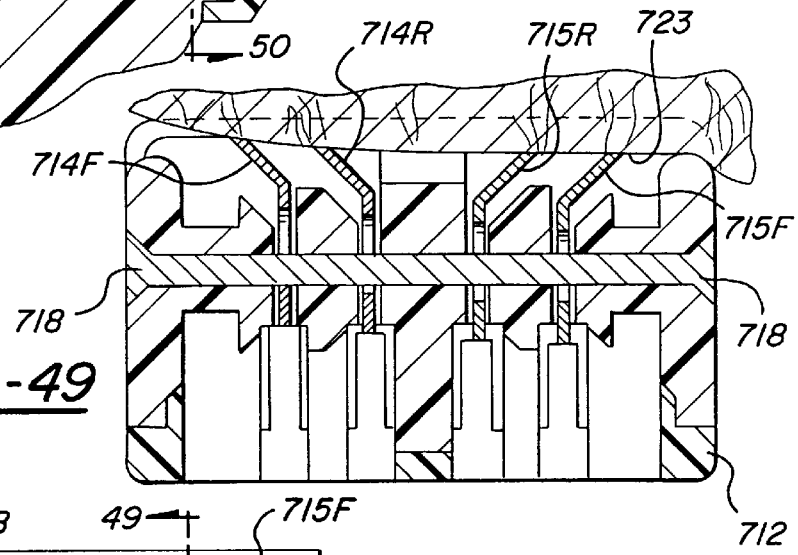
Figure 50:
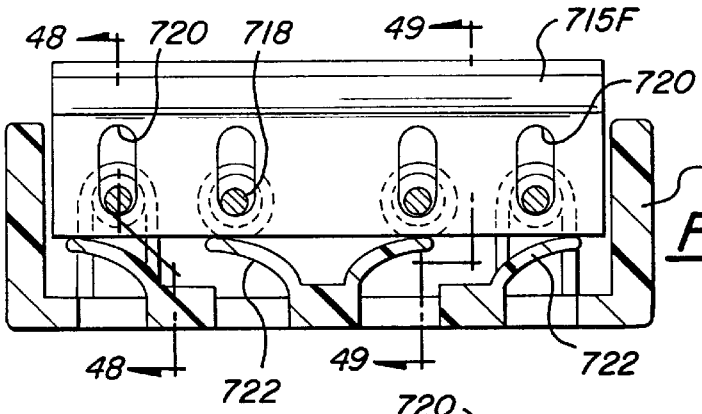
Figure 51:
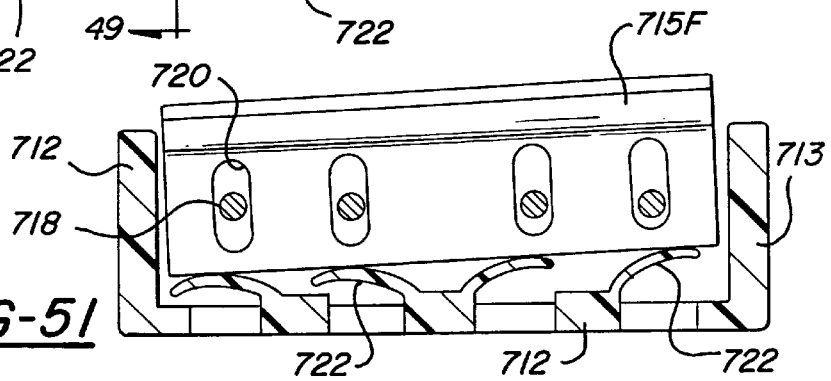

FIGS. 48 through 51 illustrate an eleventh embodiment of the invention, namely bi-directional razor 710 having cartridge 711 secured rigidly to handle 712 through a sliding track coupling. Razor head 711 includes: a base structure 712; a blade spacer structure 713; first set of blades 714; second set of blades 715; glide strip 716; a pair of end covers, such as cover 717; and a series of horizontally arranged interlock pins 718 which pass through elongated registration holes 720 in the razor blade strips. The blades 714, 715 are individually sprung by a set of leaf-spring fingers 722 integrally formed within the base structure 712, as shown in FIGS. 49 and 50, that curve upwardly and push up on the bottom of the blade strips. Angled blades 714, 715 may thus be depressed by the passing skin 723 as shown in FIG. 49. There, blade 714F is at its full upright position, while the remaining blades 714R and 715 are partially depressed. FIG. 51 illustrates how the individual blades, such as blade 715F may also be tilted at an angle to the guard bar plane or face of the razor in response to forces applied by the skin of the user that is to be shaved. The bi-directional razor 710 and cartridge 711 thus illustrate that individually-sprung blades may be employed in the bi-directional razors of my invention.

FIGS. 52 through 54 illustrate a twelfth embodiment of my invention, namely bi-directional razor 740, which has a cartridge of ultra-thin width, in part due to the use of a single blade in each shaving zone, as will now be explained. Razor 740 includes a replaceable bi-directional cartridge 741 pivotally mounted on handle 742 by virtue of a shell-bearing pivot arrangement of the type discussed in connection with FIGS. 40 through 44, which needs no further explanation. Cartridge 741 includes a main cartridge structure 742, and end cap members 743 and 744. It has a single working plane 745 defined by centrally-located glide strip 746 and front guard bars 747 and 748, as well as the top surfaces of end cover 743 and 744. The main cartridge structure 742, shown in FIG. 53, includes base section 752, and side wall sections 753 and 754 which snap onto upstanding prongs 755 and 756 of base section 752. Sets of leaf springs 761 and 762 respectively bias in an upward direction angled blades 764 and 765 to their full upright position. Center section 766 and interior side wall sections 767 and 768 serve to keep the blades in a generally upright position, even if they should be biased downwardly by forces generated during engagement of the skin against the blades. The internal structures of cartridge 741 depicted in FIG. 53 are preferably repeated at three to four times along the length of cartridge 741.

FIG. 54 illustrates another end cross-sectional view of cartridge 741 showing how the cartridge construction may be generally open between internal wall sections 767 and 768 to provide a generally open interior and debris passages 777 and 778 through base section 752 to minimize the problems associated with cut hair and other shaving byproducts that might otherwise collect within cartridge 741 and possibly impede proper operation of razor blade strips 764 and 765 by sets of springs 761 and 762. Blades 764 and 765 may be of a two-piece construction as shown. For example, blade 765 includes a thin-gauge elongated flat razor strip 771 with a single sharpened edge that is laser welded or otherwise bonded to a thicker gauge angled blade strip support member 772. Finally, attention is directed to the lack of blade-retaining interlock pins in this embodiment. This shows that my bi-directional razors may be provided with movable razor blade strips without using blade-strip interlock pins. In cartridge 741, it is the end covers 743 and 744 which ensure that the blade strips cannot become detached from the cartridge during use.

Figure 55:
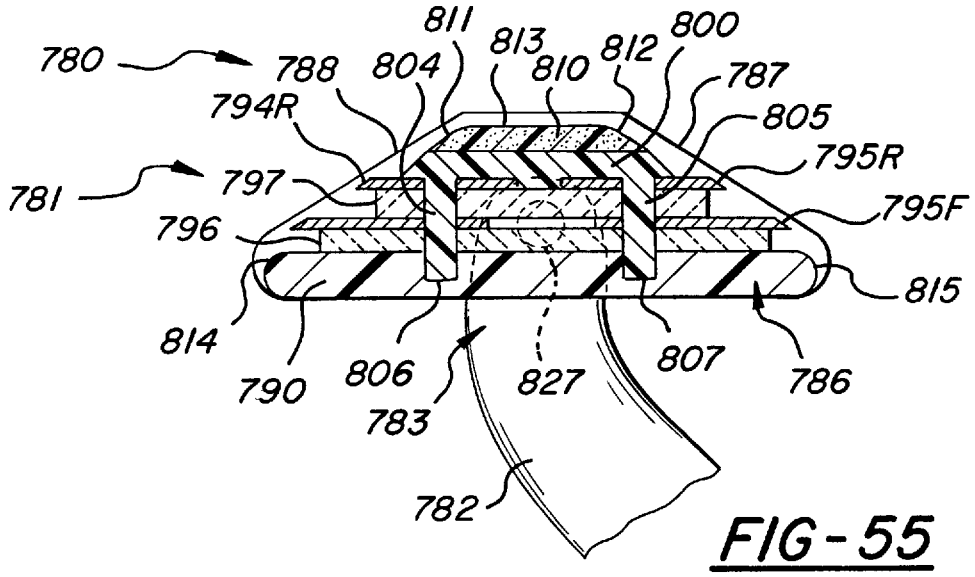
FIGS. 55 and 56 illustrate a thirteenth embodiment of the bi-directional razor system of the present invention which features two sets of horizontal blade strips located within a single head structure that is pivotally mounted to a handle connected to its bottom and is capable of bi-directional operation since the head rotates during use so that the two opposed sets of blades can be used without lifting the razor from the skin, and where.
Figure 56:
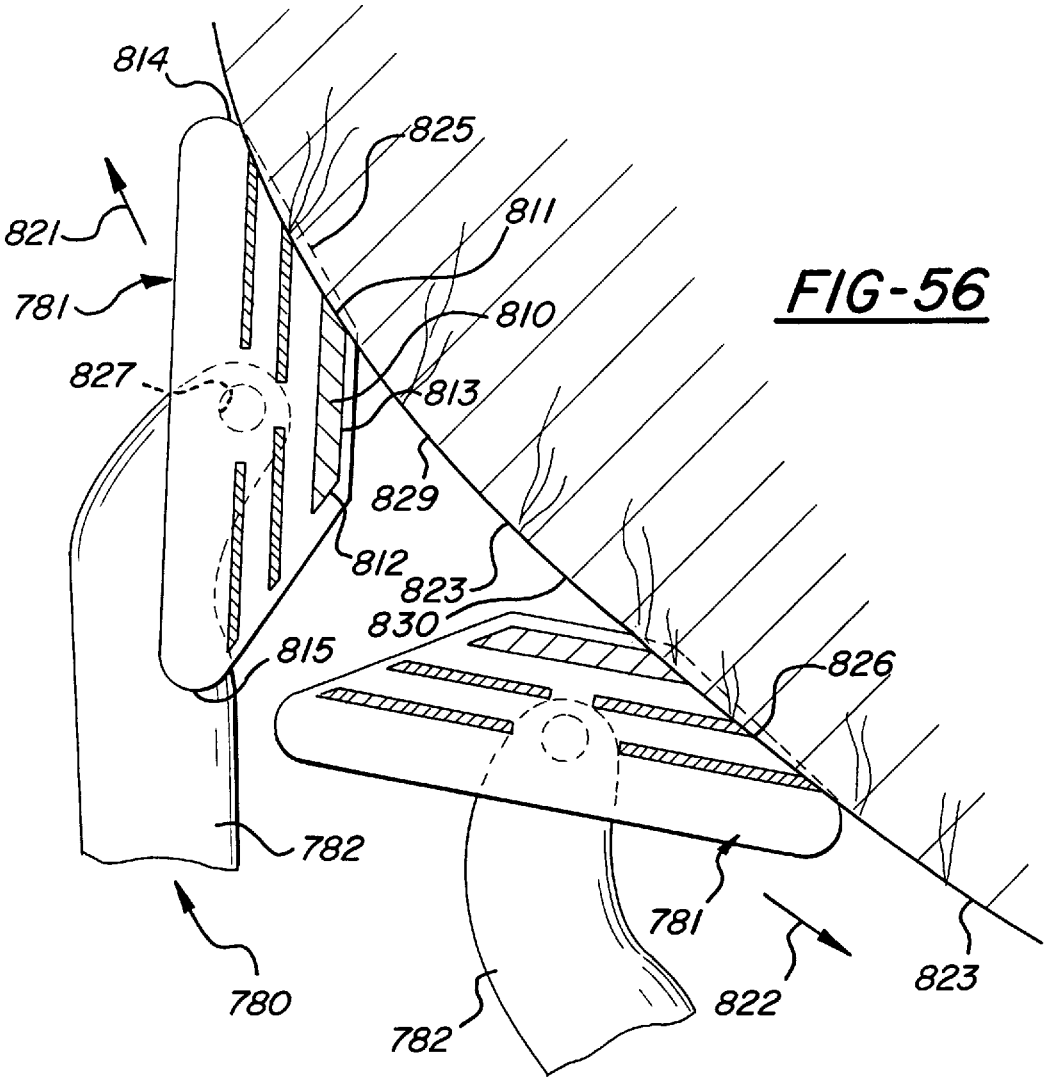

FIGS. 55 and 56 illustrate the thirteenth embodiment of my invention, namely bi-directional razor 780 having a dual-plane cartridge 781 mounted on handle 782 using a pivot pin mounting mechanism 783. Razor cartridge 780 includes main cartridge structure 786, and end caps 787 and 788 (cap 788 is not shown). The end caps may be integrally formed as molded end walls on the base member 790 of the main cartridge structure 786. Cartridge 781 includes two pairs of blade strips 794 and 795 and two blade strip spacers 796 and 797, which are all pinned into position by blade cap 800. Cap 800 includes two rows of pins 804 and 805 which respectively pass through registration holes in blade strips 794 and 795 and registration holes in spacers 796 and 797, before being press-fit into registration holes 806 and 807 of the base member 790. Cartridge 781 also includes a guide strip 810 which has sloped surfaces 811 and 812 and top surface 813. The strip 810 is glued or otherwise fastened to blade cap 800. Cartridge 781 also includes scalloped front guard bars 814 and 815 as shown. The first working plane, in which sharpened edges of blade strips 494 are located, is defined in part by front guard bar 814 and rear glide strip surface 811. The second working plane, in which sharpened edges of blades 795 reside, is defined in part by front guard bar 815 and rear glide surface 812.

FIG. 56 depicts razor cartridge 781 in operation in two different locations and directions 821 and 822 along a stretch of skin 823. When razor head 781 moves in the direction shown by arrow 821 along skin 823, head 781 toggles or pivots into contact with the skin as shown at location 825, with the first working plane of the razor and blades 794 in contact with the skin 823. As can be seen, front guard bar 814 and rear glide surface 811 are also in contact with the skin. When the direction is reversed, as shown by arrow 822, the cartridge 781 toggles into the orientation shown in location 826. This toggling action occurs as the handle 782 is pulled backwards, which causes the head 781 to roll about pivot point 827. This causes top surface 813 of glide strip 810 to come into contact with skin 823 at about location 829. As handle 782 continues to move, cartridge 781 naturally flips or toggles so that the second working plane defined by front guard bar 815 and rear glide surface 812 comes into contact with the skin at about location 830, at which time blades 795 become active and begin to shave hair from the skin. When the user wishes to resume shaving in direction 821, the toggling action just described is reversed at whatever location on the skin the cartridge happens to be at. FIG. 56 clearly shows that the first and second working planes of cartridge 781 intersect at a line of the cartridge at an obtuse angle. Clearly the angle between the working planes is such that when one set of blades is active against the skin, the other set will be rotated off of the skin entirely. Nevertheless, when shaving a flat portion or plane of skin, the first and second working planes of razor head 781 are toggled into and out of position so that the two opposed blade sets are effectively operating in the same single plane. Accordingly, I sometimes call this dual-plane pivoting razor head design illustrated in the thirteenth embodiment a "single effective plane" design since the two distinct working planes operate in a "single effective plane".

FIGS. 57 and 58 illustrate a fourteenth embodiment of my invention, namely dual-plane bi-directional razor 840. Razor 840 includes cartridge 841 mounted on handle 482 through pivoting mechanism 483 already discussed in connection with the FIG. 37 embodiment. Thus, only the details of cartridge 841 need be discussed here. Cartridge 841 includes end cover members 842 and 843 which have a rounded triangular appearance and shield the blade edge corners from nicking the user. Cartridge 841 includes base structure 846, blade-retaining interlock pins 847 and 848, blade spacer member 849, blade cap member 850, and an arcuate elongated glide strip 845 having surface segments 851 and 852. Base structure 846 includes front guard bars 854 and 855.

Cartridge structure 841 has a reduced width due to a more compact internal structure. Diagonally-oriented interlocking pins retain the two sets of blade strips 854 and 855, which themselves are less wide than corresponding blade strips 794 and 795 in the previous embodiment. Deck structure 846 includes front guard bars 856 and 857. The first working plane, in which blade edges 854 reside, is defined in part by front guard bar 856 and glide strip surface segment 851. The second working plane, in which blade edges 855 reside, is defined by front guard bar 857 and rear guard strip surface 852. In operation, the cartridge 841 transitions from the first to the second working plane and back more readily than previous razor 780 does because it is narrower and because glide strip 845 is more rounded and smaller than glide strip 810. Also, strip 845 lacks a flat surface like flat surface 813 on strip 810 that tends to impede the transition of cartridge 781 between working planes.

FIG. 59 illustrates a fifteenth embodiment of my invention, namely razor 860, which is a modification of razor 840. Razor 860 features a still smaller overall size and narrower width than razor head 841 shown in FIG. 58. Razor head 861 has a simplified internal construction utilizing one row of vertical interlocking pins to hold the blades of dual plane cartridge 861 in place. In previous cartridge 841, interlock pins 847 and 848 are press fit into corresponding holes in blade cap member 850. In contrast, cartridge 861 of FIG. 59 has an end cap 872 from which the vertical interlocking pins 873 are integrally formed, which extend downwardly from blade cap 872 into blade deck structure 876. Blades 874F and 875F may be made from one piece of flat razor blade strip stock sharpened on both sides. Similarly, the razor blade edges 874R and 875R may be made from a narrower single piece of razor blade strip stock sharpened along both edges. The simplified construction of cartridge 861 should make it cheaper to mass-produce than cartridge 841 in FIGS. 57 and 58. In all other respects it operates in the same way as cartridge 841.

The thirteenth through fifteenth embodiments just described all employ two sets of horizontally arranged, vertically-stacked razor blade strips disposed in cartridge structures having a generally trapezoidal or triangular shape when viewed in end cross-section. Further, each cartridge featured generally two distinct working planes separated from the horizontal blade deck plane by about 10 to 15 degrees or more. Due to the pivoting interconnection between the dual-plane cartridge and the handle, these pivoting razor heads are nonetheless able to operate bi-directionally with the two working planes toggling into and out of a single effective plane. Pivoting or toggle-action dual-plane bi-directional razors of my invention may also be constructed with vertically arranged angled blade strips interconnected by horizontally-disposed interlock pins, as shown in the next three embodiments.

FIGS. 60 through 63 illustrate a sixteenth embodiment of my invention, namely dual-plane pivoting bi-directional razor 880. For ease of illustration, the usual handle, such as handle 482 has been omitted from the drawings so that attention may be focused upon dual-plane cartridge 881. FIG. 60 shows that cartridge 881 employs an outside socket 882 on end cover member 883 to receive the pivot pin of pivoting connection mechanism, such as mechanism 489 shown in FIGS. 37 and 38. Cartridge 881 has two sets of blades 884 and 885, with the sharpened edges of each arranged in its own distinct working plane. Blades 884 are in a plane parallel to diagonal surface 886 of end cover 883. The second working plane containing the sharpened edges of blade 885 is parallel and closely adjacent to diagonal surface 887 of cover 883.

FIG. 61 shows a preferred construction for cartridge 881 which includes: blade deck structure 892, a blade seat structure 893 and a blade cap structure 894 having a lubricant strip 895 disposed thereon provided with planar rear glide surfaces 896 and 897. FIG. 62 shows a top view of deck structure 892, in plan on the left and in longitudinal cross-section on the right. This view reveals rows of debris passages 901 through 904. FIG. 63 shows the blade seat structure 893 in plan view and partial cross-sectional view. The razor head 881 includes rows of interlock pins 905.

FIG. 64 shows one embodiment for a plastic interlock pin 905 before use. FIG. 65 shows the same pin with its ends partially melted by heat after insertion into a cartridge structure, so as to have a final appearance as shown in FIG. 65. The bulging ends 906 and 907 ensure the pin 905 will remain locked into position with the cartridge.

In operation, cartridge 881 operates in the same manner as the previous three embodiments. The first and second working planes toggle into and out of contact with the skin to be shaved as the razor handle is moved back and forth by the user.

FIGS. 66 and 67 illustrate a seventeenth embodiment of the present invention, namely a dual plane bi-directional razor 920 having a razor head 921 and handle 922 connected together by a "slide and pivot" coupling mechanism 923. Cartridge 921 may be constructed in the same manner as cartridge 881, and need not be further discussed, except with respect to its slide-and-pivot mechanism 923. The upper end portion 924 of handle 922 includes a large pivot pin 926. The coupling mechanism 923 may be substantially similar to mechanism 489 shown in FIGS. 37 and 38, if desired. The elongated horizontal slot 930 with semi-circular end portions is located in the end cover section or wall portion 933 of cartridge 921. Pivot pin 926 will normally be in either location 931 or 932 when razor 920 is in use. Pivot pin 926 will be in location 931 when blades 884 are active, that is, when the first working plane and surface 886 are bearing against the user's skin. Pivot pin 926 will be in location 932 when the second set of blades 885 are active due to the second working plane and surface 887 bearing against the skin.

The slide and pivot coupling mechanism 923 of razor 920 is advantageous because it places the pivot pin 926 directly adjacent to, and centrally located above and between, the active blades for improved user control of the cartridge 921. This also represents the placement of the pivot point directly above located at or very near the mid-point of the active working plane. For example, in location 932, pivot pin 926 is located along line 935 substantially equidistant between front and rear blades 885F and 885R and substantially equidistant from the front guard bar location indicated by line 936 and the rear glide strip location indicated by line 937.

FIG. 67 shows the razor head 921 with positive stops blocks 938 and 939 added. Positive stops 938 and 939 are strategically positioned on and mounted securely to side wall of end cover 933 to contact the upper portion of 924 of handle 922 when the handle should not be further rotated relative to the cartridge without physically pivoting the cartridge with the handle. As can be seen, these stop blocks 938 and 939 help the user use the handle if so desired to pivot cartridge 921 further than it wants to pivot on its own while being pulled along parallel to the plane of the skin. While the positive stops shown in FIG. 67 take the form of blocks contacting the handle, any other form of positive stop mechanism may be used for the application just described.

FIG. 68 illustrates the eighteenth embodiment of my invention, namely dual-plane bi-directional razor 940. Razor 940 includes bi-directional razor head 941 and handle 922, attached through a curved "slide-and-pivot" coupling mechanism 943. The cartridge 941 may be constructed in the manner of cartridge 881 shown in FIGS. 60 through 63, except for the differences attributable to the new coupling mechanism 943. Mechanism 943 includes a large pivot pin 926 on the upper portion 924 of handle 922. The end wall portion 944 includes a curved elongated slot 950. The longer curved surface 951 of slot 950 generally corresponds proportionally to the shape of nearby surfaces 952, 953 and 954 along the top edge 955 of end wall portion 944. As a result, the toggling or transition of cartridge 941 between the three positions shown namely positions 941-1 (upper illustration-first working plane engaged), position 941-C (center illustration-transition between working planes) and position 941-2 (lower illustration-downward direction of travel-second working plane engaged) is made to occur more smoothly. This is because the pivot pin 926 essentially or generally is not moving toward or away from the skin as the cartridge 941 transitions back and forth between locations 941-1 and 941-2. Thus, by using the curved "slide and pivot" coupling mechanism 943, the user enjoys a more comfortable shave with cartridge 943 since the handle remains at approximately the same distance from the skin even as the pivot pin 926 and razor head 941 toggles and transitions back and forth between the two orientations of first and second working planes by the user moving the handle 922 to and fro in opposite directions.

Bi-directional Shaving Methods

Having described 18 exemplary embodiments of the bi-directional razors and cartridges of my invention, it is now useful to summarize the shaving methods associated with the different classes of embodiments of my bi-directional razors.

In order to shave with any one of my bi-directional razors in the first twelve embodiments, the user holds the razor by the handle or hand grip in the normal manner in which he or she has become accustomed to holding a conventional uni-directional razor. The user grasps the razor handle and applies the head of the razor adjacent the skin portion to be shaved. For example, as shown in FIG. 18, the razor head is placed against the skin schematically shown at 132. The user may stroke the razor first in one direction, and then, at the end of the stroke, reverse the movement to stroke in the opposite direction. This back-and-forth motion is indicated by the arrows adjacent the handle and the head in FIG. 18. Thus, no special grip and no unusual motion is required to engage in bi-directional shaving with my new manual bi-directional razors. In other words, the required shaving technique is performed in accordance with the grip style and motions very similar to the user's previous experience with uni-directional manual safety razors. To that end, my bi-directional razors need not be tilted, or lifted, or repositioned for the return strokes or to cut in an opposite direction, as is the practice with a normal uni-directional razor. Hence, my bi-directional razors may simply be moved back-and-forth, fairly rapidly, to complete the shaving process bi-directionally and expeditiously.

When shaving with any of my dual-plane pivoting or toggling bi-directional ("TBD") razors shown in the thirteenth through eighteenth embodiments, the user grips the TBD razor handle the way he or she grips a conventional uni-directional razor. The user still moves the handle in the same manner as well after the razor has been placed against the skin. Most importantly, the user can stroke and cut hair in both directions without lifting the TBD razor head from the skin, or changing the orientation of the handle as the direction of razor head travel is changed. However, the user will have to adapt to the slight motion of the razor head toggling or transitioning from one shaving zone or working plane of the razor head to the other, as the direction of razor head travel is reversed. As shown and discussed in my later embodiments, the construction of these dual-plane pivoting bi-directional razors may be optimized to minimize the distraction transition motion this may present to the user. Other than this one change, the overall shaving experience with these TBD razors should be very similar to that of my other bi-directional razors whose sharpened edges are in the exact same plane or in substantially the same plane or in two distinct working planes having a combined angle between them of less than about 15 degrees.

Further Advantages of the Structures of the Present Invention

The Back Blades As an Efficient Glide Surface. One of the advantages of the bi-directional razors of my invention, such as in the first embodiment, but also the second through ninth embodiments shown in FIGS. 8 through 42, is that the second set of razor blade strips which are not actually cutting hair are being dragged along the skin, and thus are functioning as part of back-portion skin-locating and rear glide means. The use of one or two polished metal blade strips at an angle anywhere between close to zero degrees up to about 20 degrees from the horizontal, or even up to 35 degrees from the horizontal provides a smooth stable rear glide surface that helps define the working plane of the forward razor blade strips actually involved in the cutting of hair.

Those in the art will appreciate that my bi-directional razor blade structures may be utilized in conjunction with such a flexible cartridge system. Specifically, the ninth and tenth embodiments which feature blade strips in two horizontal planes, in particular can be adapted to such a flexible cartridge structures as are taught in the aforementioned Motta patent with a flexible razor blade cartridge symmetrical about its axial center line that releasably secures the cartridge through a pivoting mechanism from its bottom side.

It should be appreciated that most if not all of my assembled bi-directional razors can be efficiently constructed and economically mass-produced using current manual safety razor construction and automated assembly techniques. In particular, all molded plastic components can all be made from conventional plastic material using available molding machinery with dies that have been machined to produce finished parts, such as, for example deck structure 251, blade seat structure 252, and cover structure 253 of razor 240. The blade strips and blade spacers, with their registration holes can be made using conventional equipment. Special tooling can easily be made to allow my bi-directional razors to be automatically assembled using conventional equipment at very low cost.

Preferred Dimensions For My Bi-directional Razors

Many of my bi-directional razors shown in the Figures and described here are sized and configured to be aesthetically pleasing, well-balanced, and comfortable to hold and use. Due to the need to be able to emphasize and clearly show key features under discussion, the Figures are not always shown to scale. Accordingly, the following table lists, for each of the illustrated embodiments of my present invention, typical overall widths and heights and a preferred range of overall widths and heights to give a clearer picture of the relative sizes of the different embodiments. The width on the razor head is measured across the front guard bars on either side of the razor head. The height is measured from the bottom of the razor deck structure (or seat structure if no deck is used) to the highest point of the working face or plane(s) or blade cap or central glide strip of the razor.

A preferred length to the bi-directional razors of the present invention is about 1.5 inches (75 mm), and preferred range of lengths for the head of the razor in each embodiment is from about 1 inch (25 mm) to about 2 inches (50 mm). Dimensions in the table below are given in fractions of an inch (and corresponding metric dimensions are given in parentheses).

| Figure Numbers | Embodiment Number | Typical Width | Range of Widths | Typical Height | Range of Heights |
|---|---|---|---|---|---|
| 1–7<br>18–19 | 1st,<br>4th | 7/16<br>(11) | 3/8 to 5/8<br>(9.5 to 16) | 3/16<br>(4.7) | 1/8 to 1/4<br>(3.2 to 6.4) |

-continued

| Figure Numbers | Embodiment Number | Typical Width | Range of Widths | Typical Height | Range of Heights |
|---|---|---|---|---|---|
| 8–12 | 2nd, | 9/16 | 7/16 to 13/16 | 1/4 | 3/16 to 3/8 |
| 13–17 | 3rd | (14.3) | (11 to 21) | (6.4) | (4.8 to 9.5) |
| 20–22, | 5th, | 1/2 | 7/16 to 3/4 | 1/4 | 3/16 to 3/8 |
| 23–34 | 6th | (12.7) | (11 to 19) | (6.4) | (4.8 to 9.5) |
| 35–36 | 7th | 7/16 | 3/8 to 5/8 | 5/16 | 1/4 to 3/8 |
| | | (11) | (9.5 to 16) | (8.2) | (6.4 to 9.5) |
| 37–39 | 8th | 3/8 | 5/16 to 1/2 | 5/16 | 1/4 to 3/8 |
| | | (9.5) | (8.2 to 12.7) | (8.2) | (6.4 to 9.5) |
| 40–42 | 9th | 1/2 | 3/8 to 5/8 | 1/4 | 3/16 to 3/8 |
| | | (12.7) | (9.5 to 16) | (6.4) | (4.8 to 9.5) |
| 43–44 | 10th | 1/2 | 3/8 to 5/8 | 5/16 | 1/4 to 7/16 |
| | | (12.7) | (9.5 to 16) | (8.2) | (6.4 to 11) |
| 48–51 | 11th | 7/16 | 3/8 to 5/8 | 1/4 | 3/16 to 3/8 |
| | | (11) | (9.5 to 16) | (6.4) | (4.8 to 9.5) |
| 52–54 | 12th | 1/4 | 3/16 to 3/8 | 5/16 | 1/4 to 3/8 |
| | | (6.4) | (4.8 to 9.5) | (8.2) | (6.4 to 9.5) |
| 55–56 | 13th | 3/8 | 7/16 to 13/16 | 5/16 | 1/4 to 3/8 |
| | | (9.5) | (11 to 21) | (8.2) | (6.4 to 9.5) |
| 57–58 | 14th | 1/2 | 3/8 to 5/8 | 5/16 | 1/4 to 3/8 |
| | | (12.7) | (9.5 to 16) | (8.2) | (6.4 to 9.5) |
| 59 | 15th | 1/4 | 5/16 to 9/16 | 5/16 | 1/4 to 3/8 |
| | | (6.4) | (to 14.3) | (8.2) | (6.4 to 9.5) |
| 64–65 | 16th | 3/8 | 1/4 to 9/16 | 3/8 | 1/4 to 1/2 |
| 66–67 | 17th | (9.5) | (6.4 to 14.3) | (9.5) | (6.4 to 12.7) |
| 68 | 18th | | | | |

As can be seen from the foregoing table, the overall size of a number of my bi-directional razor designs will very likely be regarded by a typical user of a wet razor as being really no bigger or heavier than the existing uni-directional wet razor he or she may be using. I believe that the size, weight, balance and overall appearance of such bi-directional razor designs should be readily accepted by consumers. Further, once the distinct advantages of bi-directional razors and shaving are appreciated by consumers, bi-directional razors may well achieve widespread use.

Epilogue

The term "razor blade strip" as used herein, including the claims, encompasses any elongated blade device having a sharpened edge, no matter how constructed, and no matter whether flat or angled. Thus, this term covers blade strips made of a single piece of metal or other sharpened or sharpenable material. It also covers razor blade strips made by bonding a thin gauge strip of metal to a more rigid piece of metal, by laser spot welding or the like, like the blades used in the Gillette Sensor razors.

Those skilled in the field will appreciate that the foregoing eighteen illustrated and discussed embodiments of the bi-directional razor structures and systems of the present invention are subject to modification and change without departing from the scope of the invention as recited in the claims below. Needless to say, the size, proportion, materials, weight and clearances of the various components used in the razor heads, handles and movable connection head-to-handle mechanisms of the bi-directional razors of the present invention can be varied as needed or desired. A number of other possible modifications have already been described above. Further changes are clearly possible, as will now be discussed first in the following examples.

(1) Different features and aspects of one embodiment may be combined with another embodiment to provide a bi-directional razor or system with the desired features from both. (2) In the tenth embodiment with its two working planes, the blade strips are shown in a flexible molded plastic seat structure. Those skilled in the art will readily appreciate that this embodiment could be changed to have a substantially rigid head, such as an assembled head including a blade seat structure, blade spacers and blade-retaining cap with pins for interlocking the blade strips into position. (3) The lubricant strip used in my embodiments may also be built into the razor head structure through impregnation or molding, rather than being a separate strip glued on to the razor's cap. In other words, a solid shaving aid strip may be provided as an integral portion of the cap or other structural member in any form that is substantially immovable. (4) A smoothly finished glide strip or surface which does not dissolve with use may be used in place of a dissolving lubricant strip material. The glide surface can be made of the same plastic material as the rest of the head. Alternatively any suitably smooth or slippery material may be used as a glide strip by being integrally molded, bonded or mechanically fastened to the cap structure of the bi-directional razor. The glide strip may be made of polytetrafluoroethylene (PTFE), or of molded plastic coated by vapor deposition or other suitable methods with a smooth slippery relatively wear-resistant and substantially inert layer. Such a layer could be gold, silver, chrome or any other metal suitable for contact with human skin, or a non-toxic glassy material such as silicon oxide or the like. (5) The individually sprung blades disclosed in the thirteenth embodiment may be provided in a bi-directional structure which looks like a bi-directional version of the double-bladed Gillette Sensor razor widely sold in recent years. U.S. Pat. Nos. 4,270,268 and 4,492,024, both to Jacobson, which are hereby incorporated by reference, disclose Sensor style spring-loaded blade structures. Such spring-loaded blade structures may be utilized in the manner generally taught in the thirteenth embodiment of the present invention to achieve a bi-directional razor blade structure. (6) Any type of conventional or suitable pin or post arrangement, beyond those already disclosed herein, may be utilized to retain the elongated blade strips within the bi-directional razor head structures of the present invention. In addition, the blades may also be attached without the need for rivet portions by direct molding, or by being held captive in a suitable clamp between the clamp and platform portions, such as the clamping mechanism disclosed in U.S. Pat. No. 4,403,413 to Trotta. (7) The sharpened edges of the rear blade strips in the fifth embodiment are shown to be slightly elevated relative to the working plane defined in part by the sharpened edge of its forward blade strip. This technique for optimizing the cutting action of the rearward blade strips, by having each rearward blade protrude ever so slightly more than the blade strip in front of it may be utilized in all embodiments of the present invention which are shown with all of the sharpened edges of the blade strips being in a common plane. (8) Any of my bi-directional razors disclosed above may be constructed as a detachable, replaceable cartridge-style razor head, and can be designed so that they can be used with any conventional or suitable re-usable handle.

Thus, it is to be understood that the present invention is by no means limited to the particular constructions herein disclosed and/or shown in the drawings. Instead, the present invention also encompasses any modifications or equivalents within the scope of the disclosures that are fairly covered by the claims set forth below.

I claim:

1. A method of wet shaving with a manual razor having a handle and single razor head by moving the handle and razor head bi-directionally against the skin so as to cut hair successively in two opposite directions while maintaining continuous contact between the razor head and the skin as the head is successively moved in opposite directions, the method comprising the steps of:

(a) providing a manual razor having a handle supporting a single head provided with at least first and second blades, each blade oriented in a specified plane of inclination relative to the skin, each blade having a single substantially straight sharpened edge arranged in a single effective working plane with the sharpened edge of the other blade, the first blade having a sharpened edge that faces away from the sharpened blade edge of the second blade;

(b) moving the handle and razor head of the razor in a first direction so the head and blades are moved as a single unit along an area of skin while maintaining said specified plane of inclination of said first blade relative to the skin in order to cut hair on the skin with the sharpened edge of the first blade; and (c) without lifting the razor head relative to the skin, moving the handle and razor head of the razor in a second direction opposite the first direction so the head and blades are moved as a single unit along the same area of skin while maintaining said specified plane of inclination of said second blade relative to the skin in order to cut hair on the same area of skin with the sharpened edge of the second blade.

2. A method of wet shaving bi-directionally as in claim 1, wherein:

during step (b), the sharpened edge of the second blade is scraped along the skin while maintaining said specified plane of inclination and does not cut hair as the second blade trails behind the first blade performing the cutting action, and during step (c), the sharpened edge of the first blade is scraped along the skin while maintaining said specified plane of inclination and does not cut hair as the first blade trails behind the second blade performing the cutting action.

3. A method of wet shaving bi-directionally as in claim 1, wherein:

as part of step (a), a manual razor is provided that has third and fourth blades each of which has a single substantially straight sharpened edge, the third blade being associated with and spaced closely to the first blade and forming therewith a first set of blades that operate together, the fourth blade being associated with and spaced closely to the third blade and forming therewith a second set of blades that operate together, and wherein during step (b), both the sharpened edges of the first and third blades are operative to cut hair as the head is moved in the first direction along the skin, wherein at least one of said first blade and said third blade maintain a specified plane of inclination relative to the skin; and during step (c), both the sharpened edges of the second and fourth blades are operative to cut hair as the head is moved in the second direction along the skin, wherein at least one of said second blade and said fourth blade maintain a specified plane of inclination relative to the skin.

4. A method of wet shaving bi-directionally as in claim 3, wherein:

during step (b), the sharpened edges of the second set of blades scrape along the skin while maintaining said specified plane of inclination as the blades of the second set trail behind the blades of the first set which are performing the cutting action, and during step (c), the sharpened edges of the first set of blades scrape along the skin while maintaining said specified plane of inclination as the blades of the first set trail behind the blades of the second set which are performing the cutting action.

5. A method of wet shaving bi-directionally as in claim 3, wherein:

as part of step (a), a manual razor is provided, wherein the sharpened edges of the first and second sets of blades are respectively located in first and second working planes, which working planes are angled apart from one another by less than about fifteen degrees, and wherein during step (b), the sharpened edges of the second set of blades are removed from contact with the skin; and during step (c), the sharpened edges of the first set of blades are removed from contact with the skin.

6. A method of wet shaving bi-directionally as in claim 3, wherein:

as part of step (a), a manual razor is provided, whereon the razor head is movable through a range of at least about 30 degrees upon the handle about at least one axis of rotation, and the sharpened edges of said first and second sets of blades are respectively located in first and second working planes, which working planes are angled apart from one another by at least fifteen degrees; and as part of step (b), the handle and head are moved in a first direction so that the first working plane and first set of blades are moved along an area of skin in order to cut hair on the skin with the sharpened edges of the first set of blades; and as part of step (c), without lifting the razor head relative to the skin, the handle and head are moved in a second direction opposite the first direction, causing the razor head to move so that the second working plane and second set of blades are moved into contact with the area of skin, so that the sharpened edges of the second set of blades are positioned while moving in the second direction in an orientation to cut hair.

7. A method of wet shaving as in claim 3, wherein:

as part of step (a), a manual razor is provided where the razor head is pivotable upon the handle to compensate for contour changes in the skin along the path over the skin taken by the razor head, and the first and second sets of blades are arranged on the single head such that sharpened edges of the first set of blades face away from the sharpened edges of the second set of blades and all of the sharpened edges are in the same general working plane, and during step (b), the sharpened edges of the second set of blades scrape along the skin, without cutting hair, at a distinct angle from the first set of blades as the blades of the second set trail behind the blades of the first set which are performing the cutting action, and during step (c), the sharpened edges of the first set of blades scrape along the skin, without cutting hair, at a distinct angle from the second set of blades as the blades of the first set trail behind the blades of the second set which are performing the cutting action.

8. A method of wet shaving as in claim 3, wherein:

as part of step (a), a manual razor is provided that has said first and third blades arranged in a substantially parallel relation and said second and fourth blades arranged in a substantially parallel relation, and wherein during step (b), both the sharpened edges of the first and third blades are operative to cut hair as the head is moved in the first direction along the skin, wherein both said first blade and said third blade maintain a specified plane of inclination relative to the skin; and during step (c), both the sharpened edges of the second and fourth blades are operative to cut hair as the head is moved in the second direction along the skin, wherein both said second blade and said fourth blade maintain a specified plane of inclination relative to the skin.

9. A method of wet shaving bi-directionally as in claim 3, wherein:

during step (b), the sharpened edges of the second set of blades scrape along the skin at an angle more than 90 degrees from the first set of blades while maintaining said specified plane of inclination as the blades of the second set trail behind the blades of the first set which are performing the cutting action, and during step (c), the sharpened edges of the first set of blades scrape along the skin at an angle more than 90 degrees from the second set of blades while maintaining said specified plane of inclination as the blades of the first set trail behind the blades of the second set which are performing the cutting action.

10. A method of wet shaving bi-directionally as in claim 3, wherein:

as part of step (a), a manual razor is provided that has said first and second sets of blades mounted in a floating arrangement, such that said first and second sets of blades are disposed to move relative to the head; and during step (b), at least one of said first blade and said third blade are able to respond to undulations of the skin surface, while maintaining a specified plane of inclination relative to the skin; and during step (c), at least one of said second blade and said fourth blade are able to respond to undulations of the skin surface, while maintaining a specified plane of inclination relative to the skin.

11. A method of wet shaving with a manual razor having a handle and single razor head by moving the handle and razor head bi-directionally against the skin so as to cut hair successively in two opposite directions while maintaining continuous contact between the razor head and the skin as the head is successively moved in opposite directions, the method comprising the steps of:

(a) providing a manual razor having a handle supporting a single head provided with at least first and second sets of blades, each set of blades comprising at least two individual blades disposed in a substantially parallel relation, each blade having a single substantially straight sharpened edge, wherein said first and second sets of blades are respectively arranged upon said single head such that the sharpened edges of each set of blade face generally away from each other, such that each blade is maintained in a specified plane of inclination relative to the skin, and such that the cooperation of sharpened blade edges of each set form first and second effective working planes for shaving;

(b) moving the handle and razor head of the razor in a first direction so the head is moved along an area of skin in order to cut hair on the skin with the sharpened edges of the first set of blades; and (c) without lifting the razor head relative to the skin, moving the handle in a second direction opposite the first direction along the same area of skin, in order to cut hair on the same area of skin with the sharpened edges of the second set of blades.

* * * * *